US010109906B2

(12) United States Patent
Park

(10) Patent No.: US 10,109,906 B2
(45) Date of Patent: Oct. 23, 2018

(54) MULTIMODE RESONATOR

(71) Applicant: KMW INC., Hwaseong-si (KR)

(72) Inventor: Nam-Shin Park, Hwaseong-si (KR)

(73) Assignee: KMW INC., Hwaseong-si (KR)

( * ) Notice: Subject to any disclaimer, the term of this patent is extended or adjusted under 35 U.S.C. 154(b) by 3 days.

(21) Appl. No.: 15/490,930

(22) Filed: Apr. 19, 2017

(65) Prior Publication Data

US 2017/0279180 A1 Sep. 28, 2017

Related U.S. Application Data

(63) Continuation of application No. PCT/KR2014/009887, filed on Oct. 21, 2014.

(51) Int. Cl.
*H01P 7/06* (2006.01)
*H01P 1/208* (2006.01)

(52) U.S. Cl.
CPC ..... *H01P 7/06* (2013.01); *H01P 1/2082* (2013.01)

(58) Field of Classification Search
CPC .... H01P 7/06; H01P 7/105; H01P 7/10; H01P 1/2082; H01P 1/2084
USPC ..... 333/202, 219, 219.1, 227
See application file for complete search history.

(56) References Cited

U.S. PATENT DOCUMENTS

| | | | |
|---|---|---|---|
| 3,562,677 | A | 2/1971 | Gunderson |
| 2003/0090344 | A1 | 5/2003 | Wang et al. |
| 2006/0139127 | A1 | 6/2006 | Wada et al. |
| 2012/0293280 | A1 | 11/2012 | Chun et al. |

FOREIGN PATENT DOCUMENTS

| | | | |
|---|---|---|---|
| EP | 0632518 | A1 | 1/1995 |
| EP | 1962369 | A1 | 8/2008 |
| EP | 3208885 | A1 | 8/2017 |
| JP | 2001-085908 | A | 3/2001 |
| KR | 10-2004-100084 | A1 | 12/2004 |
| KR | 10-2014-0140751 | A | 12/2014 |
| WO | 2013-103269 | A1 | 7/2013 |

OTHER PUBLICATIONS

International Search Report for PCT/KR2014/009887, dated Jun. 26, 2015, and English Translation thereof.

Eric J. Naglich et al. "Intersecting Parallel-Plate Waveguide Loaded Cavities for Dual-Mode and Dual-Band Filters", IEEE Transcations on Microwave Theory and Techniques, pp. 1829-1838, vol. 61, No. 5, May 2013.

Huan Wang et al., "An Inline Coaxial Quasi-Elliptic Filter With Controllable Mixed Electric and Magnetic Coupling", IEEE Transactions on Microwave Theory and Techniques, pp. 667-673, vol. 57, No. 3, Mar. 2009.

Himanshu Joshi et al. "High Q Narrow-Band Tunable Filters with Controllable Bandwidth", 2009 IEEE MTT-S International Microwave Symposium Digest, pp. 629-632, Jun. 7-12, 2009.

Xuguang Wang, "Compact Quad-Mode Bandpass Filter Using Modified Coaxial Cavity Resonator With Improved Q-Factor", IEEE Transcations on Microwave Theory and Techniques, pp. 965-975, vol. 63, No. 3, Mar. 2015.

*Primary Examiner* — Stephen E Jones

(57) ABSTRACT

The present invention relates to a multimode resonator comprising: a housing provided with a cavity substantially corresponding to one accommodation space; a plurality of resonance arms arranged at preset intervals from each other in the cavity and generating resonance signals by complex mutual coupling; and a plurality of resonance legs for respectively supporting the plurality of resonance arms.

15 Claims, 64 Drawing Sheets

(a) (b) (c)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

MULTIMODE RESONATOR

CROSS REFERENCE TO RELATED APPLICATIONS

This application is a continuation of International Application No. PCT/KR2014/009887 filed on Oct. 21, 2014, the entire content of which is incorporated herein by reference.

TECHNICAL FIELD

The present disclosure relates to a resonator configured to implement a radio frequency (RF) filter, and more particularly, to a multi-mode resonator that outputs resonant frequencies in multiple resonant modes.

BACKGROUND ART

A radio frequency (RF) device such as an RF filter is typically configured using a connection structure of multiple resonators. Such a resonator is a circuit element that resonates at a specific frequency based on a combination of an inductor L and a capacitor C as an equivalent electronic circuit, and each resonator is structured such that a dielectric resonance (DR) element or metallic resonance element is installed inside a cavity such as a metallic cylinder or a rectangular parallelepiped, etc., surrounded by a conductor. Thus, each resonator allows existence of only an electromagnetic field of a unique frequency in a processing frequency band in the cavity, enabling microwave resonance. Generally, the resonator has a multi-stage structure including sequentially connected multiple resonance stages, each of which is formed for multiple cavities.

FIG. 1 illustrates an example of a conventional 6-pole bandpass filter 10. Referring to FIG. 1, in the conventional example, the bandpass filter 10 includes a housing 110 having, for example, six cavities sectioned by a predetermined interval or space inside hexahedral metal, and in each cavity, eight dielectric or metallic resonance elements 122 having a high quality factor (Q) values are fixed using a support. Input and output connectors 111 and 113 mounted on a side of the housing 110 and a cover 160 for shielding an open surface of the housing 110 are also provided in the bandpass filter 10. Each cavity of the housing 110 is sectioned by a partition 130 having predetermined-size windows 131 through 135 formed therein to adjust the amount of coupling between resonators, and an inner surface of the housing 110 is silver-plated to stabilize electric performance and to maximize conductivity. A coupling screw 175 that is insertable into the windows 131-135 through the cover 160 or the housing 110 is also provided for fine adjustment of the amount of coupling.

Each resonance element 122 is supported by the support provided erect on a bottom surface, and a tuning screw 170 for tuning a frequency is installed above each resonance element 122 in such a way to be inserted into the cavity through the cover 160 and thus, fine adjustment of a resonant frequency may be possible by frequency tuning with the tuning screw 170.

On a side of the housing 110 are provided the input and output connectors 111 and 113 which are connected to input and output feeding lines (not shown), respectively, in which the input feeding line delivers a signal input from the input connector to a resonance element on the first stage and the output feeding line delivers a signal input from a resonance element on the last stage to the output connector.

An example of an RF filter having the above-described structure is disclosed in a Korean Patent Laid-Open Gazette No. 10-2004-100084 (entitled "Radio Frequency Filter", published on Dec. 20, 2004, and invented by Jongkyu Park, Sangsik Park, and Seuntaek Chung) filed by the present applicant.

However, in the conventional bandpass filter (or band rejection filter), to construct a filter having multiple poles, a coupling means for coupling multiple cavities with each resonance element 122 is inevitably needed. That is, in the conventional filter, one resonance element 122 implements only a single resonance mode, and thus to implement a multi-mode filter, a structure in which multiple resonators are connected is required. As a result, a significantly large space is needed for implementation of the multi-mode filter, increasing the size, weight, and manufacturing cost of the filter.

As such, a filter having a multi-mode resonator structure is one of communication facilities that occupy large spaces, and research has been steadily and actively performed to reduce the size and weight of the filter. Moreover, in line with a recent trend where each base station has evolved into a small (or micro) cell to respond to high processing speed and improved quality in the recent mobile communication market, the small size and light weight of the filter are required more crucially.

SUMMARY

Accordingly, the present disclosure provides a multi-mode resonator capable of interconnecting multiple identical-mode resonant frequencies.

The present disclosure also provides a small-size multi-mode resonator.

The present disclosure also provides a light-weight multi-mode resonator.

The present disclosure also provides a multi-mode resonator contributing to manufacturing cost reduction.

To achieve the foregoing objects, there is provided a multi-mode resonator including a housing provided with a cavity corresponding to a substantially single accommodation space, a plurality of resonance arms which are arranged with a predetermined interval therebetween in the cavity and generate a resonant signal by multiple coupling therebetween, and a plurality of resonance legs which support the plurality of resonance arms, respectively.

The multi-mode resonator may further include a resonance rod installed in a center of the cavity.

The multi-mode resonator may further include a tuning structure installed in a center of an entire arrangement structure of the plurality of resonance arms to electrically float.

The multi-mode resonator may further include an input probe and an output probe which are connected to the plurality of resonance legs to exchange input and output signals with a pair of resonance arms among the plurality of resonance arms.

The cavity may have a polyhedral shape.

The plurality of resonance arms may be arranged with an equal interval therebetween.

BRIEF DESCRIPTION OF THE DRAWINGS

The above and other aspects, features, and advantages of the present invention will be more apparent from the following detailed description taken in conjunction with the accompanying drawings, in which.

DETAILED DESCRIPTION

Hereinafter, exemplary embodiments of the present invention will be described in detail with reference to the accompanying drawings. In the following description, specific details such as detailed elements, etc., will be provided, but they are merely provided to help the overall understanding of the present disclosure and it would be obvious to those of ordinary skill in the art that modifications or changes may be made to the specific details within the scope of the present disclosure.

The present disclosure proposes a multi-resonance-mode filter that provides multiple resonance modes. Conventionally, it is general that to provide, for example, four resonance modes, four cavities and one resonance element in each of the cavities are required. However, the multi-resonance-mode filter according to the present disclosure may provide four resonance modes (quadruple modes) or five resonance modes (quintuple modes) in one cavity.

Figure 1:
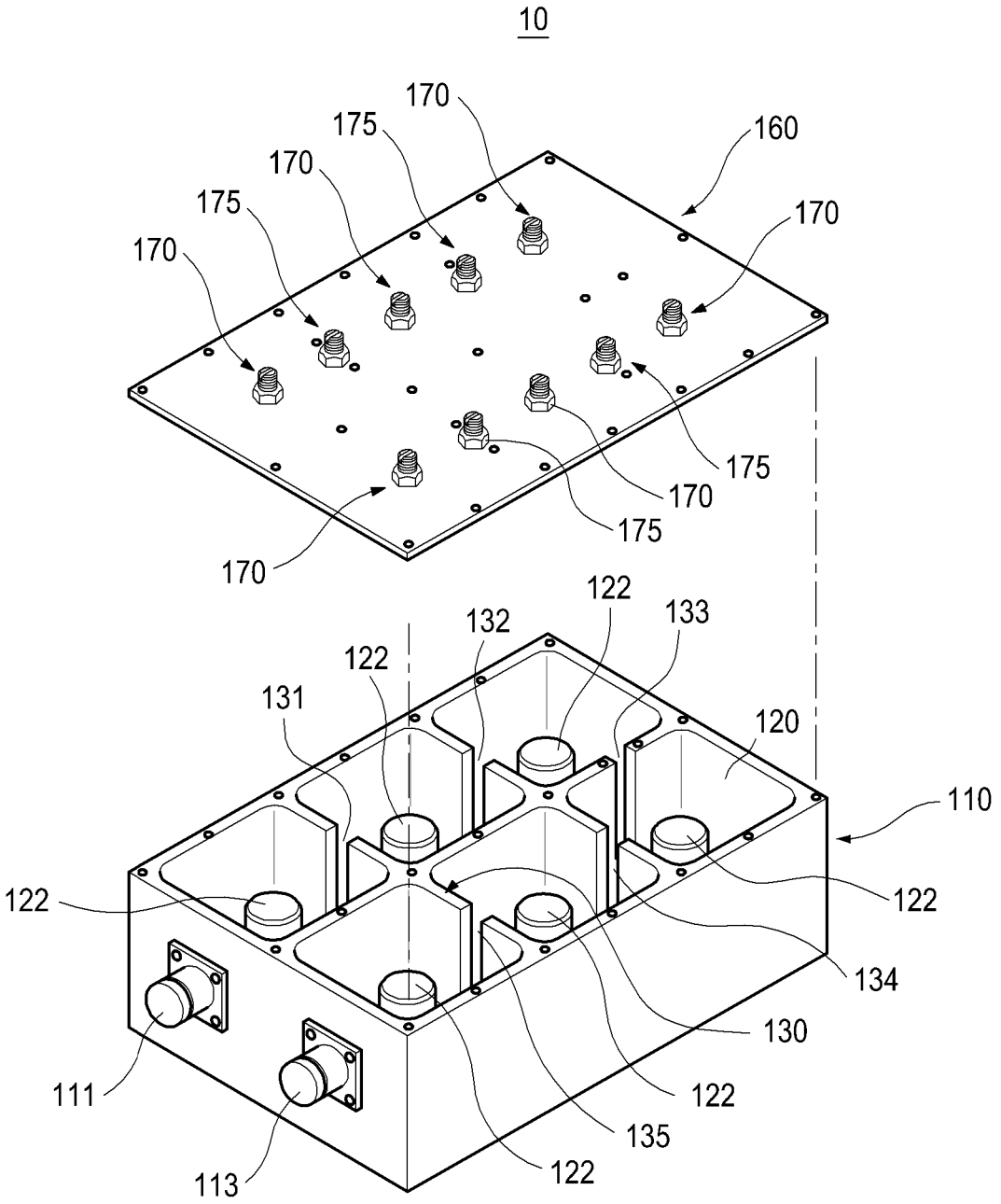
FIG. 1 is a partial exploded perspective view of an example of a conventional 6-pole bandpass filter.
Figure 2:
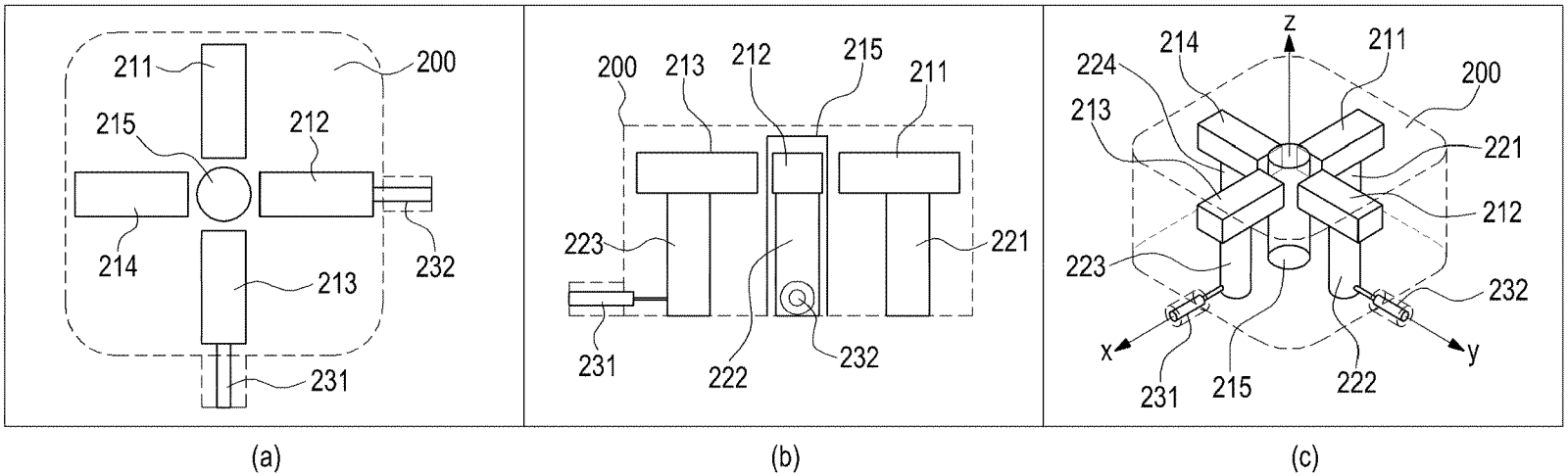
FIG. 2 is a structural diagram of a multi-mode resonator corresponding to a bandpass filter according to a first embodiment of the present disclosure.

FIG. 2 is a structural diagram of a multi-mode resonator corresponding to a bandpass filter according to a first embodiment of the present disclosure, in which (a) of FIG. 2 shows a top plan structure, (b) of FIG. 2 shows a side structure, and (c) of FIG. 2 shows a perspective projection structure. The resonator illustrated in FIG. 2 may include a cavity 200 having a space formed by a metallic housing (bottom cover) like a typical filter structure, and FIG. 2 does not illustrate a structure of the metallic housing, input and output connectors formed on an outer portion of the housing, etc., for convenience of a description.

Referring to FIG. 2, the multi-mode resonator according to the first embodiment of the present disclosure may include the cavity 200 in the shape of a rectangular box or in a shape similar thereto, which has a substantially single accommodation space inside a housing (not shown). However, such a structure of the cavity 200 may have various shapes such as a polyprism, a cylinder, and so forth, as well as the rectangular box.

In the cavity 200 are provided a plurality of resonance arms arranged with a predetermined interval or space therebetween. The plurality of resonance arms may be made of a metallic material, and may be arranged with an equal interval therebetween. In this case, the plurality of resonance arms are arranged in pairs to face each other and the pairs of resonance arms may be arranged to cross each other. More specifically, as in the first embodiment illustrated in FIG. 2, in the cavity 200, for example, resonance arms adjacent to each other are orthogonal to each other, and four resonance arms 211, 212, 213, and 214 are individually installed in such a way to be separated from each other. The four resonance arms 211 through 214, that is, first through fourth resonance arms 211 through 214 are arranged globally (planarly) in the shape of '+', that is, a center of the entire arrangement structure of the four resonance arms 211 through 214 corresponds to a center of the cavity 200. Each of the four resonance arms 211 through 214 has the shape of a rectangular parallelepiped bar that is longitudinally long. The four resonance arms 211 through 214 are fixedly installed by first through fourth resonance legs 221, 222, 223, and 224 which extend from (or are fixedly installed on) a bottom surface of the cavity 200 (a bottom surface of the housing), and are formed of, for example, a metallic material, in a cylindrical shape.

In the first embodiment illustrated in FIG. 2, a resonance rod 215 having a structure similar to a resonance element of a conventional filter structure is further installed in the center of the entire arrangement structure of the four resonance arms 211 through 214, that is, in the center of the cavity 200. The four resonance arms 211 through 214 and the resonance rod 215 are installed physically spaced apart from each other with a proper distance therebetween, such that signals therebetween may be complexly coupled with each other. The amount of signal coupling is adjusted based on adjustment of the distance. In such an entire structure of the four resonance arms 211 through 214, the four resonance arms 211 through 214 are complexly coupled with each other unlike in the structure of the conventional resonator that provides sequential coupling.

If the arrangement structure of the four resonance arms 211 through 214 and the resonance rod 215 is substituted into three axes, for example, x, y, and z axes, which are orthogonal to each other around the center of the cavity 200, then the first resonance arm 211 and the third resonance arm 213 may be on the x axis, the second resonance arm 212 and the fourth resonance arm 214 may be on the y axis, and the resonance rod 215 may be on the z axis.

Meanwhile, an input connector (not shown) and an output connector (not shown) may be formed on one pole of the x axis and one pole of the y axis, respectively, and an input probe 231 for connection with the input connector formed on one pole of the x axis and an output probe 232 for connection with the output connector formed on one pole of the y axis are provided, and the input probe 231 and the output probe 232 exchange input and output signals with one pair of resonance arms among the plurality of resonance arms 211 through 214. In an example of FIG. 2, the input probe 231 and the output probe 232 are directly or indirectly connected with the third resonance leg 223 and the second resonance leg 222, respectively, to deliver the input and output signals, thus exchanging the input and output signals with the third resonance arm 213 and the second resonance arm 212.

Figure 3A:
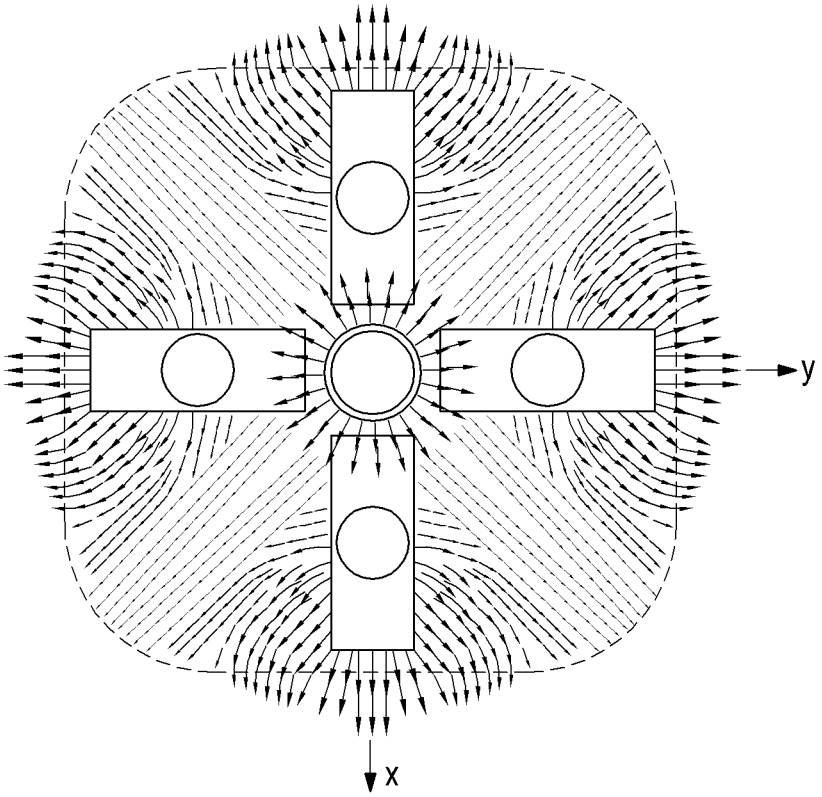
FIGS. 3A through 3E illustrate multi-mode resonance characteristics of the multi-mode resonator illustrated in FIG. 2.
Figure 3A:
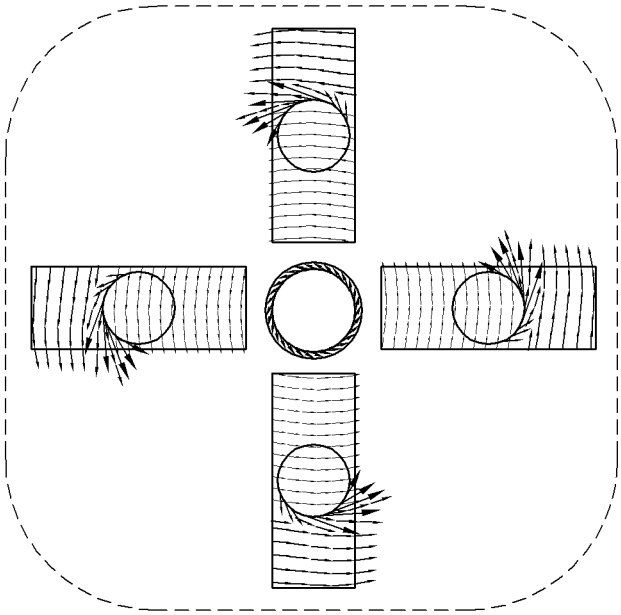
Figure 3B:
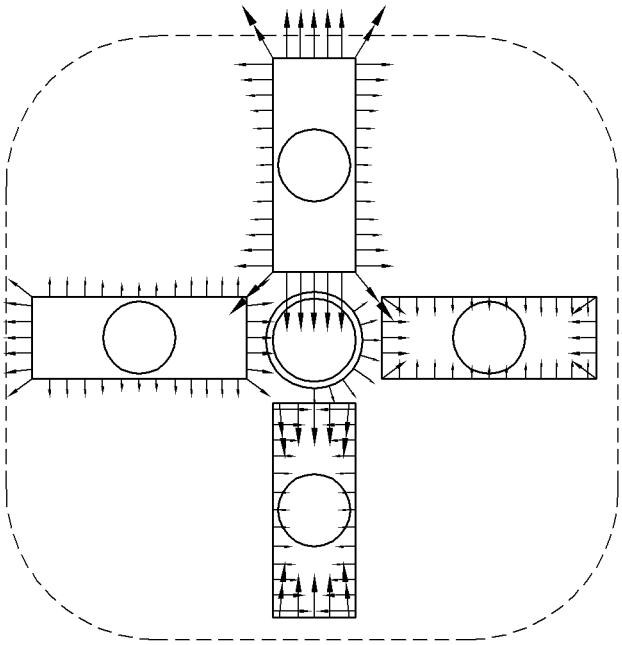
Figure 3B:
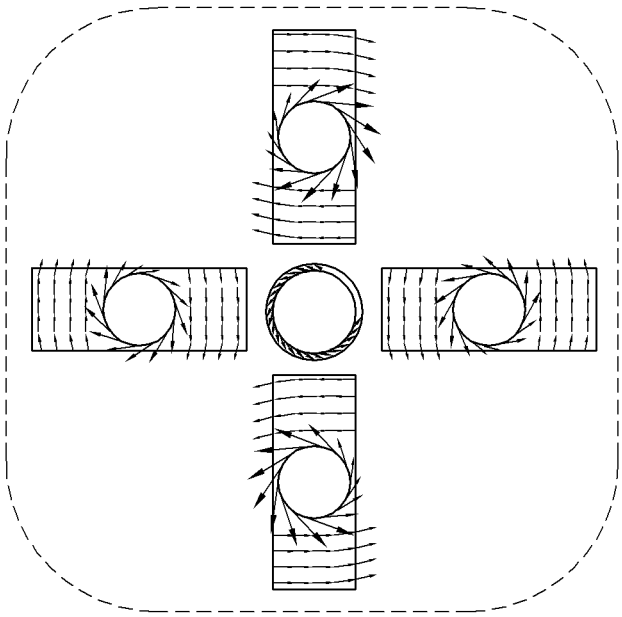
Figure 3C:
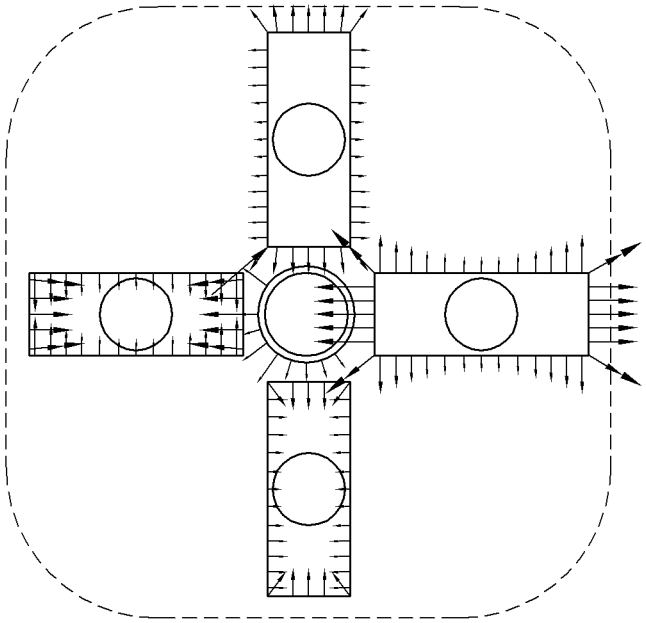
Figure 3C:
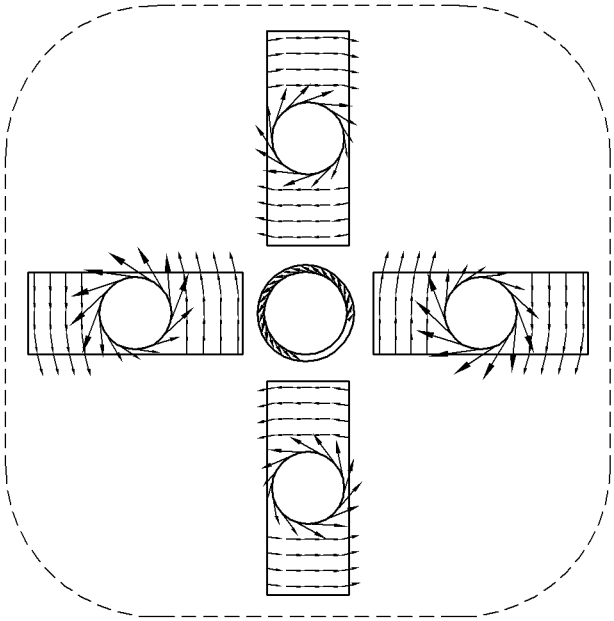
Figure 3D:
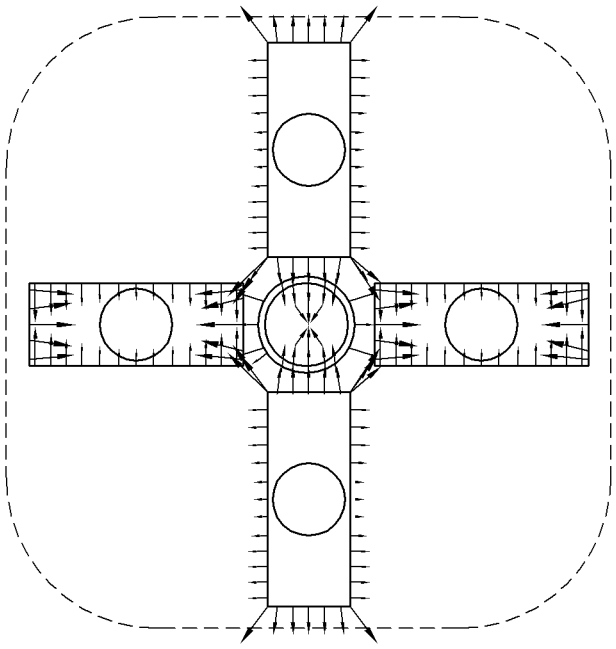
Figure 3D:
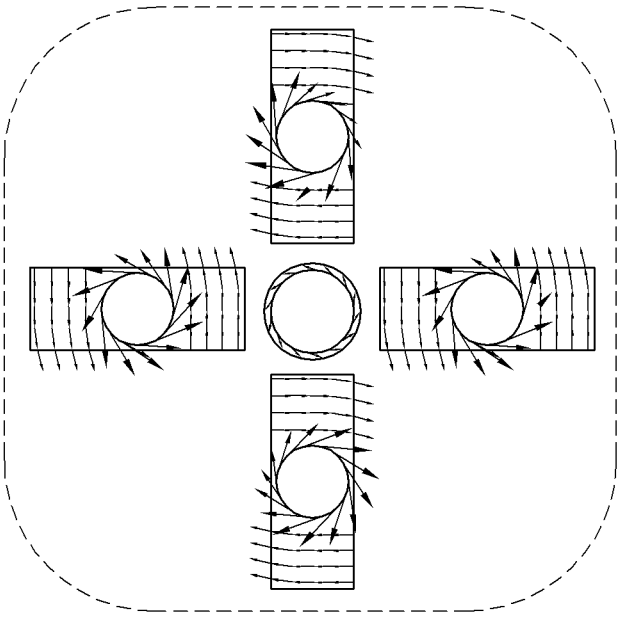
Figure 3E:
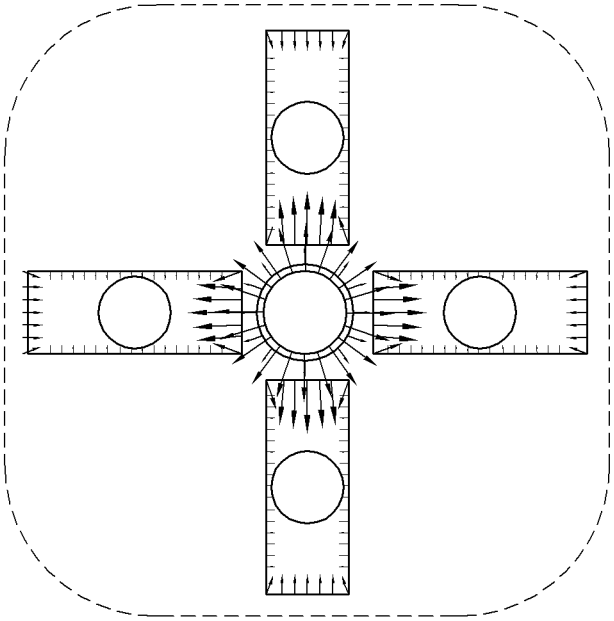
Figure 3E:
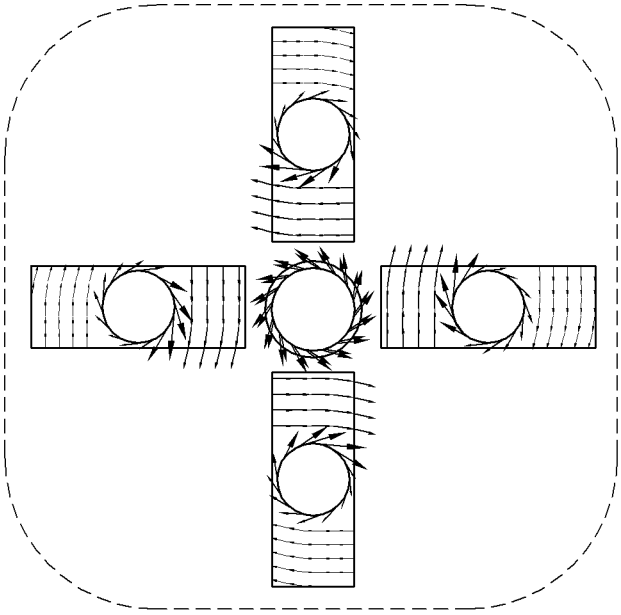

Multi-mode resonance characteristics of the resonator structured as described above are shown in FIGS. 3A through 3E. FIG. 3A illustrates a magnetic field (or an electric field) of a first resonance mode formed by a total combination (coupling) of a resonance structure, FIG. 3B illustrates a magnetic field (or an electric field) of a second resonance mode where dominant resonance is formed along the y axis, for example, by the second resonance arm 212 and the fourth resonance arm 214, FIG. 3C illustrates a magnetic field (or an electric field) of a third resonance mode where dominant resonance is formed along the x axis, for example, by the first resonance arm 211 and the third resonance arm 213, FIG. 3D illustrates a magnetic field (or an electric field) of a fourth resonance mode formed by a total combination of the first through fourth resonance arms 211 through 214, and FIG. 3E illustrates a magnetic field (or an electric field) of a fifth resonance mode where dominant resonance is formed along the z axis, for example, by the resonance rod 215. In each of FIGS. 3A through 3E, (a) shows E-field characteristics and (b) shows H-field characteristics. In FIGS. 3A through 3E, a direction of each arrow indicates a direction of an electric field or a magnetic field in a position in each resonance arm, and a size of each arrow indicates an intensity or strength of the electric field or the magnetic field.

Figure 4:
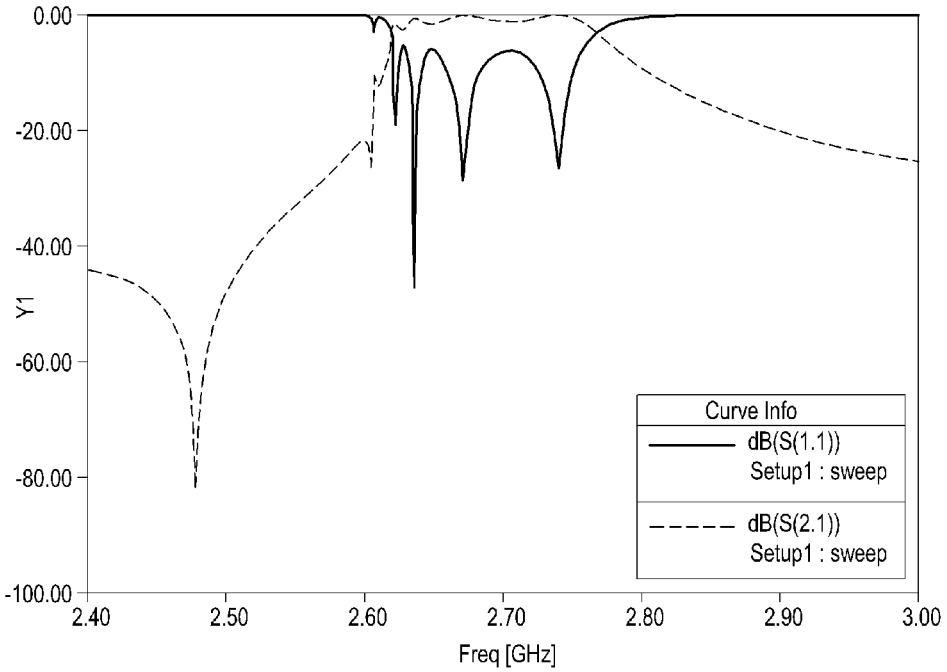
FIG. 4 is a graph showing frequency filtering characteristics of the multi-mode resonator illustrated in FIG. 2.

FIG. 4 is a graph showing an example of frequency filtering characteristics of the multi-mode resonator illustrated in FIG. 2. Referring to FIG. 4, it can be seen that frequency filtering characteristics vary with five multi-mode characteristics shown in FIGS. 3A through 3E.

As such, the multi-mode resonator according to the first embodiment of the present disclosure implements the five resonance modes in one cavity 200, and in this case, the multi-mode resonator structured according to the present disclosure has a quality factor (Q) value improved by about 30%-40% when compared to a general-structure transverse electric and magnetic (TEM) mode resonator having the same size or has a physical size reduced by about 30%-40% when compared to the general structure TEM mode resonator having the same Q value.

Meanwhile, in the above-described structure according to the first embodiment of the present disclosure, a frequency of each resonance mode may be shifted and a resonance mode of a proper frequency may be set and adjusted by changing a shape, a length, and a width of the first through fourth resonance arms 211 through 214, a length and a width of the first through fourth resonance legs 221 through 224, a distance of the first through fourth resonance legs 221 through 224 with respect to the center of the cavity 200, and a size and a height of the cavity 200, and so forth. If necessary, only three or four resonance modes may be implemented.

Figure 5:
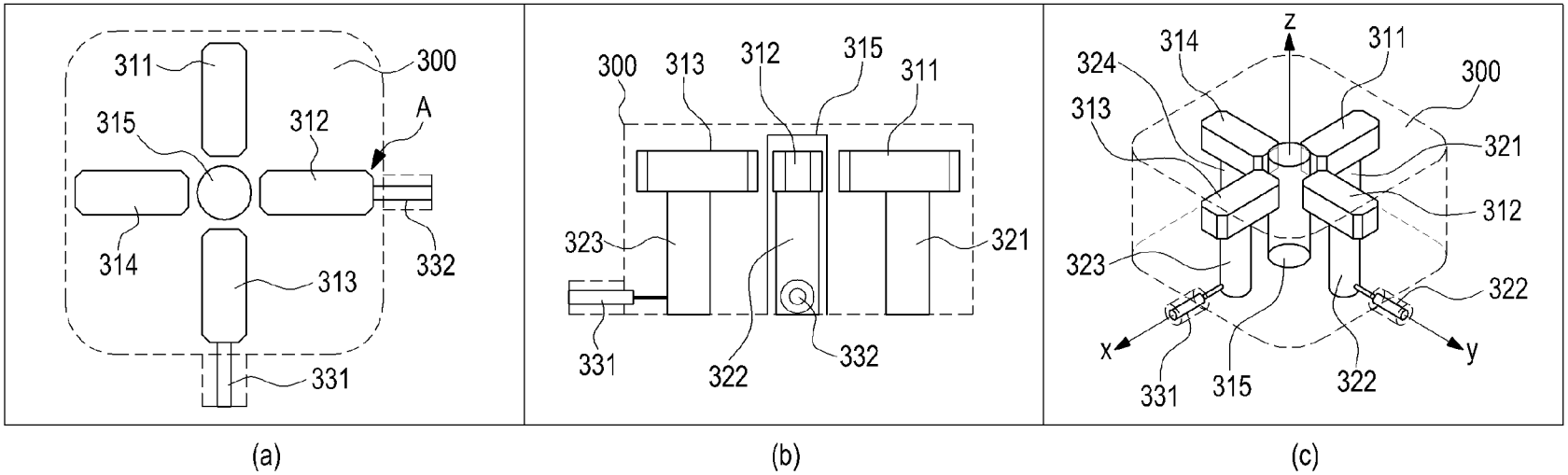
FIG. 5 is a structural diagram of a multi-mode resonator corresponding to a bandpass filter according to a second embodiment of the present disclosure.

FIG. 5 is a structural diagram of a multi-mode resonator corresponding to a bandpass filter according to a second embodiment of the present disclosure, in which (a) of FIG. 5 illustrates a top plan structure, (b) illustrates a side structure, and (c) illustrates a perspective projection structure. The resonator according to the second embodiment illustrated in FIG. 5, similarly with the structure according to the first embodiment illustrated in FIG. 2, may include a cavity 300 having a rectangular box shape or a shape similar thereto, four resonance ribs 311, 312, 313, and 314 arranged to have an overall '+' shape in the cavity 300, are orthogonal to each other, and are individually installed to be separated from each other, first through fourth resonance legs 321, 322, 323, and 324 that support the four resonance ribs 311, 312, 313, and 314, respectively, a resonance rod 315 installed in the center of the entire arrangement structure of the four resonance arms 311 through 314, and an input robe 331 and an output probe 332 connected to the third resonance leg 323 and the second resonance leg 322, respectively.

In the resonator according to the second embodiment structured as described above, unlike the structure according to the first embodiment illustrated in FIG. 2, as indicated by A in FIG. 5, at least a part of corner portions of each of the four resonance arms 411 through 414 in a rectangular bar shape is cut by processing such as trimming, etc., and with this structure change, characteristics such as coupling intensity, etc., are adjusted. In the example illustrated in FIG. 5, four corners of corner portions of the four resonance arms 411 through 414 are cut. In this way, through a change such as a cut structure of a corner of a resonance arm through trimming, etc., the intensity of coupling between the resonance arms, generation of a notch, etc. may be adjusted.

Figure 6:
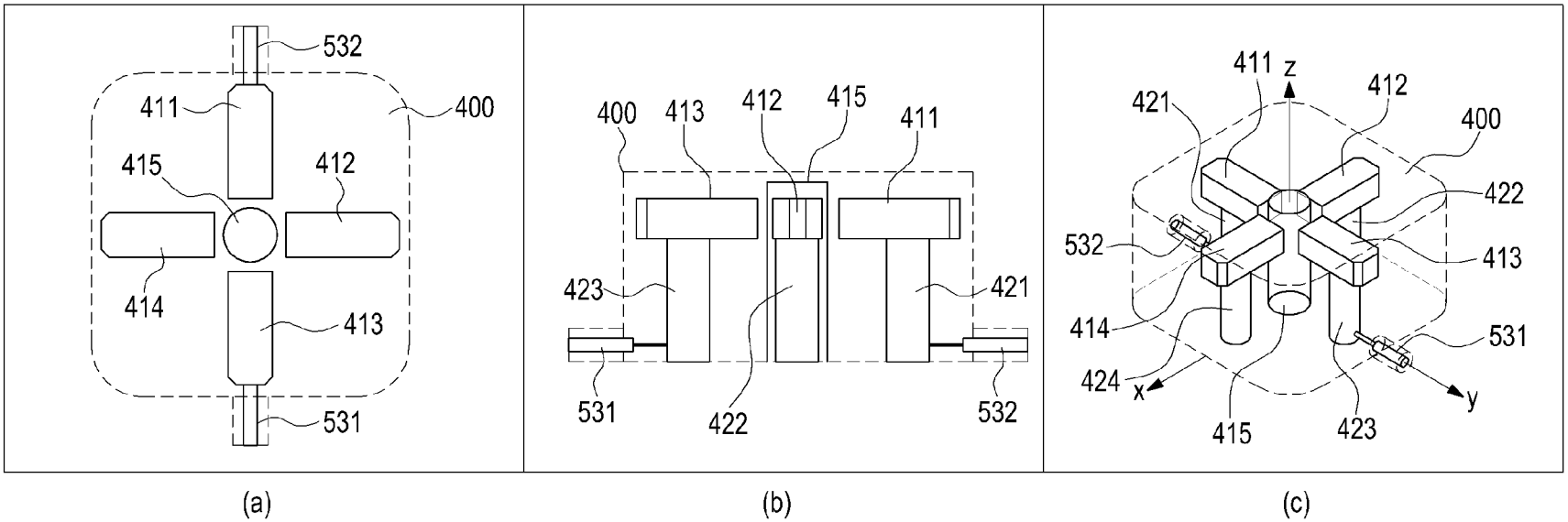
FIG. 6 is a structural diagram of a multi-mode resonator corresponding to a bandpass filter according to a third embodiment of the present disclosure.

FIG. 6 is a structural diagram of a multi-mode resonator corresponding to a bandpass filter according to a third embodiment of the present disclosure, in which (a) of FIG. 6 illustrates a top plan structure, (b) illustrates a side structure, and (c) illustrates a perspective projection structure. The resonator according to the third embodiment of the present disclosure illustrated in FIG. 6, like the structure according to the first embodiment illustrated in FIG. 2, may include a cavity 400, four resonance arms 411, 412, 413, and 414, first through fourth resonance legs 421, 422, 423, and 424, and a resonance rod 415.

In the third embodiment of the present disclosure, unlike in the structure according to the first embodiment, an input connector (not shown) and an output connector (not shown) may be formed in both poles on the x axis, respectively, and an input probe 531 and an output probe 532 for connection with the input connector and the output connector formed in both poles on the x axis are directly and indirectly connected to the third resonance leg 423 and the first resonance leg 421, respectively. With the structure according to the third embodiment illustrated in FIG. 6, five satisfactory resonance modes are formed.

Figure 7:
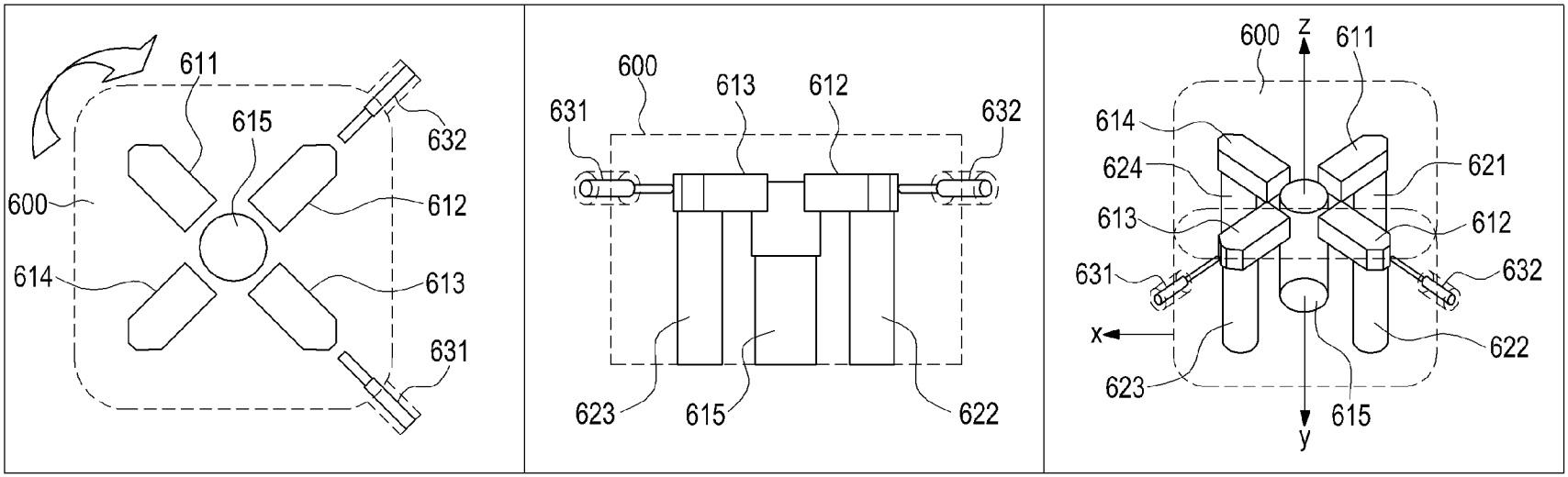
FIG. 7 is a structural diagram of a multi-mode resonator corresponding to a bandpass filter according to a fourth embodiment of the present disclosure.

FIG. 7 is a structural diagram of a multi-mode resonator corresponding to a bandpass filter according to a fourth embodiment of the present disclosure, in which (a) of FIG. 7 illustrates a top plan structure, (b) illustrates a side structure, and (c) illustrates a perspective projection structure. The resonator according to the fourth embodiment of the present disclosure illustrated in FIG. 7, like the structure according to the first embodiment illustrated in FIG. 2, may include a cavity 600, four resonance arms 611, 612, 613, and 614, first through fourth resonance legs 621, 622, 623, and 624, a resonance rod 615, and an input probe 631 and an output probe 632.

In the fourth embodiment according to the present disclosure, unlike in the structure according to the first embodiment, two corners of corner portions of the four resonance arms 611 through 614 are cut, and the four resonance arms 611 through 614 are arranged in the shape of X in the cavity 600 having a globally rectangular box shape. That is, the four arms may be arranged in positions rotated at 45 degrees when compared to the structure illustrated in FIG. 2. Thus, the input probe 631 and the output probe 632 are formed in the corner portions of the cavity 600.

Especially, in this case, the input probe 631 and the output probe 632 may directly deliver a signal to the third resonance arm 623 and the second resonance arm 622, respectively, instead of delivering the signal to the resonance arms through the resonance legs as in the first embodiment illustrated in FIG. 2.

Figure 8:
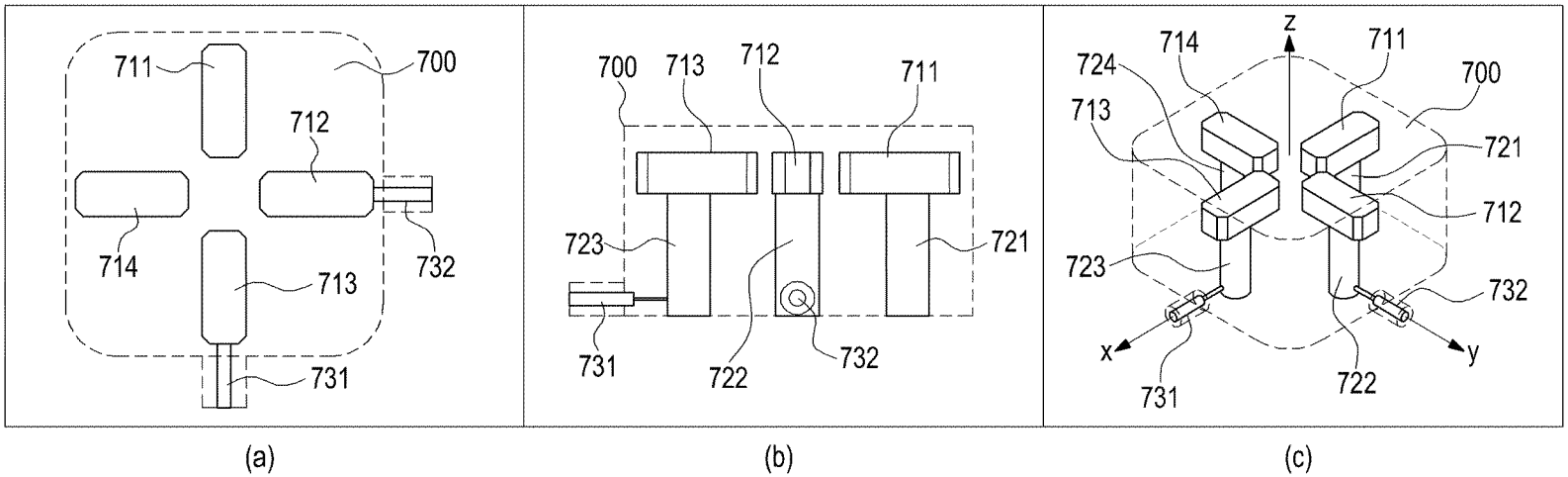
FIG. 8 is a structural diagram of a multi-mode resonator corresponding to a bandpass filter according to a fifth embodiment of the present disclosure.

FIG. 8 is a structural diagram of a multi-mode resonator corresponding to a bandpass filter according to a fifth embodiment of the present disclosure, in which (a) of FIG. 8 illustrates a top plan structure, (b) illustrates a side structure, and (c) illustrates a perspective projection structure. The resonator according to the fifth embodiment of the present disclosure illustrated in FIG. 8, like the structure according to the first embodiment illustrated in FIG. 2, may include a cavity 700, four resonance arms 711, 712, 713, and 714, first through fourth resonance legs 721, 722, 723, and 724, and an input probe 731 and an output probe 732.

However, the structure according to the fifth embodiment illustrated in FIG. 8 is such that the resonance rod is removed from (that is, is not included in) the structure according to the first embodiment. This structure is suitable for implementation of four resonance modes.

Figure 9:
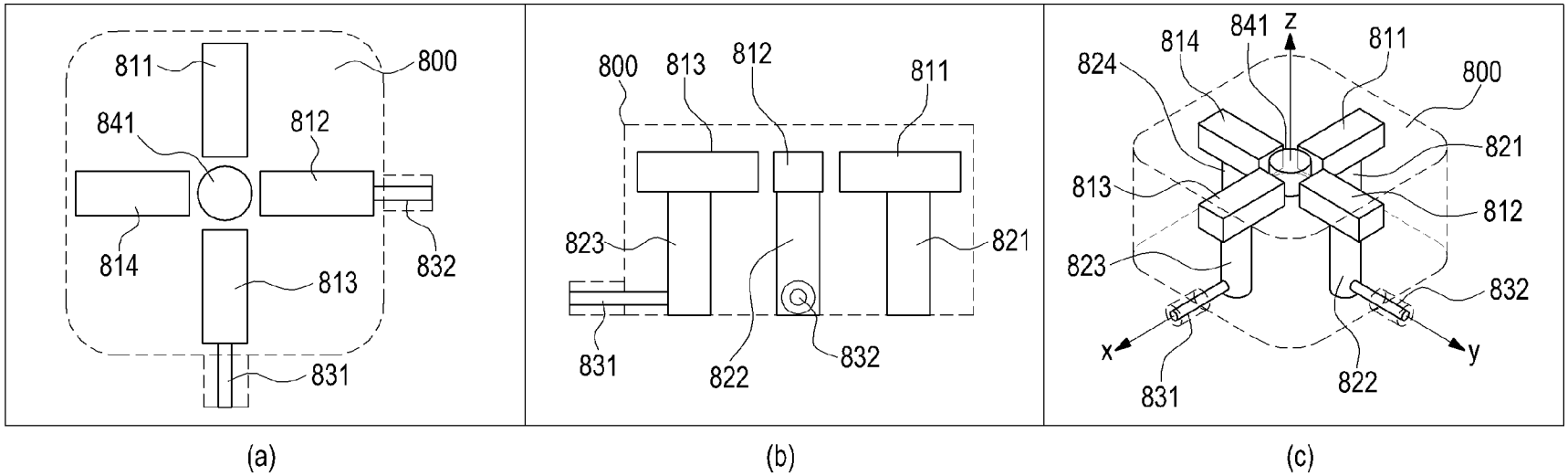
FIG. 9 is a structural diagram of a multi-mode resonator corresponding to a bandpass filter according to a sixth embodiment of the present disclosure.

FIG. 9 is a structural diagram of a multi-mode resonator corresponding to a bandpass filter according to a sixth embodiment of the present disclosure, in which (a) of FIG. 9 illustrates a top plan structure, (b) illustrates a side structure, and (c) illustrates a perspective projection structure. The resonator according to the sixth embodiment of the present disclosure illustrated in FIG. 9, mostly like the structure according to the fifth embodiment illustrated in FIG. 8, may include a cavity 800, four resonance arms 811, 812, 813, and 814, first through fourth resonance legs 821, 822, 823, and 824, and an input probe 831 and an output probe 832.

In the sixth embodiment illustrated in FIG. 9, in addition to the structure according to the fifth embodiment illustrated in FIG. 8, a metallic tuning structure 841, for example, in a cylindrical shape, is further installed to electrically float in the center of the entire structure of the four resonance arms 811 through 814 for signal coupling and coupling adjustment between corresponding resonance modes.

The coupling structure 841 is fixed and supported by a support member (not shown) made of a material such as $Al_2O_3$, Teflon, etc., on an inner surface of the housing or cover or adjacent resonance arms in the cavity.

Figure 10:
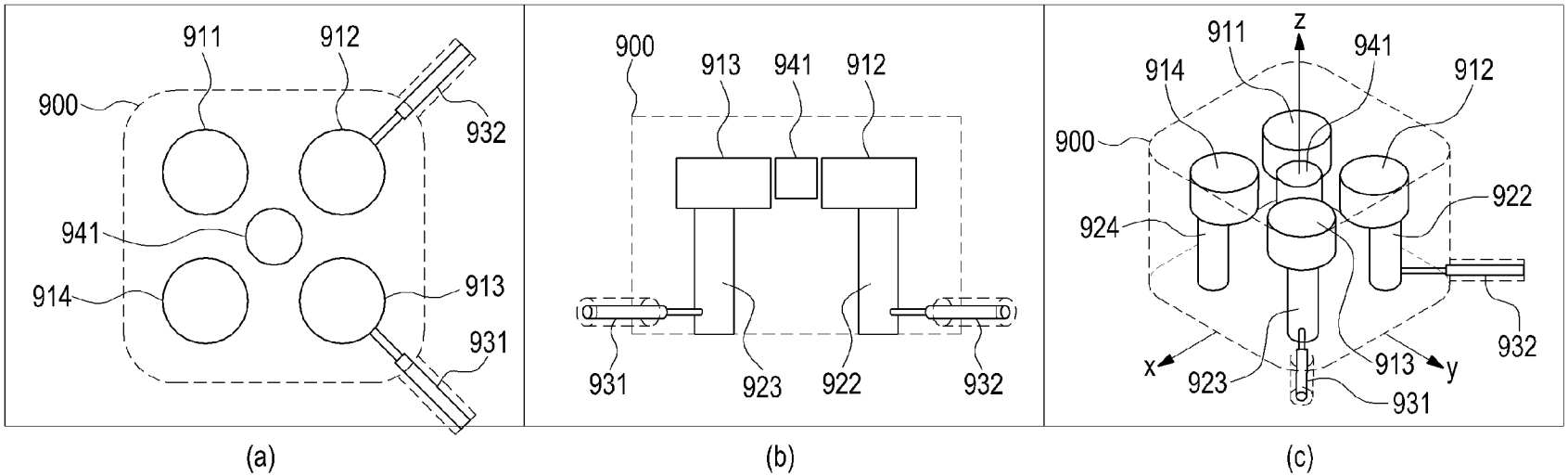
FIG. 10 is a structural diagram of a multi-mode resonator corresponding to a bandpass filter according to a seventh embodiment of the present disclosure.

FIG. 10 is a structural diagram of a multi-mode resonator corresponding to a bandpass filter according to a seventh embodiment of the present disclosure, in which (a) of FIG. 10 illustrates a top plan structure, (b) illustrates a side structure, and (c) illustrates a perspective projection structure. The resonator according to the seventh embodiment of the present disclosure illustrated in FIG. 10, mostly like the structure according to the sixth embodiment illustrated in FIG. 9, may include a cavity 900, four resonance arms 911, 912, 913, and 914, first through fourth resonance legs 921, 922, 923, and 924, an input probe 932 and an output probe 931, and a tuning structure 941.

In the seventh embodiment illustrated in FIG. 10, unlike in the structure according to the sixth embodiment illustrated in FIG. 9, the four resonance arms 911, 912, 913, and 914 are arranged in the shape of X in the cavity 900 having a globally rectangular box shape. In addition, the four resonance arms 911, 912, 913, and 914 have a globally cylindrical shape, rather than the globally rectangular shape.

Figure 11:
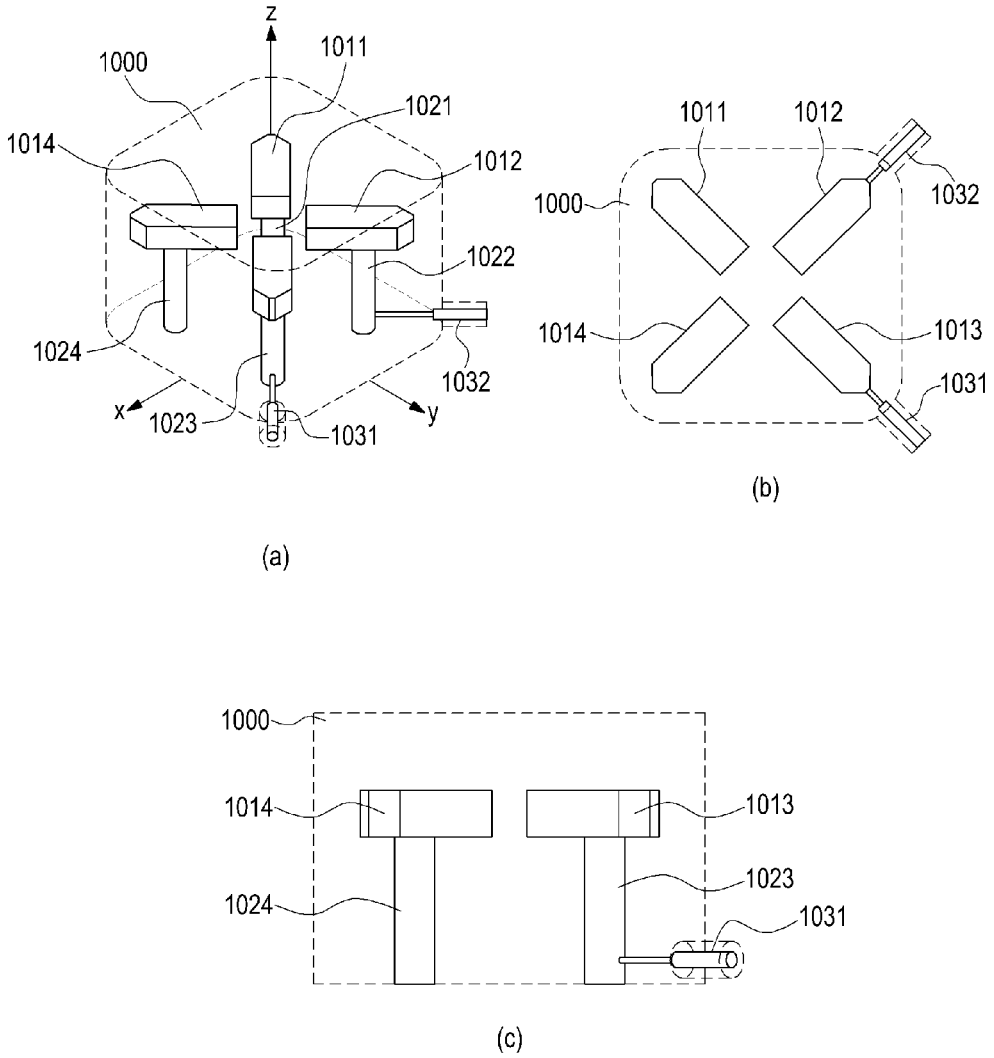
FIG. 11 is a structural diagram of a multi-mode resonator corresponding to a bandpass filter according to an eighth embodiment of the present disclosure.

FIG. 11 is a structural diagram of a multi-mode resonator corresponding to a bandpass filter according to an eighth embodiment of the present disclosure, in which (a) of FIG. 11 illustrates a perspective projection structure, (b) illustrates a top plan structure, and (c) illustrates a side structure. The resonator according to the eighth embodiment of the present disclosure illustrated in FIG. 11, like the structure according to the fourth embodiment illustrated in FIG. 7, may include a cavity 1000, four resonance arms 1011, 1012, 1013, and 1014, first through fourth resonance legs 1021, 1022, 1023, and 1024, and an input probe 1031 and an output probe 1032.

However, the structure according to the eighth embodiment illustrated in FIG. 11 is such that the resonance rod is removed from (that is, is not included in) the structure according to the fourth embodiment illustrated in FIG. 7. This structure is suitable for implementation of four resonance modes.

Figure 12:
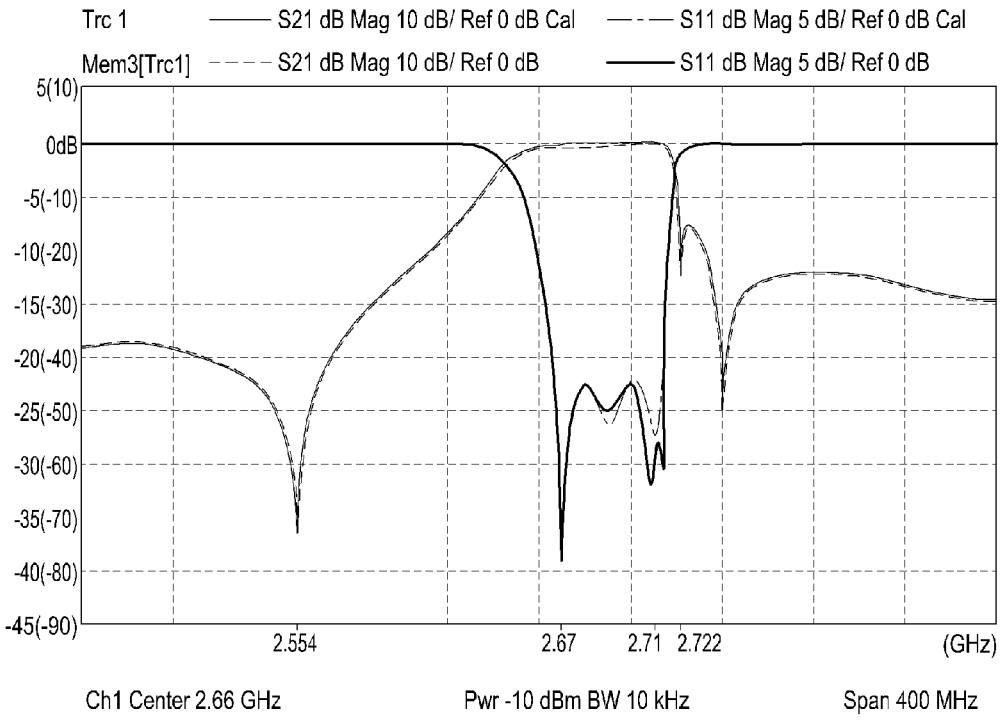
FIG. 12 illustrates frequency filtering characteristics of the multi-mode resonator illustrated in FIG. 11.

FIG. 12 is a graph showing an example of frequency filtering characteristics of the multi-mode resonator illustrated in FIG. 11. Referring to FIG. 12, it can be seen that frequency filtering characteristics vary with four multi-mode characteristics in the structure illustrated in FIG. 11.

Figure 13:
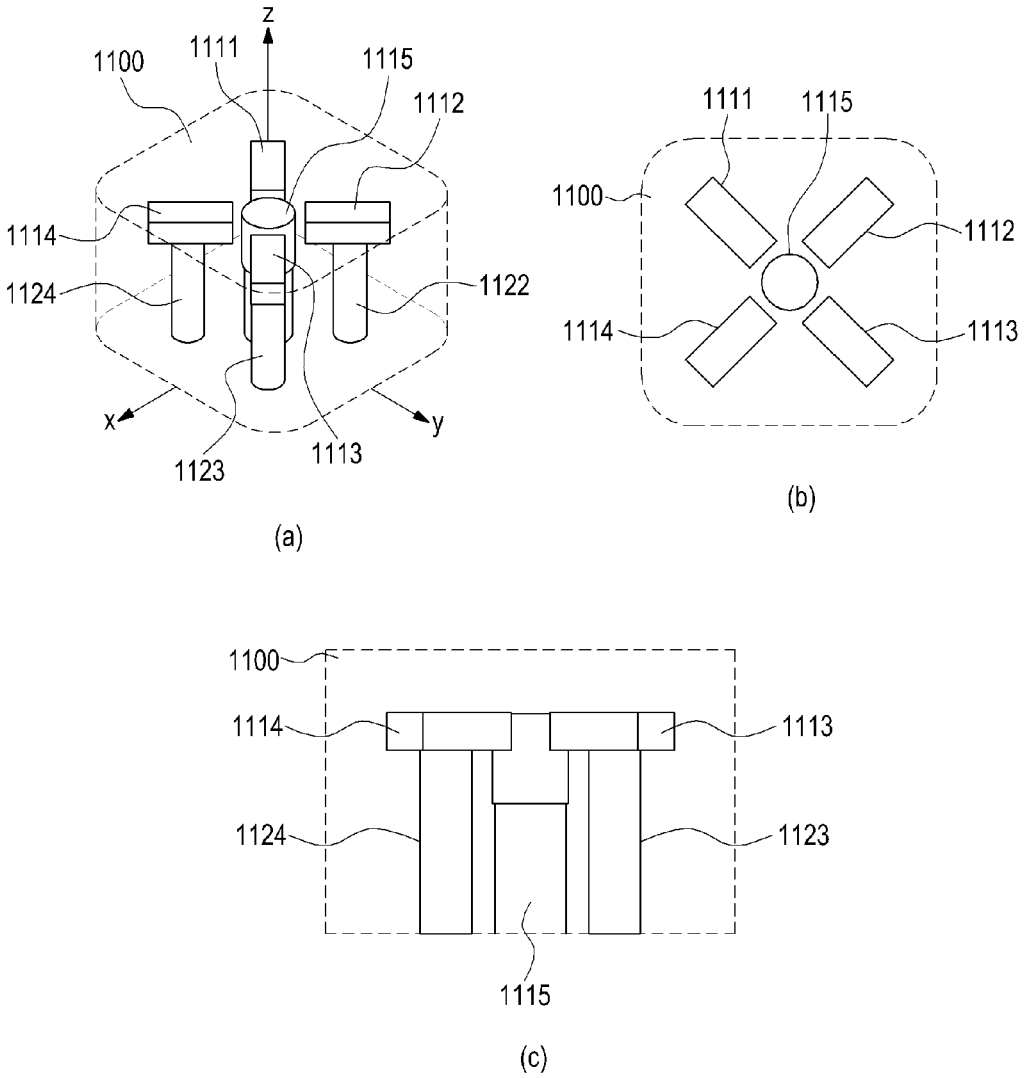
FIG. 13 is a structural diagram of a multi-mode resonator corresponding to a bandpass filter according to a ninth embodiment of the present disclosure.

FIG. 13 is a structural diagram of a multi-mode resonator corresponding to a bandpass filter according to a ninth embodiment of the present disclosure, in which (a) of FIG. 13 illustrates a perspective projection structure, (b) illustrates a top plan structure, and (c) illustrates a side structure. The resonator according to the ninth embodiment of the present disclosure illustrated in FIG. 13, like the structure according to the first embodiment illustrated in FIG. 2, may include a cavity 1100, four resonance arms 1111, 1112, 1113, and 1114, first through fourth resonance legs 1121, 1122, 1123, and 1124, and a resonance rod 1115.

In the ninth embodiment illustrated in FIG. 13, unlike in the structure according to the first embodiment illustrated in FIG. 2, the four resonance arms 1111, 1112, 1113, and 1114 are arranged in the shape of X in the cavity 1100 having a globally rectangular box shape. That is, the four arms may be arranged in positions rotated at 45 degrees when compared to the structure illustrated in FIG. 2. Thus, an input probe and an output probe are formed in corner portions of the cavity 1100.

Figure 14A:
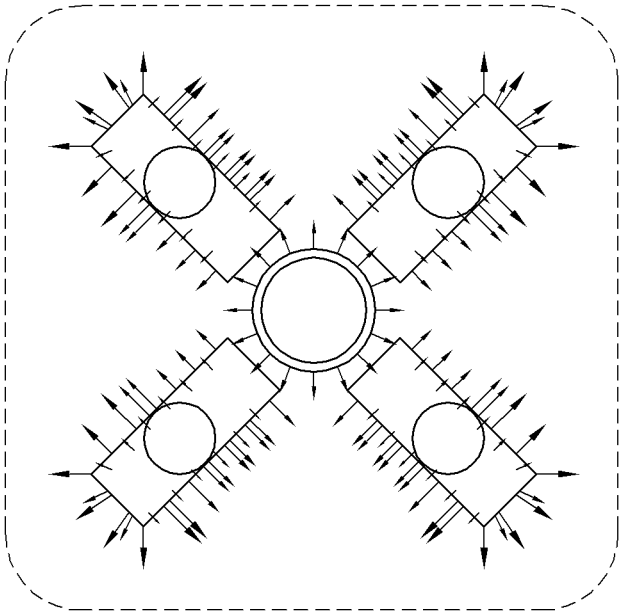
FIGS. 14A through 14E illustrate multi-mode resonance characteristics of the multi-mode resonator illustrated in FIG. 13.
Figure 14A:
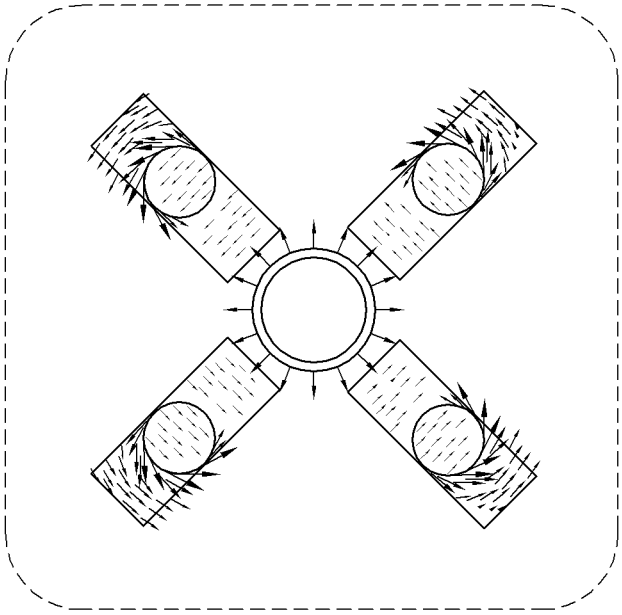
Figure 14B:
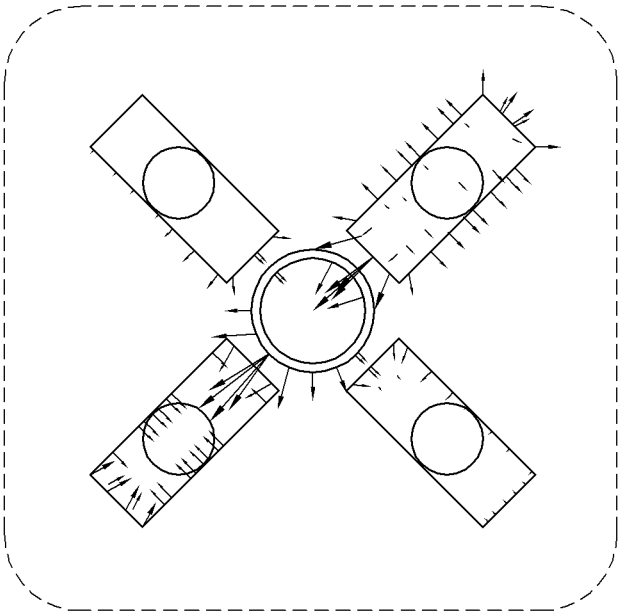
Figure 14B:
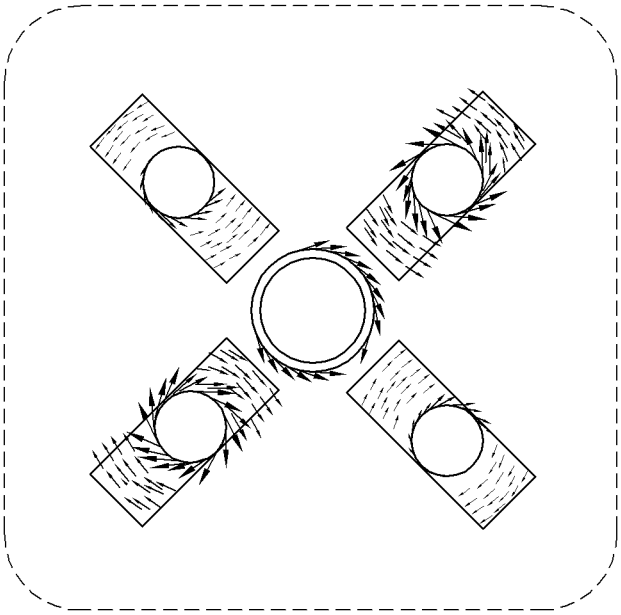
Figure 14C:
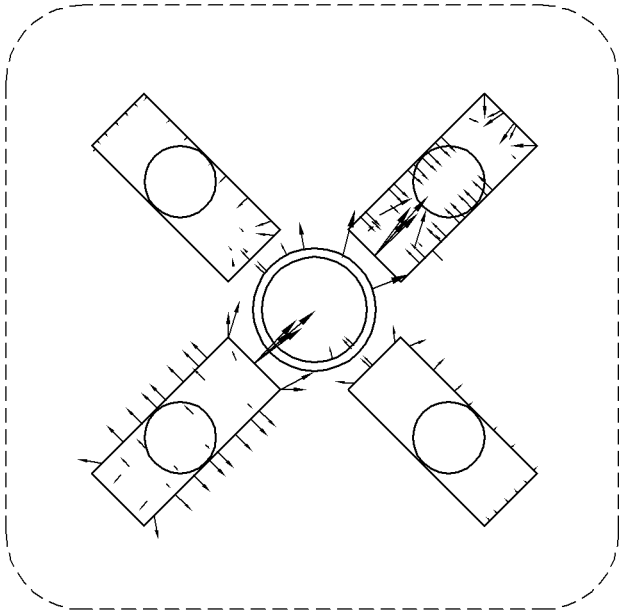
Figure 14C:
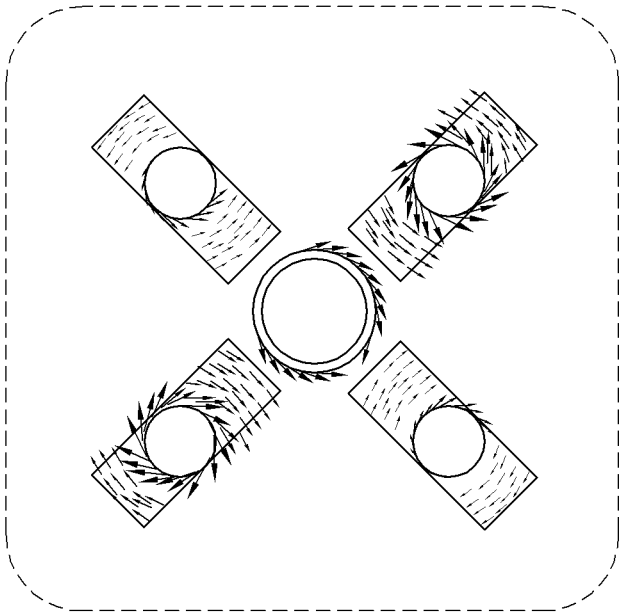
Figure 14D:
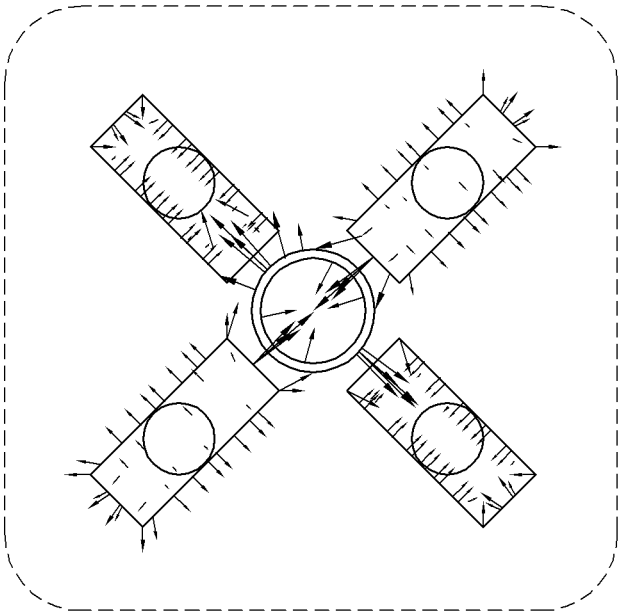
Figure 14D:
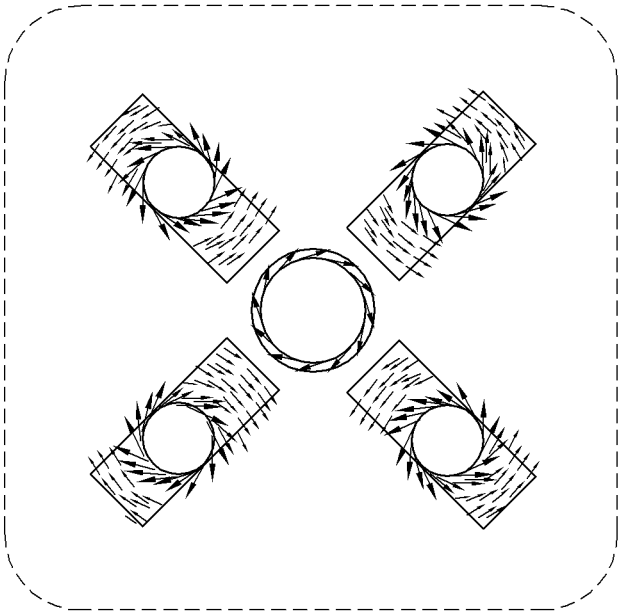
Figure 14E:
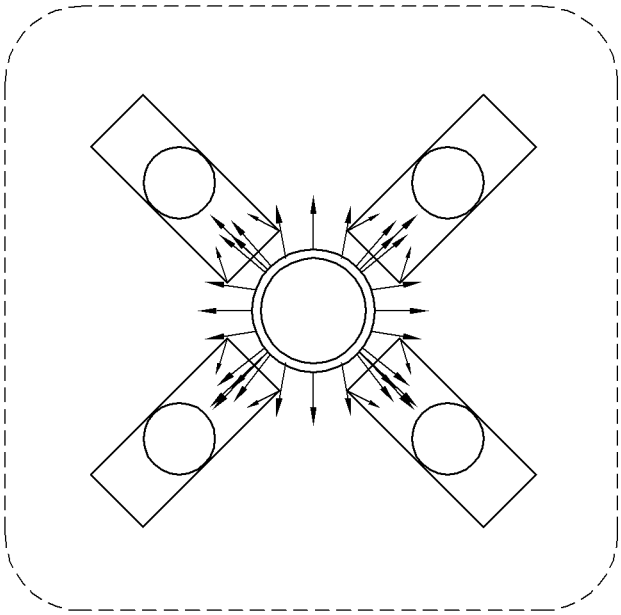
Figure 14E:
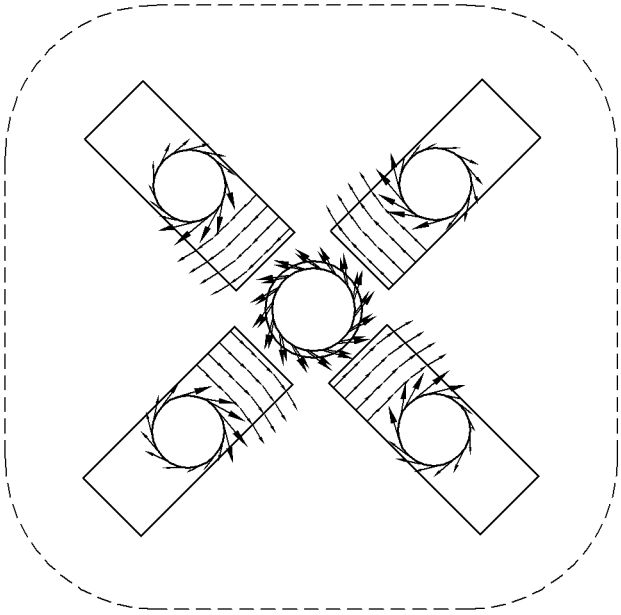

Multi-mode resonance characteristics of the resonator having the structure illustrated in FIG. 13 are illustrated in FIGS. 14A through 14E. FIG. 14A illustrates a magnetic field (or an electric field) of a first resonance mode formed by a total combination (coupling) of a resonance structure, FIG. 14B illustrates a magnetic field (or an electric field) of a second resonance mode formed by, for example, the second resonance arm 1112 and the fourth resonance arm 1114, FIG. 14C illustrates a magnetic field (or an electric field) of a third resonance mode formed by, for example, the first resonance arm 1111 and the third resonance arm 1113, FIG. 14D illustrates a magnetic field (or an electric field) of a fourth resonance mode formed by a total combination of the first through fourth resonance arms 1111 through 1114, and FIG. 14E illustrates a magnetic field (or an electric field) of a fifth resonance mode formed by the resonance rod 1115. In each of FIGS. 14A through 14E, (a) shows E-field characteristics and (b) shows H-field characteristics.

Figure 15:
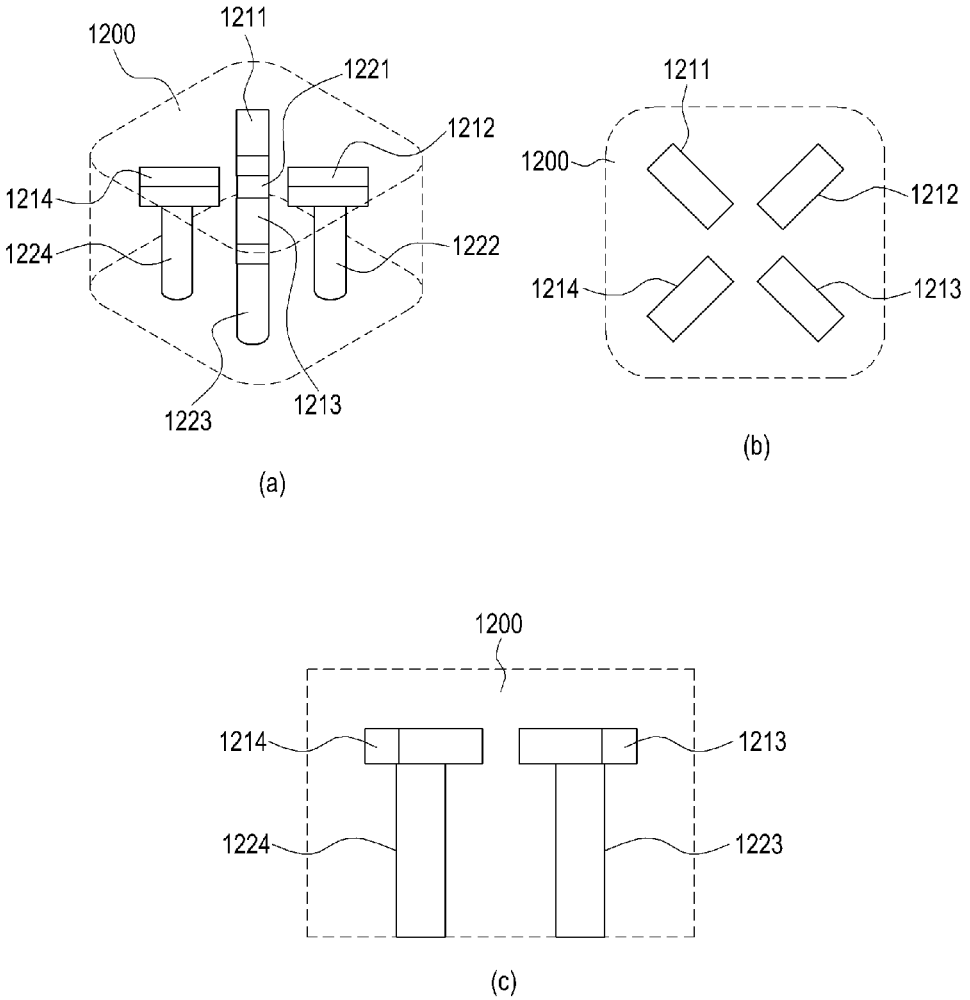
FIG. 15 is a structural diagram of a multi-mode resonator corresponding to a bandpass filter according to a tenth embodiment of the present disclosure.
Figure 16A:
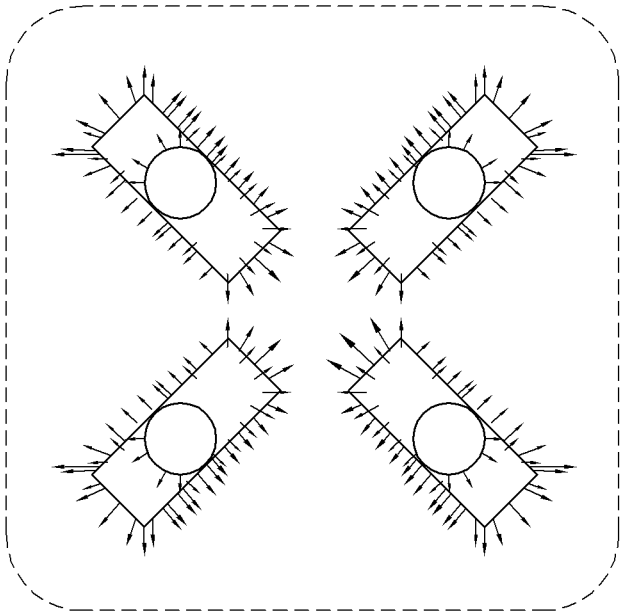
FIGS. 16A through 16D illustrate multi-mode resonance characteristics of the multi-mode resonator illustrated in FIG. 15.
Figure 16A:
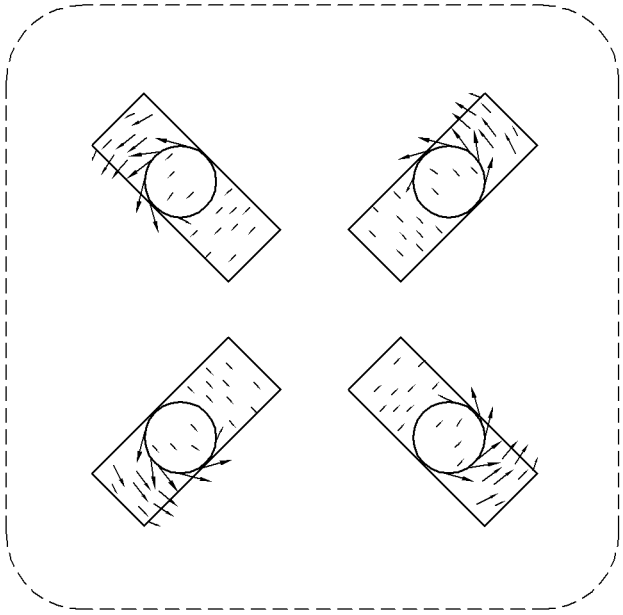
Figure 16B:
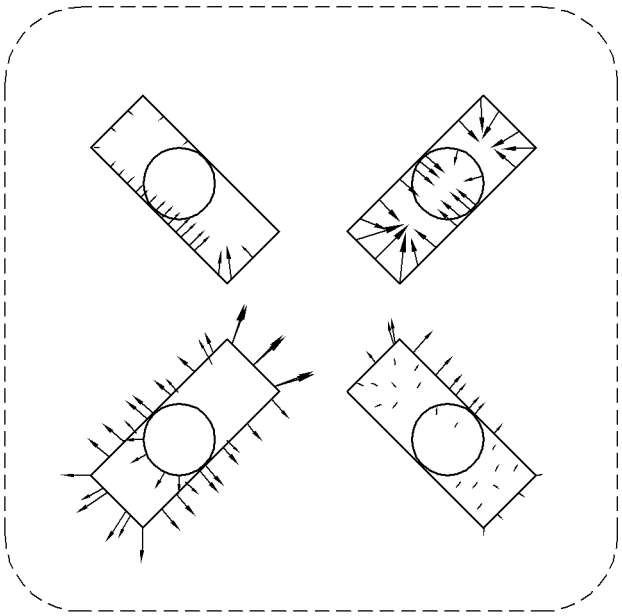
Figure 16B:
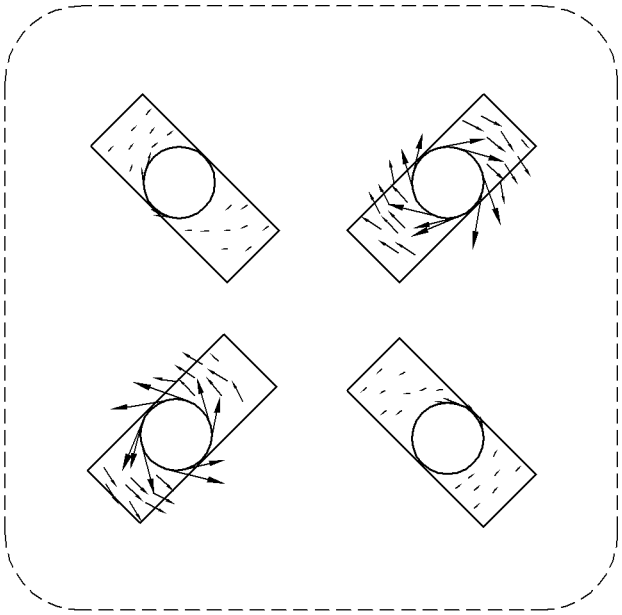
Figure 16C:
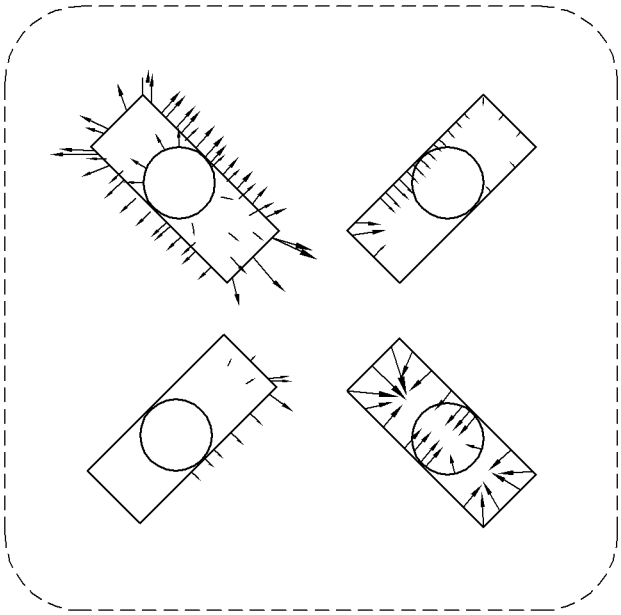
Figure 16C:
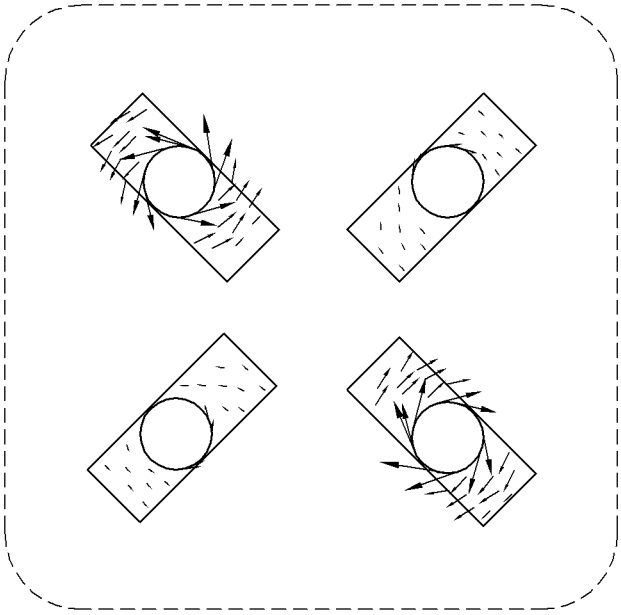
Figure 16D:
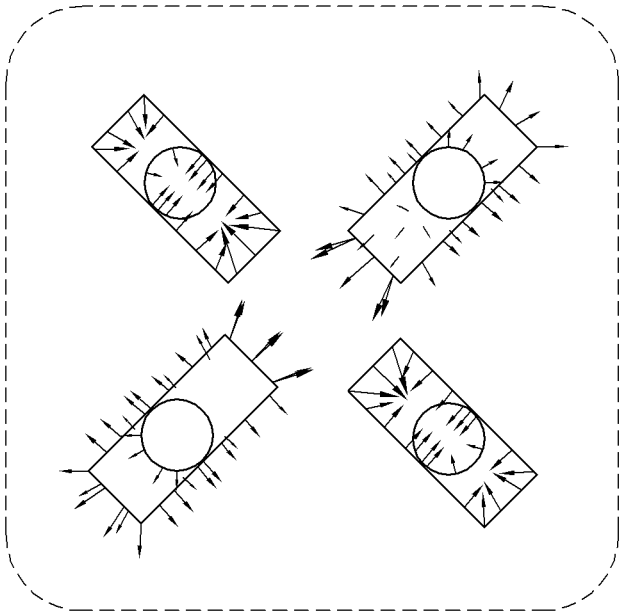
Figure 16D:
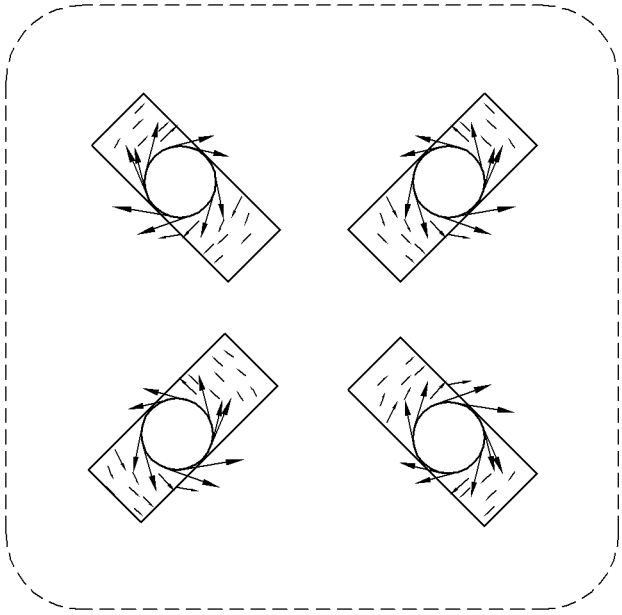

FIG. 15 is a structural diagram of a multi-mode resonator corresponding to a bandpass filter according to a tenth embodiment of the present disclosure, in which (a) of FIG. 15 illustrates a perspective projection structure, (b) illustrates a top plan structure, and (c) illustrates a side structure. The resonator according to the tenth embodiment of the present disclosure illustrated in FIG. 15, like the structure according to the ninth embodiment illustrated in FIG. 13, may include a cavity 1200, four resonance arms 1211, 1212, 1213, and 1214, and first through fourth resonance legs 1221, 1222, 1223, and 1224.

However, the structure according to the tenth embodiment illustrated in FIG. 15 is such that the resonance rod is removed from (that is, is not included in) the structure according to the ninth embodiment illustrated in FIG. 15. This structure is suitable for implementation of four resonance modes.

Main multi-mode resonance characteristics of the resonator having the structure illustrated in FIG. 15 are as illustrated in FIGS. 16A through 16D. In each of FIGS. 16A through 16D, (a) shows E-field characteristics and (b) shows H-field characteristics.

Figure 17:
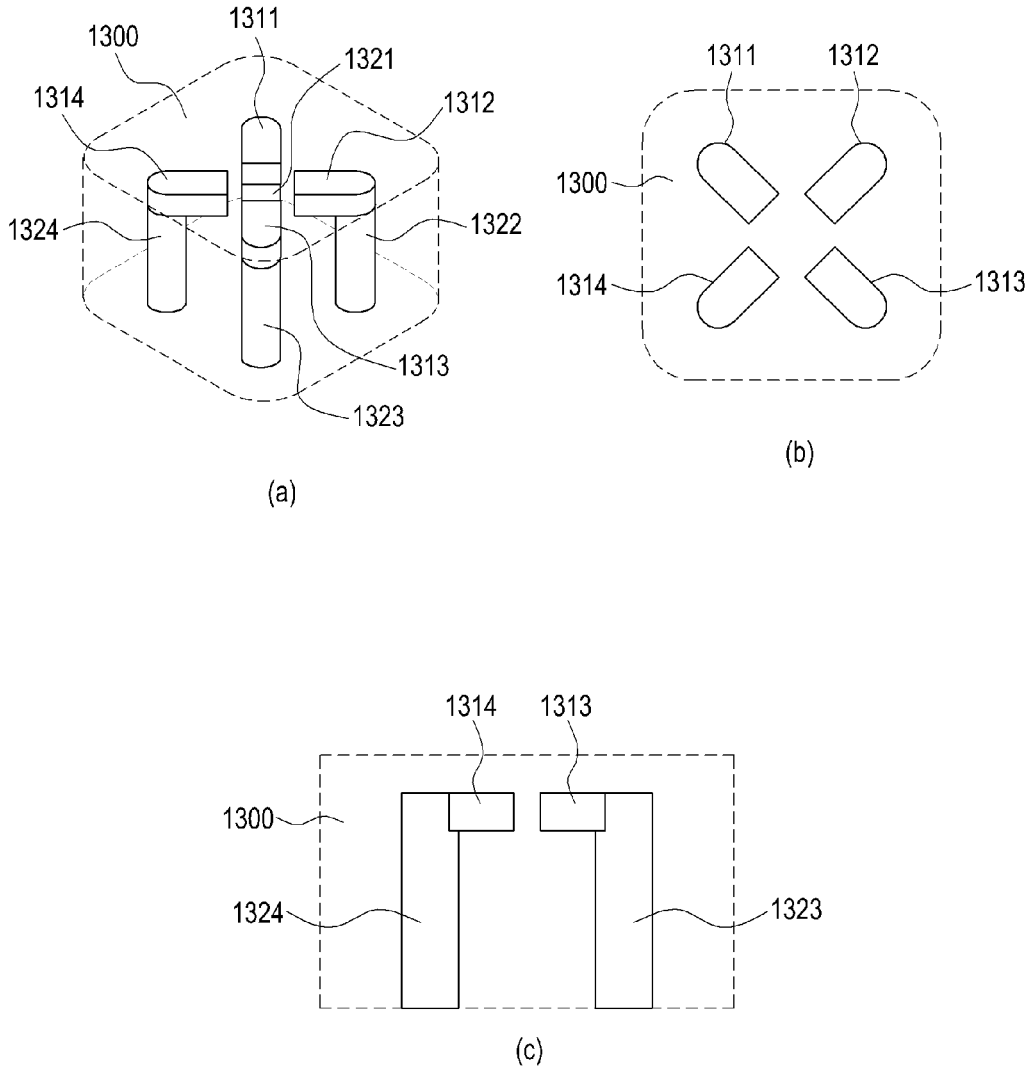
FIG. 17 is a structural diagram of a multi-mode resonator corresponding to a bandpass filter according to an eleventh embodiment of the present disclosure.
Figure 18A:
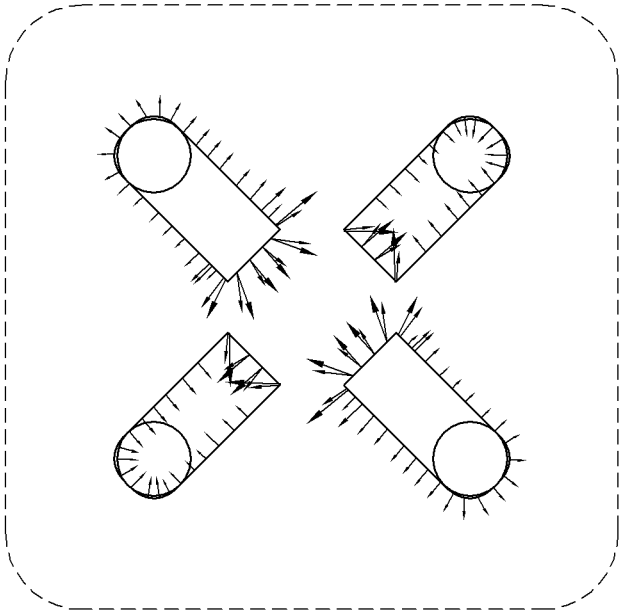
FIGS. 18A through 18D illustrate multi-mode resonance characteristics of the multi-mode resonator illustrated in FIG. 17.
Figure 18A:
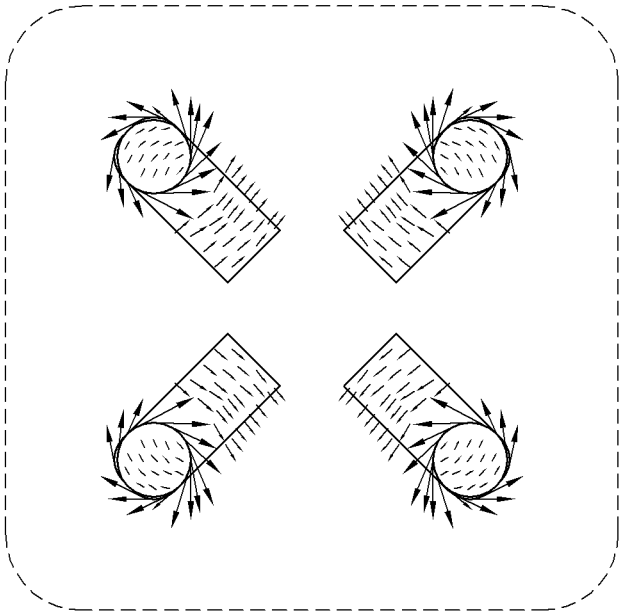
Figure 18B:
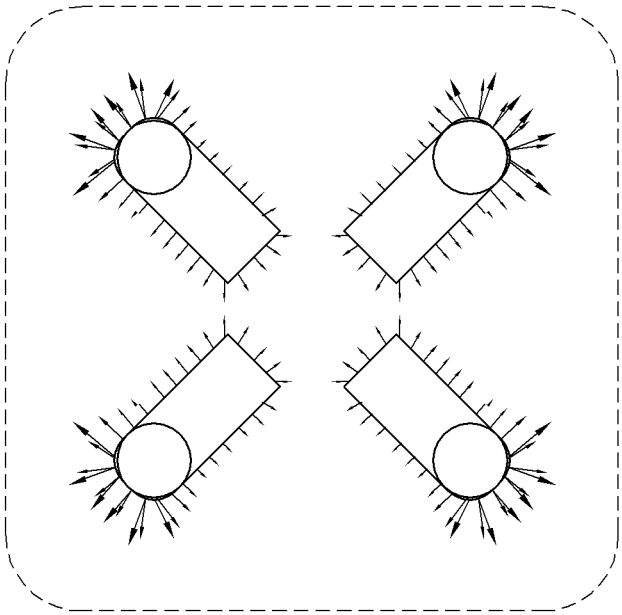
Figure 18B:
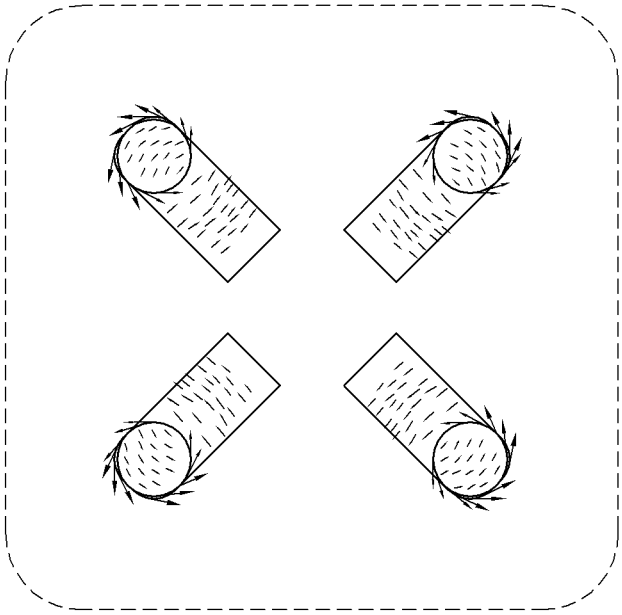
Figure 18C:
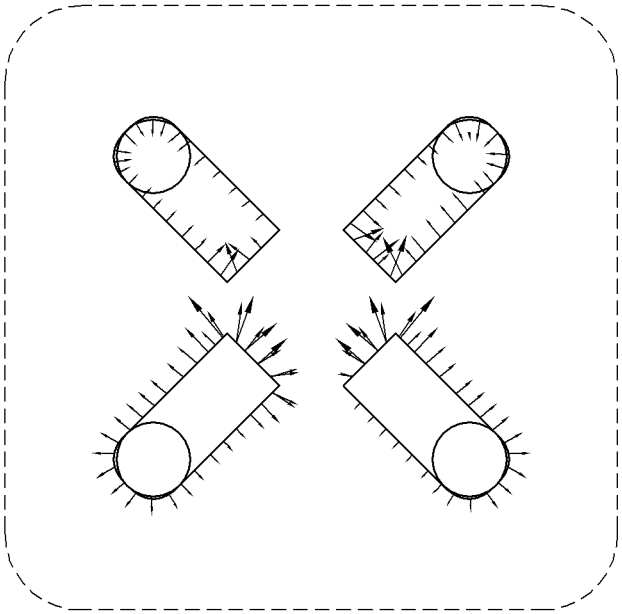
Figure 18C:
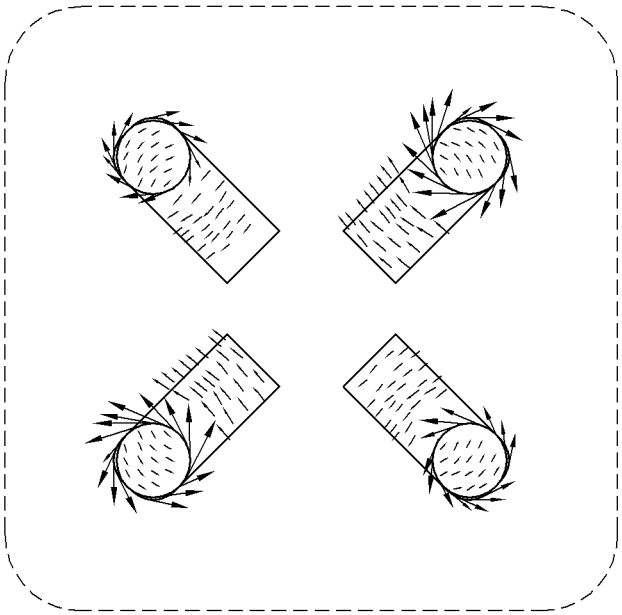
Figure 18D:
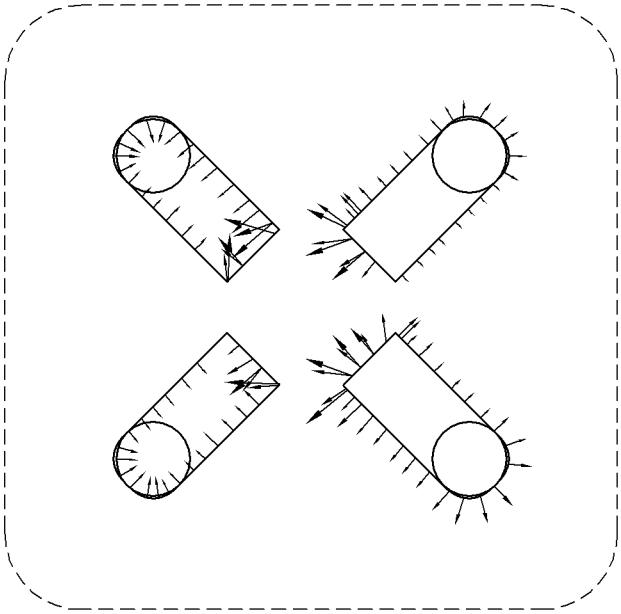
Figure 18D:
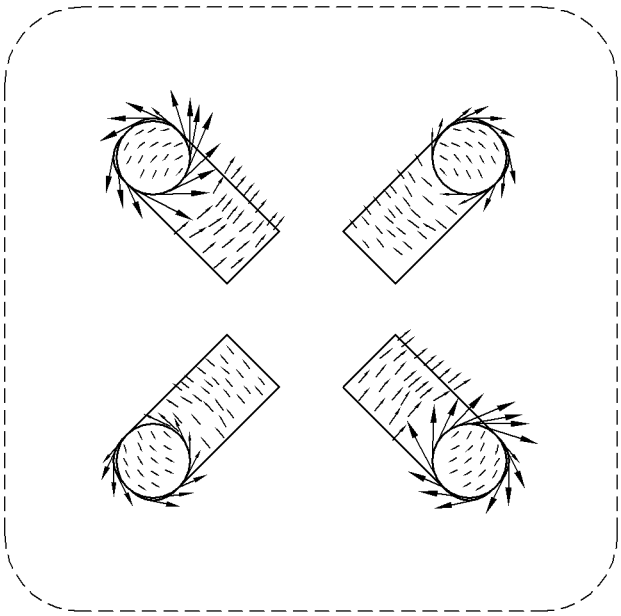

FIG. 17 is a structural diagram of a multi-mode resonator corresponding to a bandpass filter according to an eleventh embodiment of the present disclosure, in which (a) of FIG. 17 illustrates a perspective projection structure, (b) illustrates a top plan structure, and (c) illustrates a side structure. The resonator according to the eleventh embodiment of the present disclosure illustrated in FIG. 17, like the structure according to the tenth embodiment illustrated in FIG. 15, may include a cavity 1300, four resonance arms 1311, 1312, 1313, and 1314, and first through fourth resonance legs 1321, 1322, 1323, and 1324.

In the structure according to the eleventh embodiment illustrated in FIG. 17, when compared to the structure according to the tenth embodiment illustrated in FIG. 15, the first through fourth legs 1321 through 1324 are installed to be spaced apart from each other as far as possible. That is, the first through fourth resonance legs 1321 through 1324 are installed in such a way to support the first through fourth resonance arms 1311 through 1314, respectively, by being coupled with outer portions of the first through fourth resonance arms 1311 through 1314 with respect to the center of the cavity 1300.

In this way, when the first through fourth resonance legs 1321 through 1324 are installed spaced further apart from each other, a similar effect to when a diameter of the entire structure of the first through fourth resonance legs 1321 through 1324 increases may be generated, leading to adjustment of a processing frequency band.

Main multi-mode resonance characteristics of the resonator having the structure illustrated in FIG. 17 are as illustrated in FIGS. 18A through 18D. In each of FIGS. 18A through 18D, (a) shows E-field characteristics and (b) shows H-field characteristics.

Figure 19:
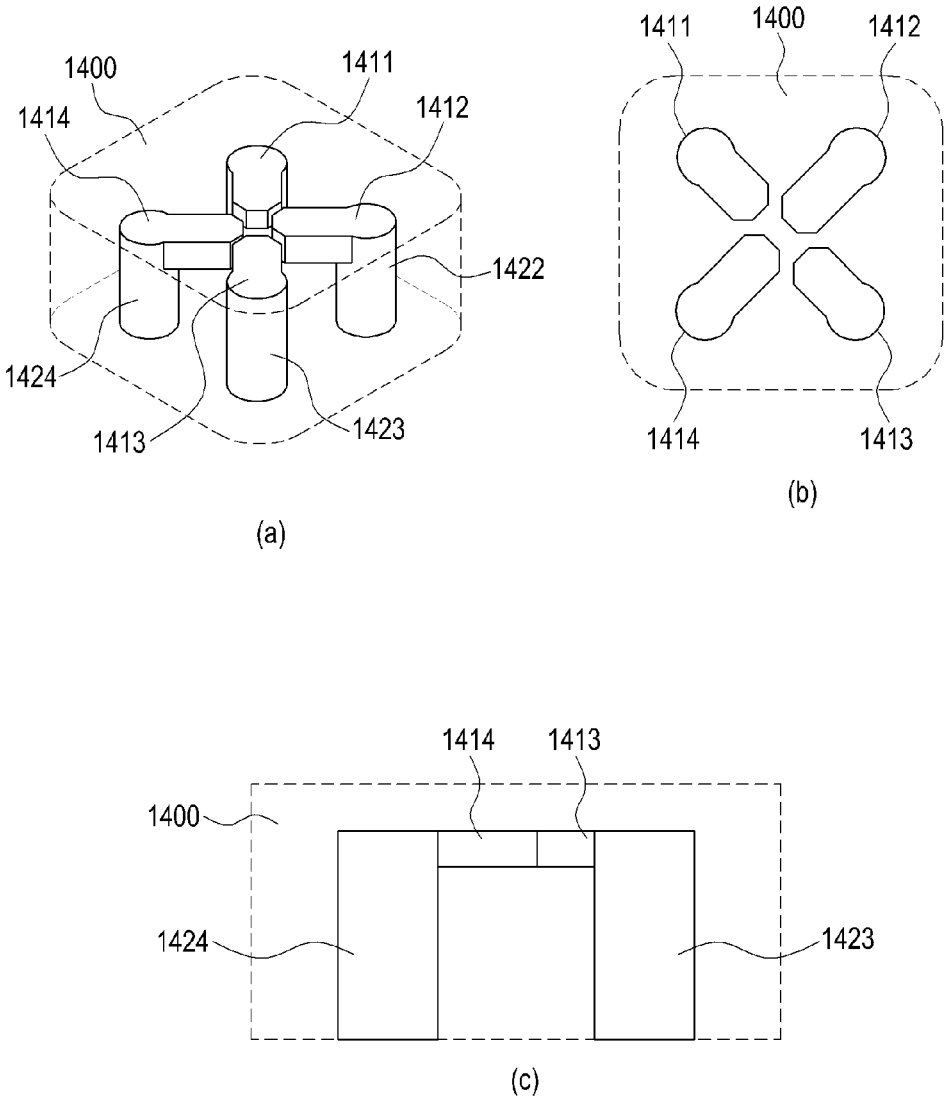
FIG. 19 is a structural diagram of a multi-mode resonator corresponding to a bandpass filter according to a twelfth embodiment of the present disclosure.
Figure 20A:
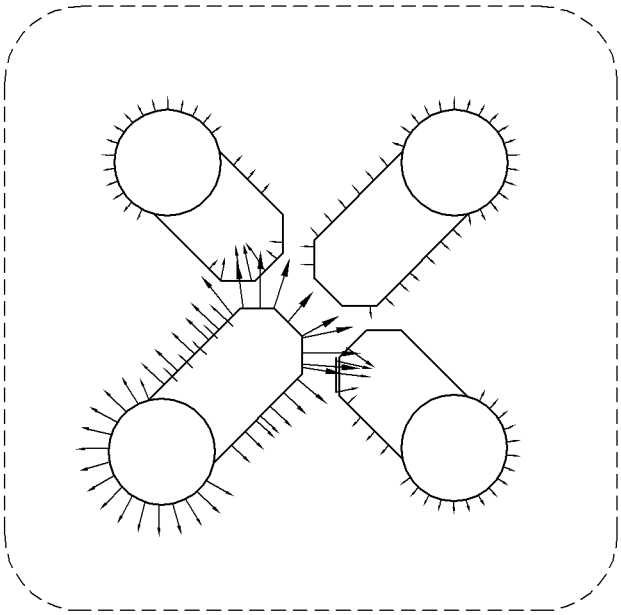
FIGS. 20A through 20D illustrate multi-mode resonance characteristics of the multi-mode resonator illustrated in FIG. 19.
Figure 20A:
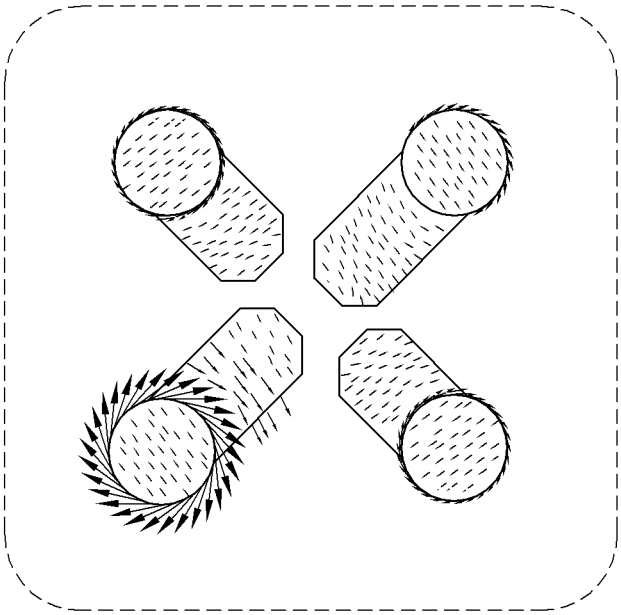
Figure 20B:
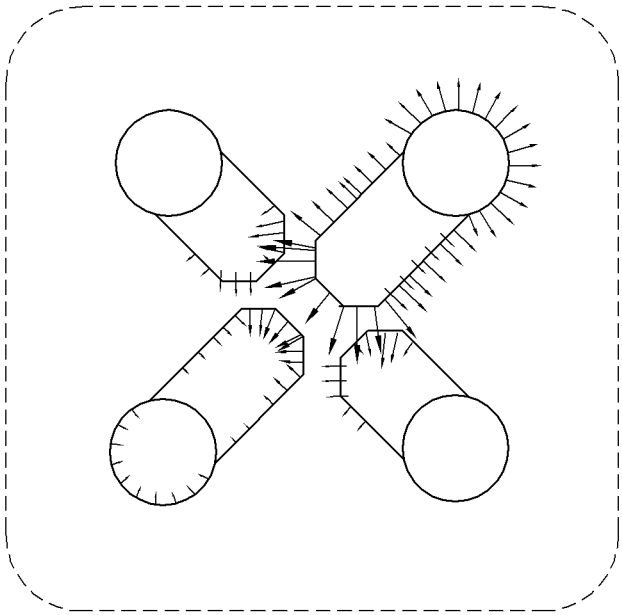
Figure 20B:
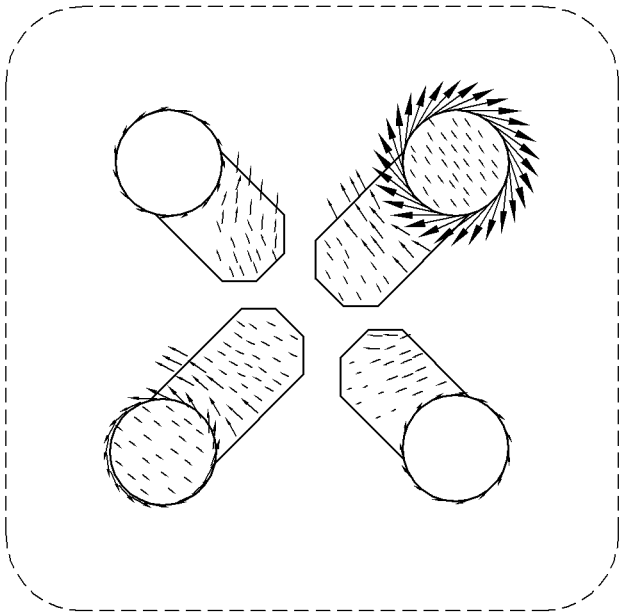
Figure 20C:
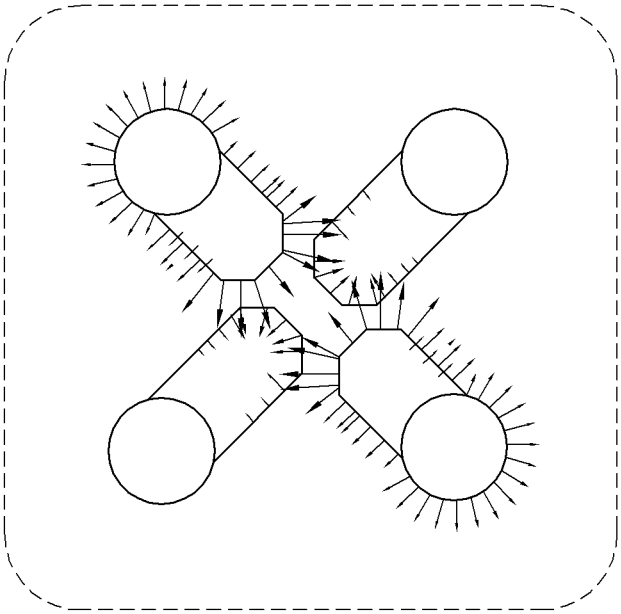
Figure 20C:
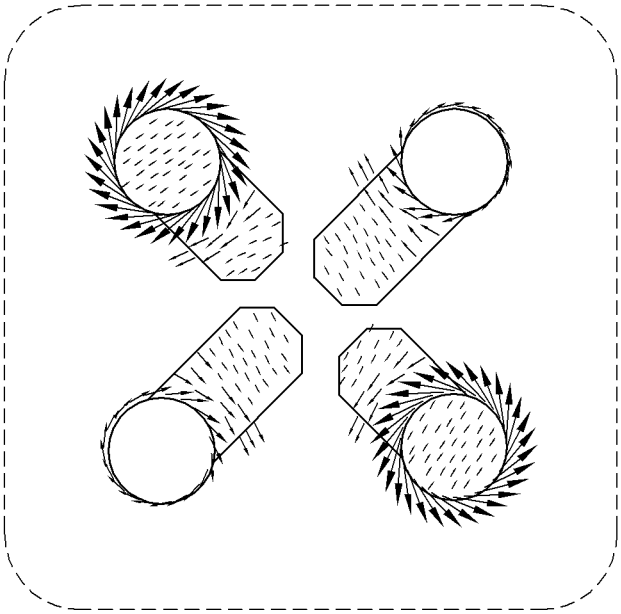
Figure 20D:
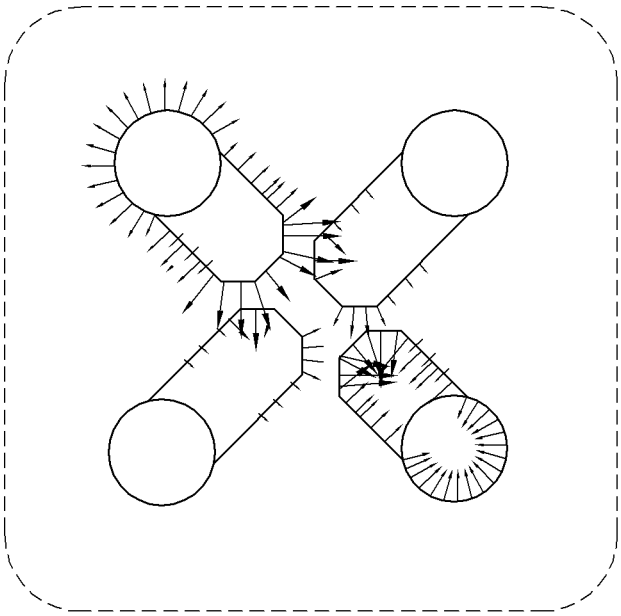
Figure 20D:
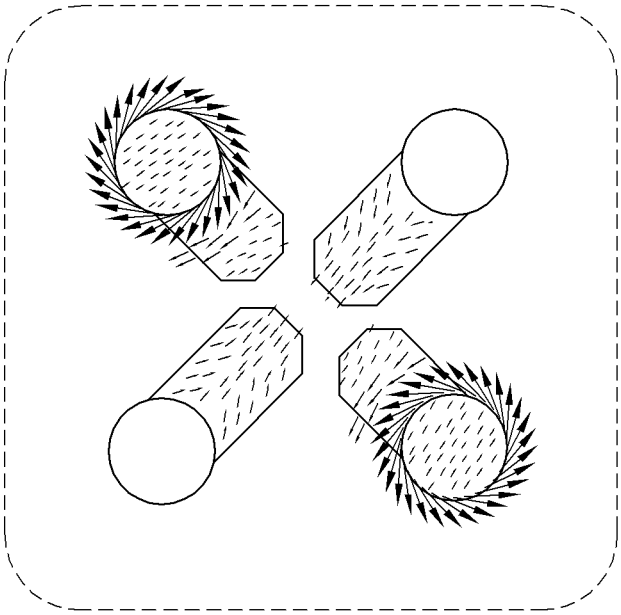

FIG. 19 is a structural diagram of a multi-mode resonator corresponding to a bandpass filter according to a twelfth embodiment of the present disclosure, in which (a) of FIG. 19 illustrates a perspective projection structure, (b) illustrates a top plan structure, and (c) illustrates a side structure. The resonator according to the twelfth embodiment of the present disclosure illustrated in FIG. 19, like the structure according to the eleventh embodiment illustrated in FIG. 17, may include a cavity 1400, four resonance arms 1411, 1412, 1413, and 1414, and first through fourth resonance legs 1421, 1422, 1423, and 1424.

However, in the structure according to the twelfth embodiment illustrated in FIG. 19, unlike structures according to other various embodiments as well as the eleventh embodiment illustrated in FIG. 17, lengths of the first through fourth 1411 through 1414 are not the same as each other, but for example, a longitudinal length of any one pair of resonance arms among a plurality of resonance arms is set different from that of the other pair of resonance arms. Likewise, designing may be performed such that differences exist in diameters, lengths, and so forth of the resonance legs 1421 through 1424. That is, for example, as illustrated in FIG. 19, the first resonance arm 1411 and the third resonance arm 1413 may be formed to have a relatively short length. The second resonance arm 1412 and the fourth resonance arm 1414 may be formed to have a relatively long length, such that end portions therebetween are closer to each other than in the first resonance arm 1411 and the third resonance arm 1413. Intervals between facing ends of the first through fourth resonance arms 1411 through 1414 may be equal to each other.

This structure is intended to change a transmission zero position, and in this case, the intensity and direction of the field coupled, for example, between the second resonance arm 1412 and the fourth resonance arm 1414 are changed, adjusting a notch point.

Main multi-mode resonance characteristics of the resonator having the structure illustrated in FIG. 19 are as illustrated in FIGS. 20A through 20D. In each of FIGS. 20A through 20D, (a) shows E-field characteristics and (b) shows H-field characteristics.

Figure 21:
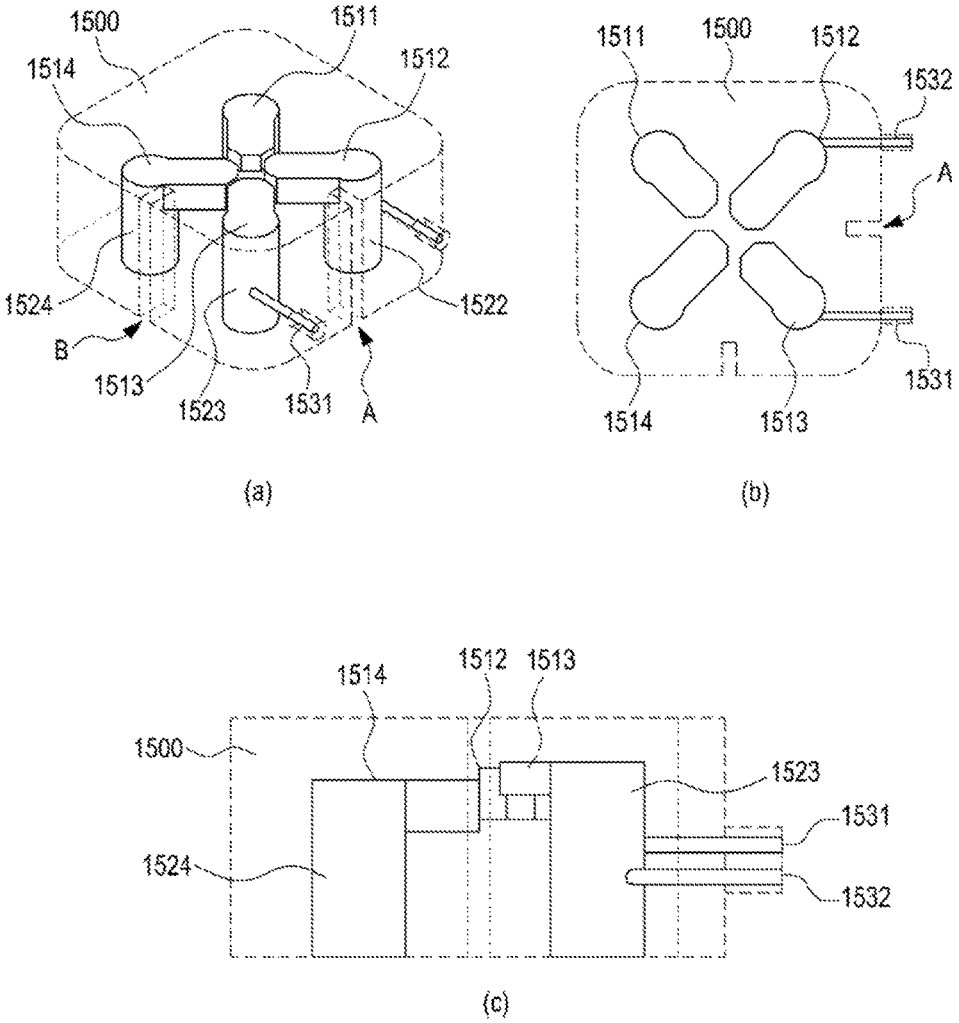
FIG. 21 is a structural diagram of a multi-mode resonator corresponding to a bandpass filter according to a thirteenth embodiment of the present disclosure.

FIG. 21 is a structural diagram of a multi-mode resonator corresponding to a bandpass filter according to a thirteenth embodiment of the present disclosure, in which (a) of FIG. 21 illustrates a perspective projection structure, (b) illustrates a top plan structure, and (c) illustrates a side structure. The resonator according to the thirteenth embodiment of the present disclosure illustrated in FIG. 21, like the structure according to the twelfth embodiment illustrated in FIG. 19, may include a cavity 1500, four resonance arms 1511, 1512, 1513, and 1514, and first through fourth resonance legs 1521, 1522, 1523, and 1524. The first and third resonance arms 1511 and 1513 are formed to have a relatively short length, and the second and fourth resonance arms 1512 and 1514 are formed to have a relatively long length. In FIG. 21, an input probe 1531 and an output probe 1532 connected to the second resonance leg 1522 and the third resonance leg 1523, respectively, are illustrated.

In the thirteenth embodiment illustrated in FIG. 21, unlike in the twelfth embodiment illustrated in FIG. 19, the second resonance leg 1522 and the third resonance leg 1523 are formed to have a longer length than the first and fourth resonance legs 1521 and 1524. Such a structure is intended to increase a capacitance component by reducing a distance between the second and third resonance arms 1512 and 1513, supported by the second and third resonance legs 1522 and 1523, respectively, and the top surface of the cavity 1500. Thus, proper capacitor component adjustment is possible in an input side and an output side of the filter, connected to the input probe 1531 and the output probe 1532.

In the thirteenth embodiment, in a proper position as well as between the input side and the output side as in a position A or B, a partition or a tuning screw may be further installed. Thus, perturbation may occur between resonance arms, thereby adjusting a transmission zero position, notch generation, and so forth.

Figure 22:
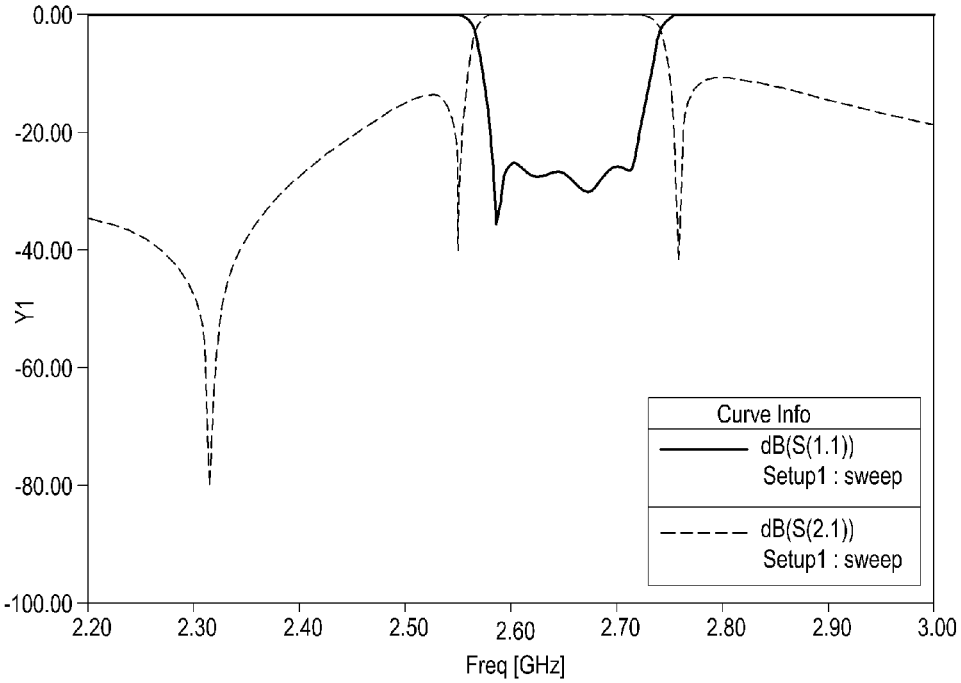
FIG. 22 is a graph showing frequency filtering characteristics of the multi-mode resonator illustrated in FIG. 21.

FIG. 22 is a graph showing an example of frequency filtering characteristics of the multi-mode resonator illustrated in FIG. 21. Referring to FIG. 22, frequency filtering characteristics including a formed notch as well as four multi-mode characteristics can be seen.

Figure 23:
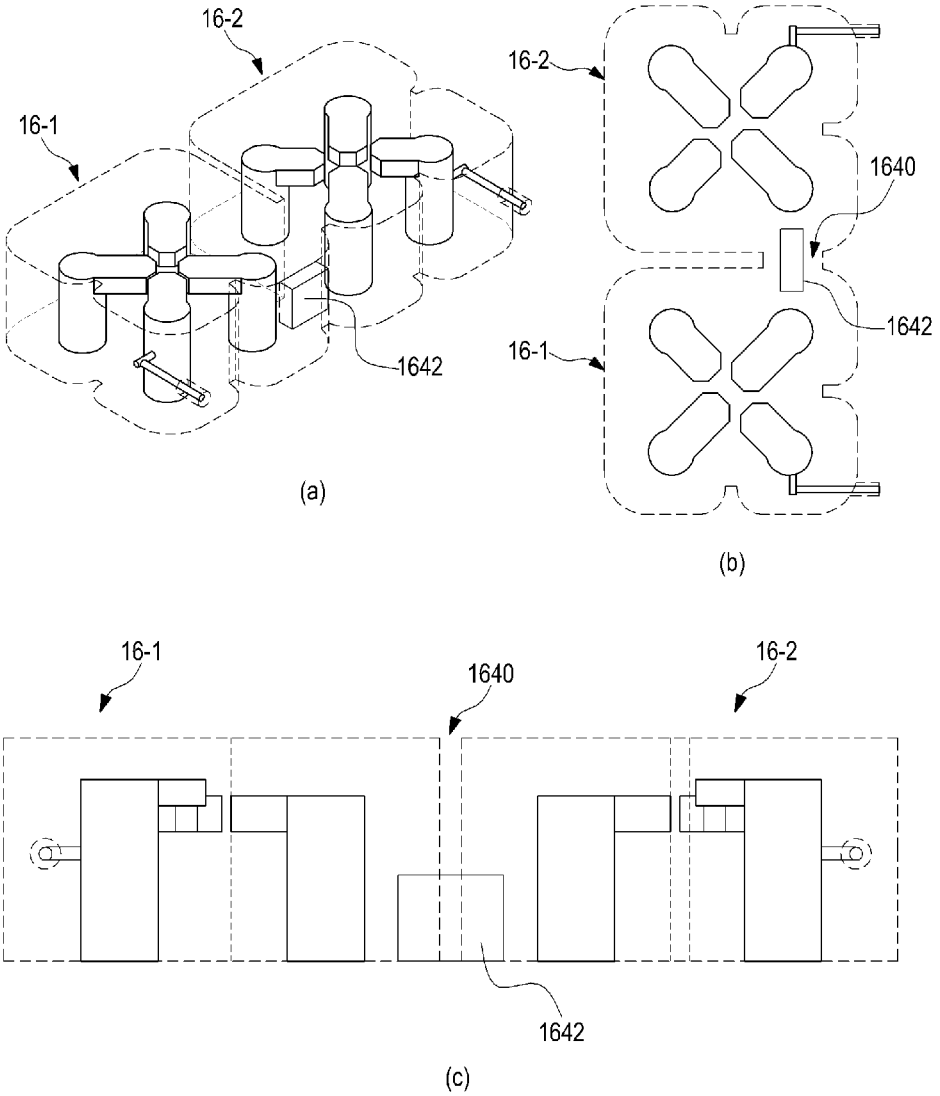
FIG. 23 is a structural diagram of a multi-mode resonator corresponding to a bandpass filter according to a fourteenth embodiment of the present disclosure.

FIG. 23 is a structural diagram of a multi-mode resonator corresponding to a bandpass filter according to a fourteenth embodiment of the present disclosure, in which (a) of FIG. 23 illustrates a perspective projection structure, (b) illustrates a top plan structure, and (c) illustrates a side structure. The resonator according to the fourteenth embodiment of the present disclosure illustrated in FIG. 23 is structured such that the structure according to the thirteenth embodiment illustrated in FIG. 21 is formed dually.

That is, a first resonator 16-1 and a second resonator 16-2, each having the same structure as that of the resonator illustrated in FIG. 23, are formed, and an output side of the first resonator 16-1 and an input side of the second resonator 16-2 are coupled to each other by a coupling window 1640. In the coupling window 1640, a coupling structure 1642 is further installed in such a way to extend from bottom surfaces of cavities for facilitating coupling.

Figure 24:
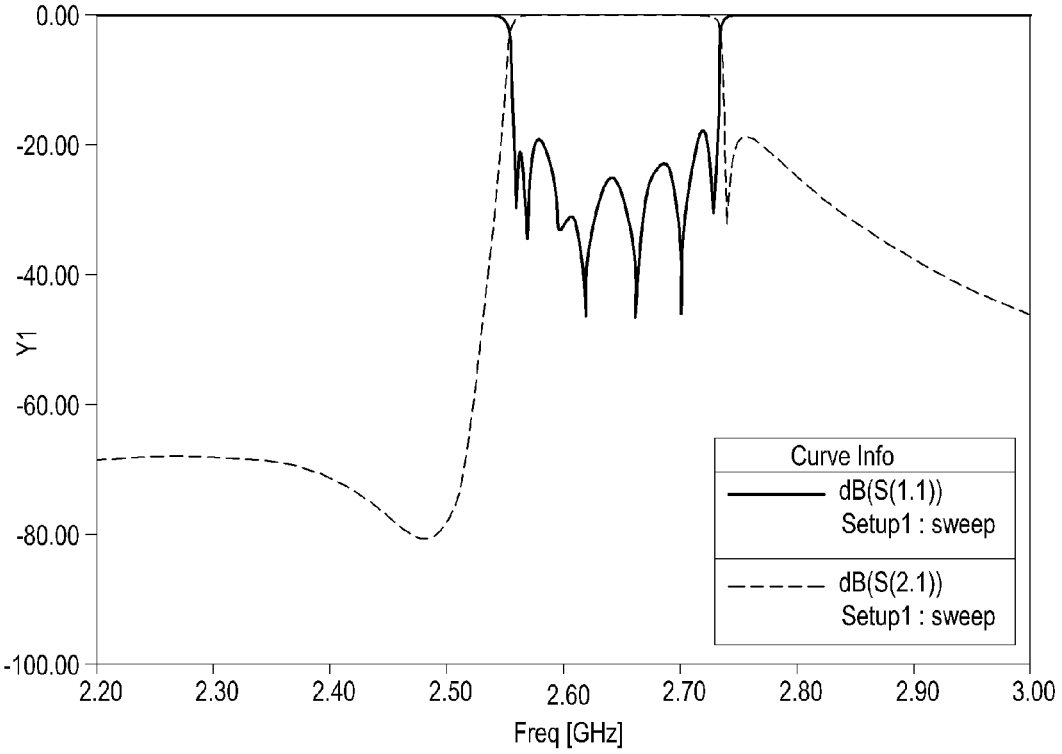
FIG. 24 is a graph showing frequency filtering characteristics of the multi-mode resonator illustrated in FIG. 23.

FIG. 24 is a graph showing an example of frequency filtering characteristics of the multi-mode resonator illustrated in FIG. 23. Referring to FIG. 24, frequency filtering characteristics corresponding to an 8-stage filter can be seen.

Figure 25:
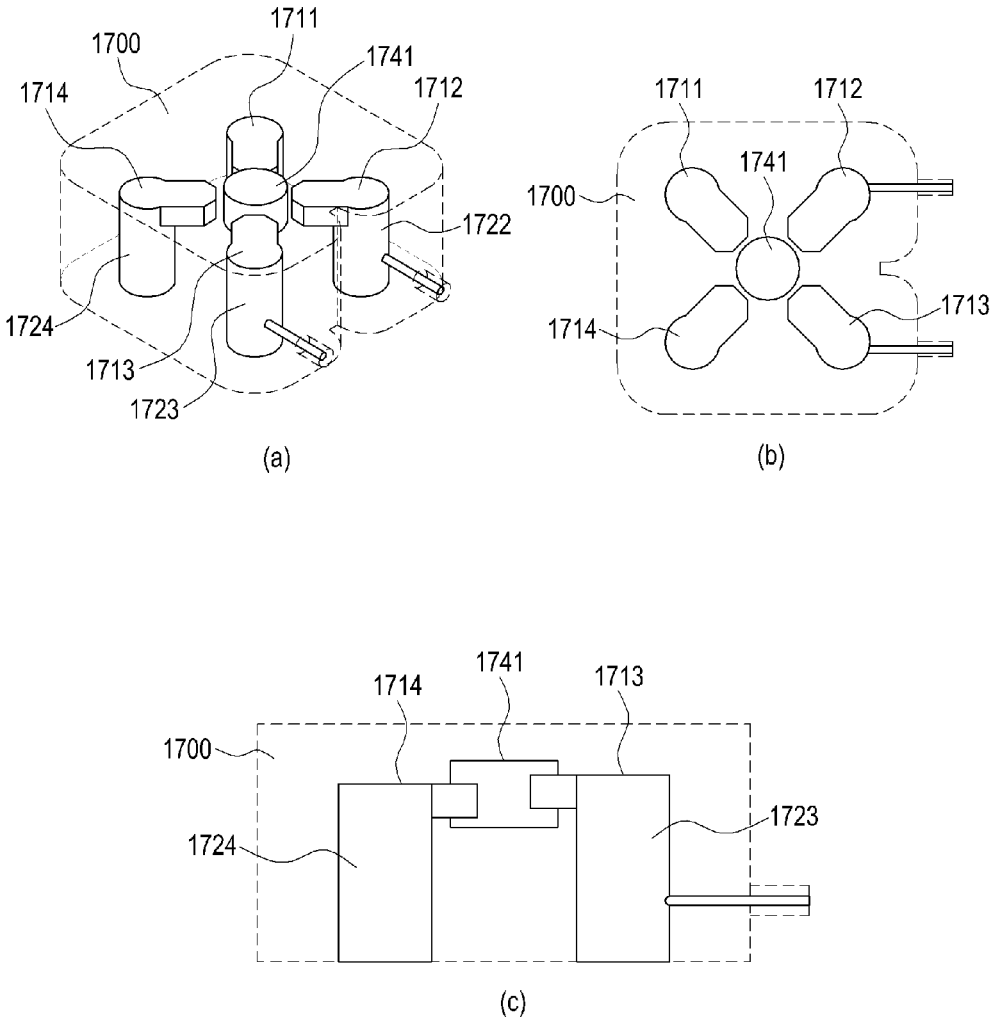
FIG. 25 is a structural diagram of a multi-mode resonator corresponding to a bandpass filter according to a fifteenth embodiment of the present disclosure.

FIG. 25 is a structural diagram of a multi-mode resonator corresponding to a bandpass filter according to a fifteenth embodiment of the present disclosure, in which (a) of FIG. 25 illustrates a perspective projection structure, (b) illustrates a top plan structure, and (c) illustrates a side structure. The resonator according to the fifteenth embodiment of the present disclosure illustrated in FIG. 25, like the structure according to the thirteenth embodiment illustrated in FIG. 21, may include a cavity 1700, four resonance arms 1711, 1712, 1713, and 1714, and first through fourth resonance legs 1721, 1722, 1723, and 1724.

Figure 26:
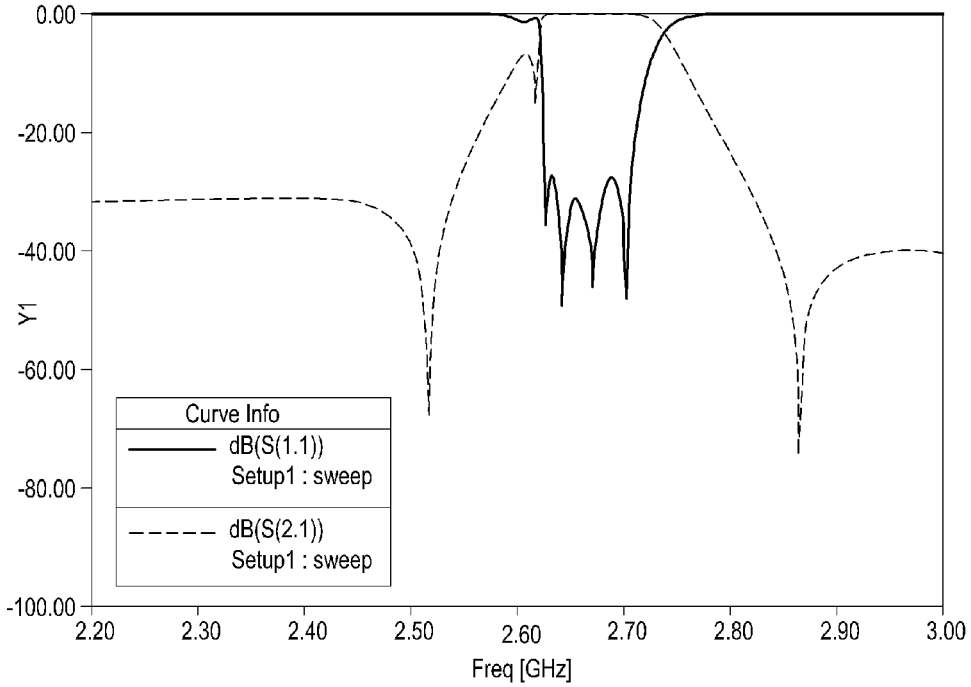
FIG. 26 is a graph showing frequency filtering characteristics of the multi-mode resonator illustrated in FIG. 25.

In the fifteenth embodiment, unlike in the thirteenth embodiment illustrated in FIG. 21, first through fourth resonance arms 1711 through 1714 are formed to have an equal length, and a metallic tuning structure 1741, for example, in a cylindrical or disc shape, is further installed to electrically float in the center of the entire structure of the four resonance arms 1711 through 1714 for signal coupling and coupling adjustment between corresponding resonance modes. The coupling structure 1741 facilitates coupling between coupling resonance arms when compared to a case having no coupling structure, broadening the entire bandwidth of the filter. Frequency filtering characteristics of the resonator according to the fifteenth embodiment are as shown in FIG. 26.

Figure 27:
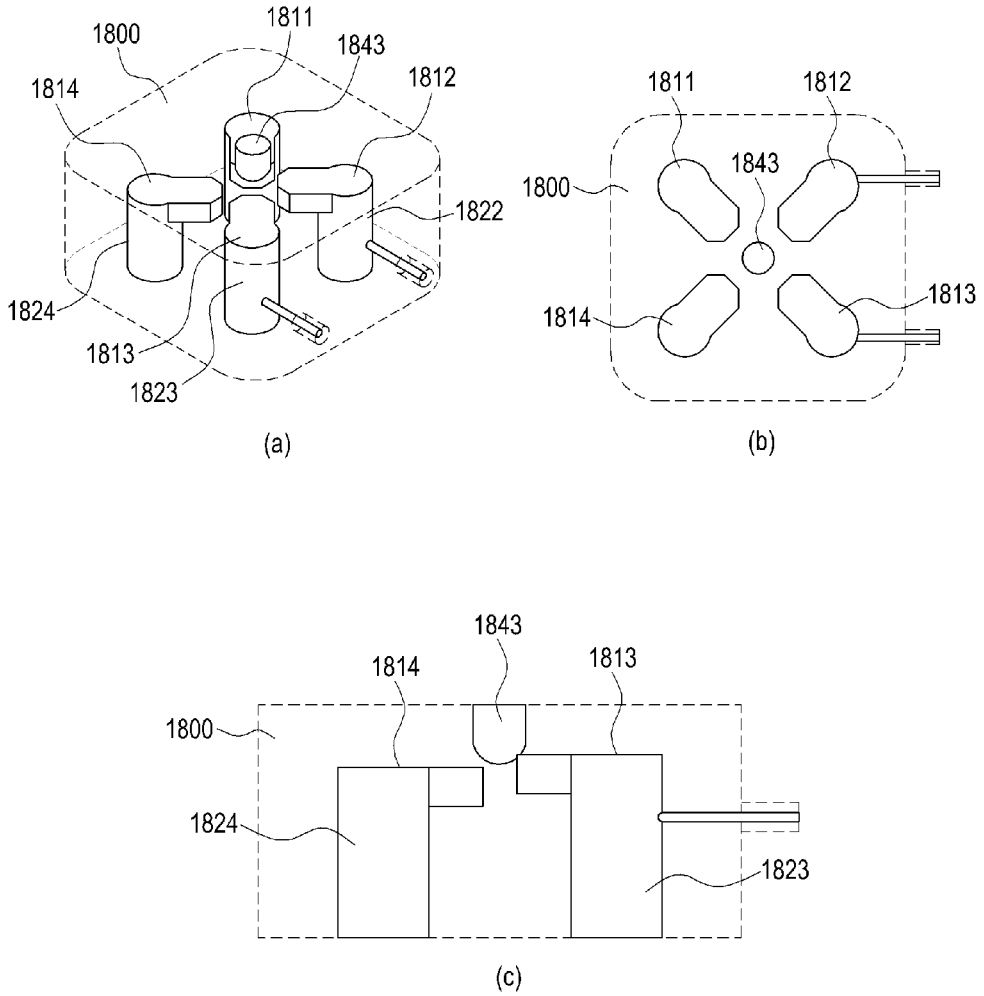
FIG. 27 is a structural diagram of a multi-mode resonator corresponding to a bandpass filter according to a sixteenth embodiment of the present disclosure.

FIG. 27 is a structural diagram of a multi-mode resonator corresponding to a bandpass filter according to a sixteenth embodiment of the present disclosure, in which (a) of FIG. 27 illustrates a perspective projection structure, (b) illustrates a top plan structure, and (c) illustrates a side structure. The resonator according to the sixteenth embodiment of the present disclosure illustrated in FIG. 27, like the structure according to the fifteenth embodiment illustrated in FIG. 25, may include a cavity 1800, four resonance arms 1811, 1812, 1813, and 1814, and first through fourth resonance legs 1821, 1822, 1823, and 1824.

Figure 28:
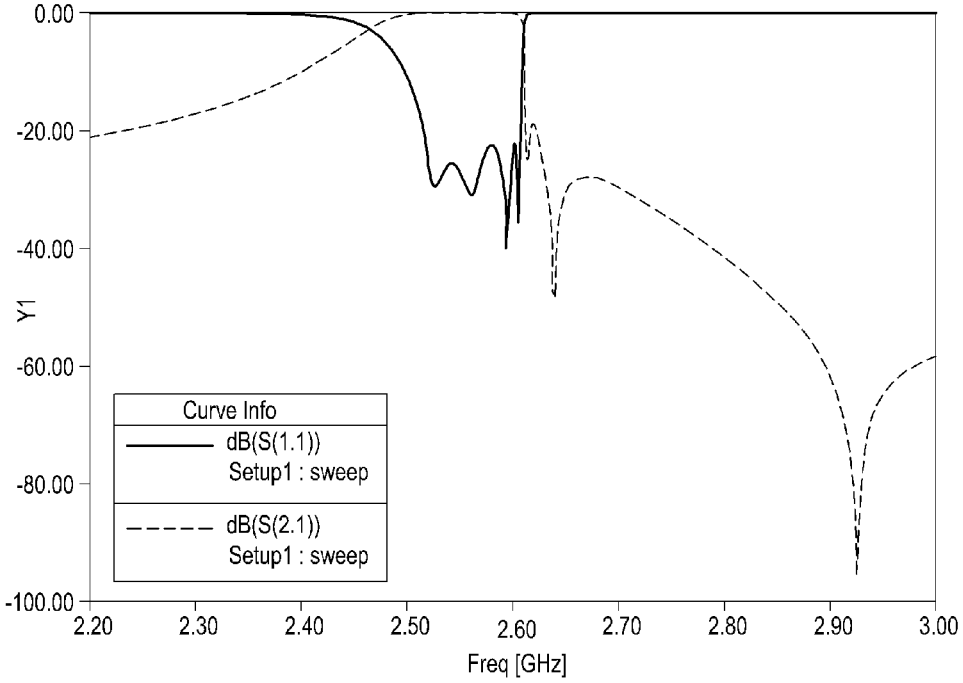
FIG. 28 is a graph showing frequency filtering characteristics of the multi-mode resonator illustrated in FIG. 27.

However, in the sixteenth embodiment illustrated in FIG. 27, unlike in the fifteenth embodiment illustrated in FIG. 25, in the center of the entire structure of the four resonance arms 1811 through 1814 is provided, in place of a tuning structure electrically floating, a tuning screw 1843 which is installed to pass through a cover, etc., from an upper end of a housing (not shown). By using the tuning screw 1843, signal coupling between the four resonance arms 1711 through 1714, coupling adjustment between corresponding resonance modes, and resonant frequency tuning may be performed. Frequency filtering characteristics of the resonator according to the sixteenth embodiment are as shown in FIG. 28.

Figure 29:
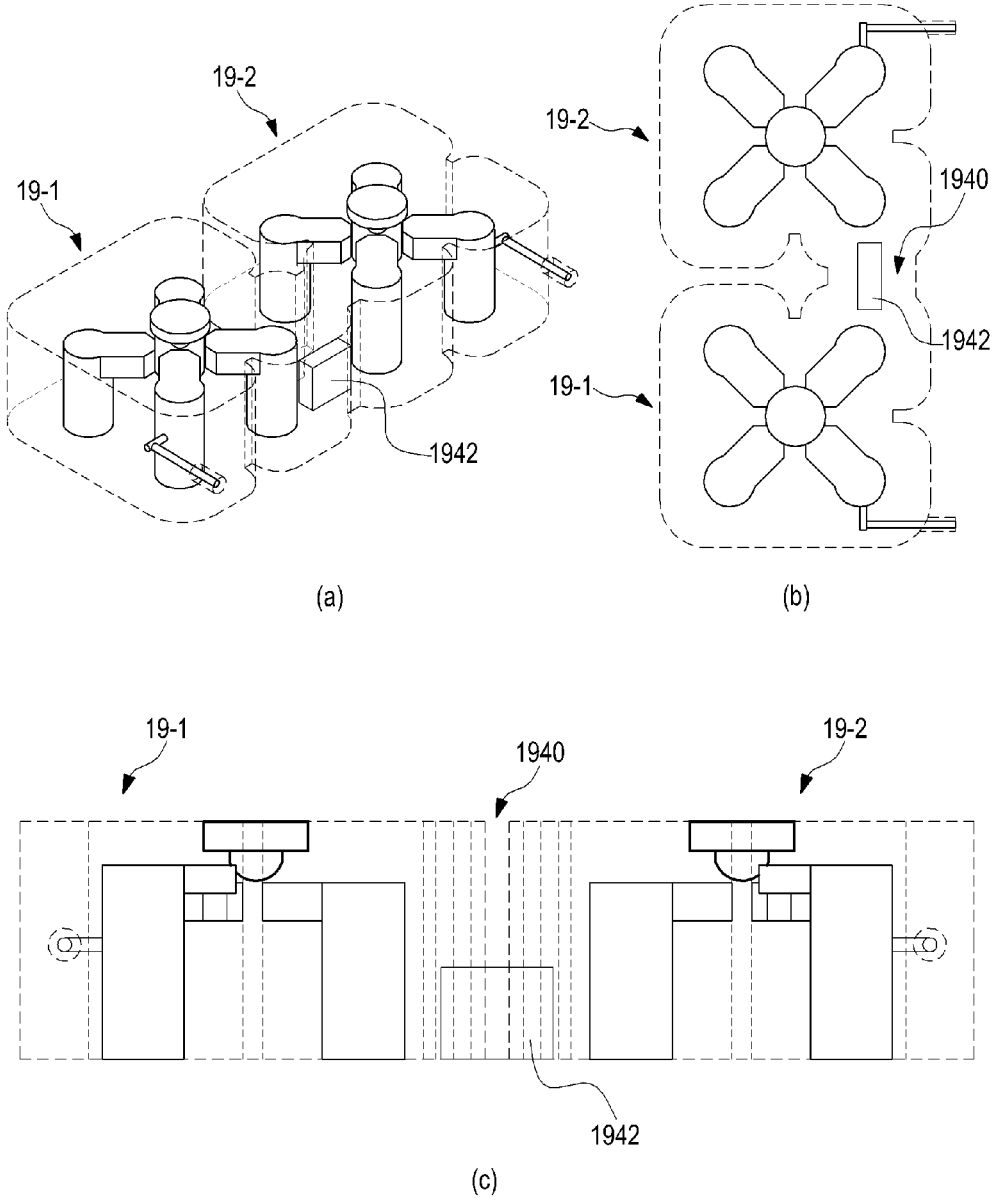
FIG. 29 is a structural diagram of a multi-mode resonator corresponding to a bandpass filter according to a seventeenth embodiment of the present disclosure.

FIG. 29 is a structural diagram of a multi-mode resonator corresponding to a bandpass filter according to a seventeenth embodiment of the present disclosure, in which (a) of FIG. 29 illustrates a perspective projection structure, (b) illustrates a top plan structure, and (c) illustrates a side structure. The resonator according to the seventeenth embodiment of the present disclosure illustrated in FIG. 29 is structured such that the structure according to the sixteenth embodiment illustrated in FIG. 27 is formed dually.

Figure 30:
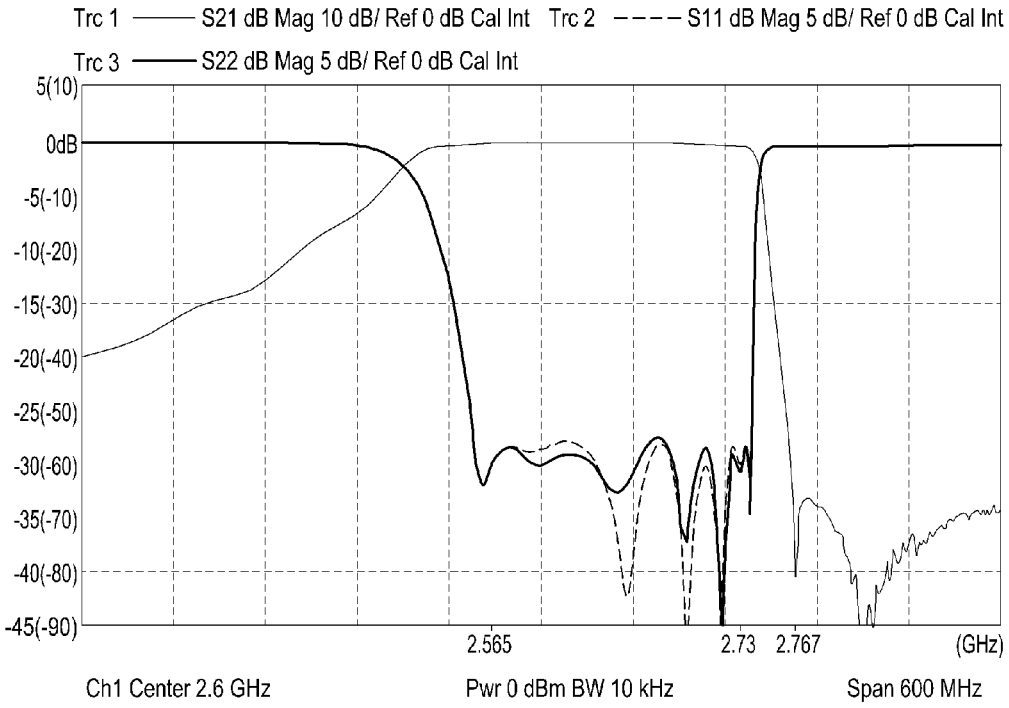
FIG. 30 is a graph showing frequency filtering characteristics of the multi-mode resonator illustrated in FIG. 29.

That is, the resonator according to the seventeenth embodiment illustrated in FIG. 29 may include a first resonator 19-1 and a second resonator 19-2, each having the same structure as that of the resonator illustrated in FIG. 27, and an output side of the first resonator 19-1 and an input side of the second resonator 19-2 are coupled to each other by a coupling window 1940. In the coupling window 1940, a coupling structure 1942 is further installed to facilitate coupling. Frequency filtering characteristics of the resonator according to the seventeenth embodiment are as shown in FIG. 30.

Figure 31:
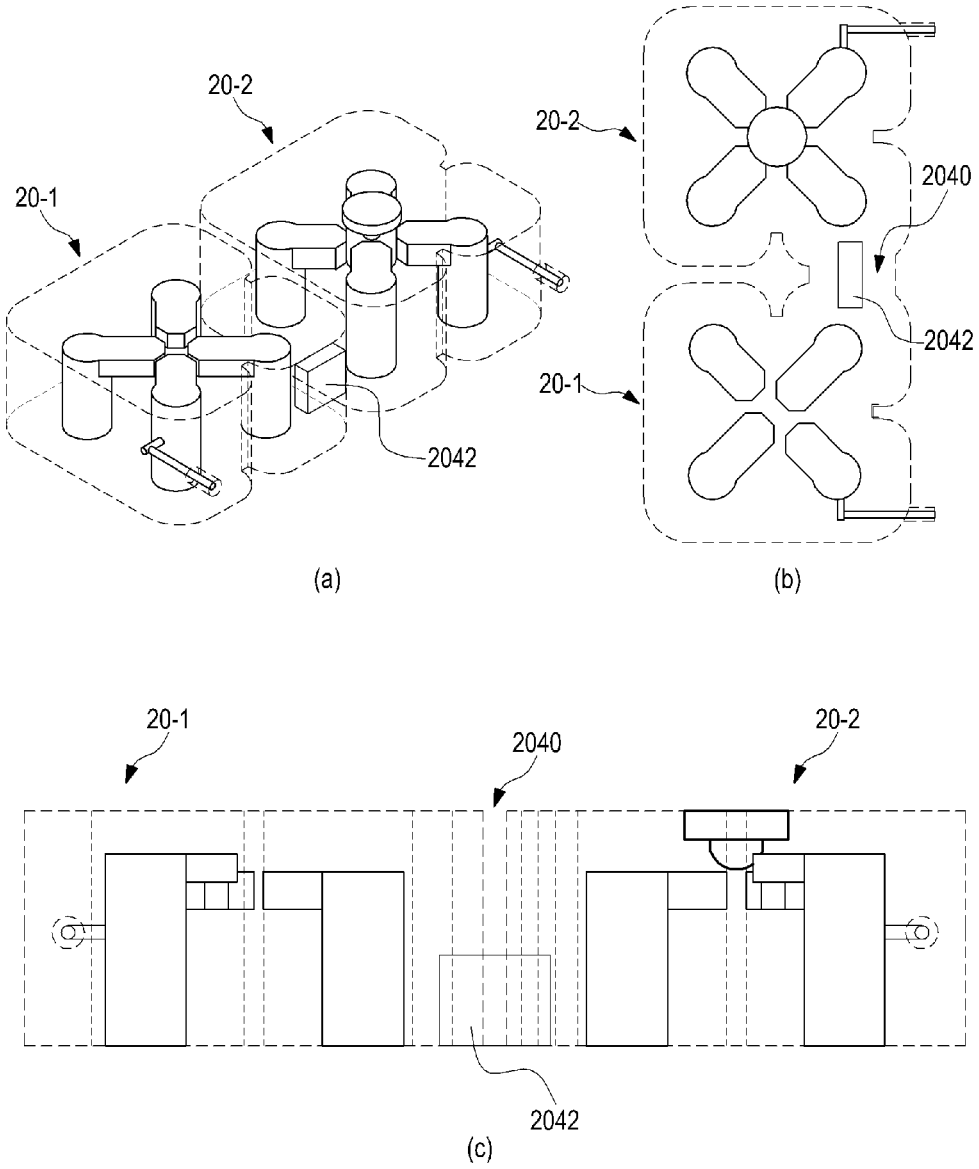
FIG. 31 is a structural diagram of a multi-mode resonator corresponding to a bandpass filter according to an eighteenth embodiment of the present disclosure.

FIG. 31 is a structural diagram of a multi-mode resonator corresponding to a bandpass filter according to an eighteenth embodiment of the present disclosure, in which (a) of FIG. 29 illustrates a perspective projection structure, (b) illustrates a top plan structure, and (c) illustrates a side structure. The resonator according to the eighteenth embodiment of the present disclosure illustrated in FIG. 31, like the resonator according to the seventeenth embodiment illustrated in FIG. 29, is structured such that a first resonator 20-1 and a second resonator 20-2 are coupled to each other.

Figure 32:
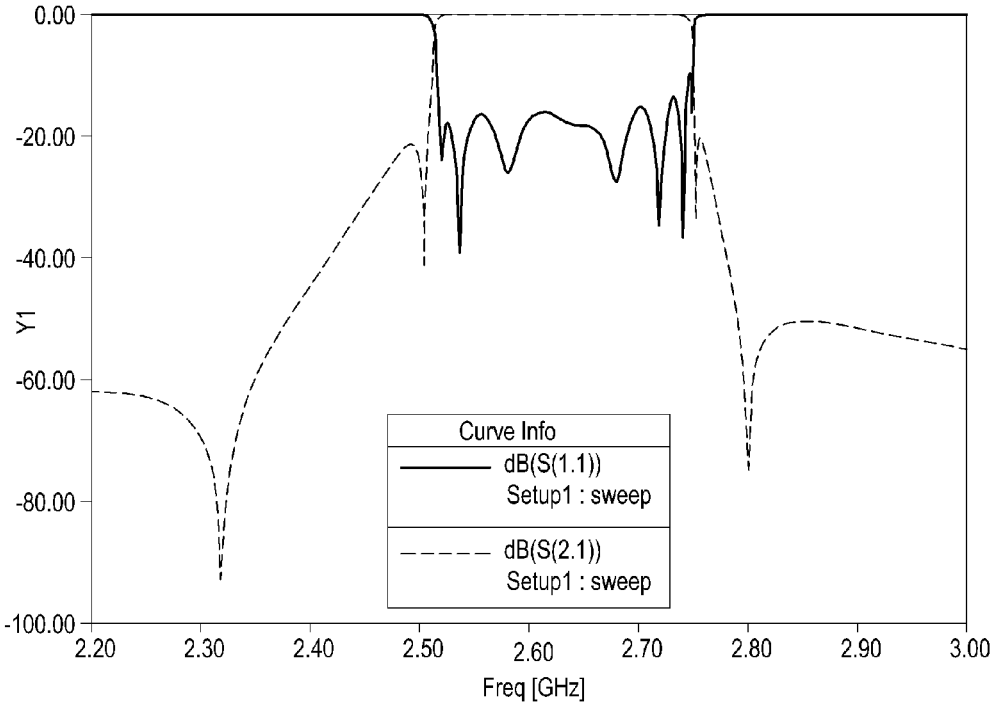
FIG. 32 is a graph showing frequency filtering characteristics of the multi-mode resonator illustrated in FIG. 30.

However, the first resonator 20-1 has the same structure as the structure according to the thirteenth embodiment illustrated in FIG. 21, and the second resonator 20-2 has the same structure as the structure according to the sixteenth embodiment illustrated in FIG. 27. That is, the first resonator 20-1 and the second resonator 20-2 have different structures. As such, resonators having various structures according to the above-described embodiments, as well as an example of the structure illustrated in the current eighteenth embodiment, may be coupled dually. Frequency filtering characteristics of the resonator according to the eighteenth embodiment are as shown in FIG. 32.

Figure 33:
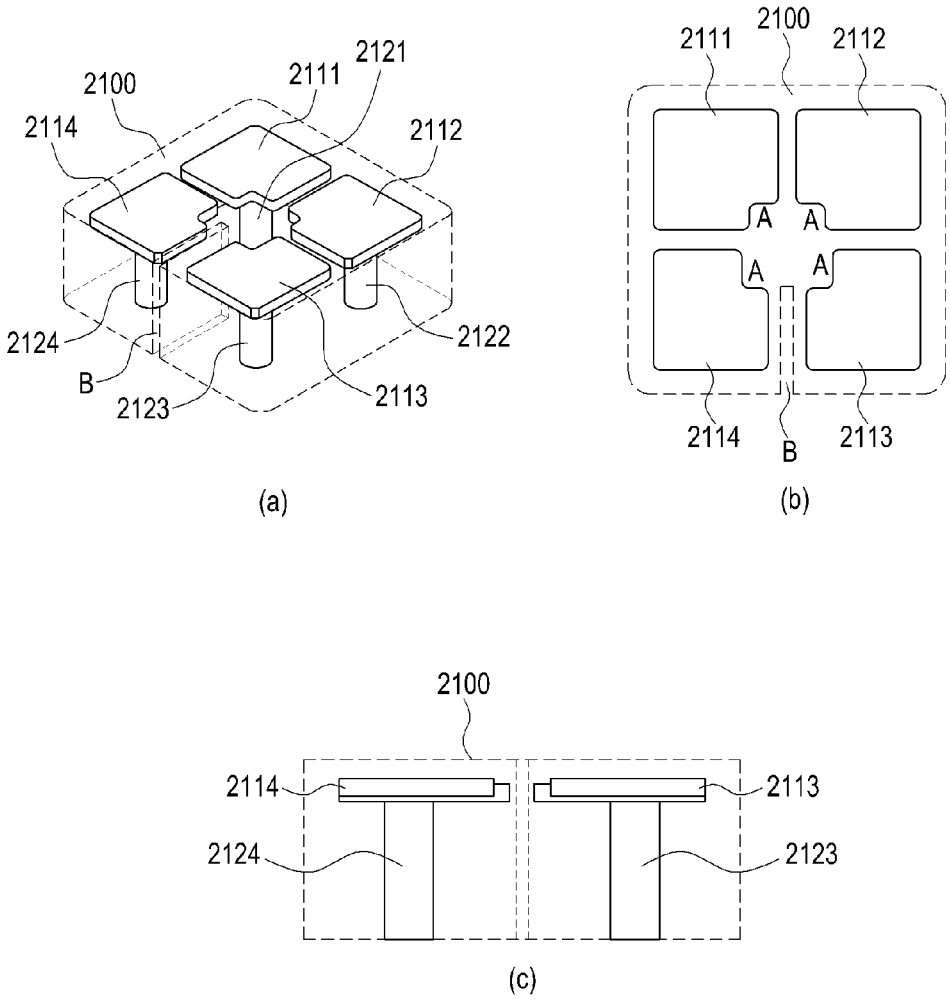
FIG. 33 is a structural diagram of a multi-mode resonator corresponding to a bandpass filter according to a nineteenth embodiment of the present disclosure.
Figure 34A:
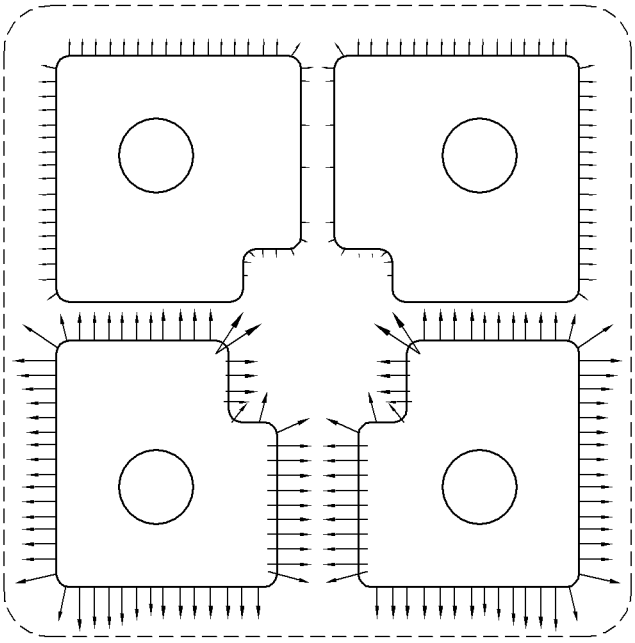
FIGS. 34A through 34D illustrate multi-mode resonance characteristics of the multi-mode resonator illustrated in FIG. 33.
Figure 34A:
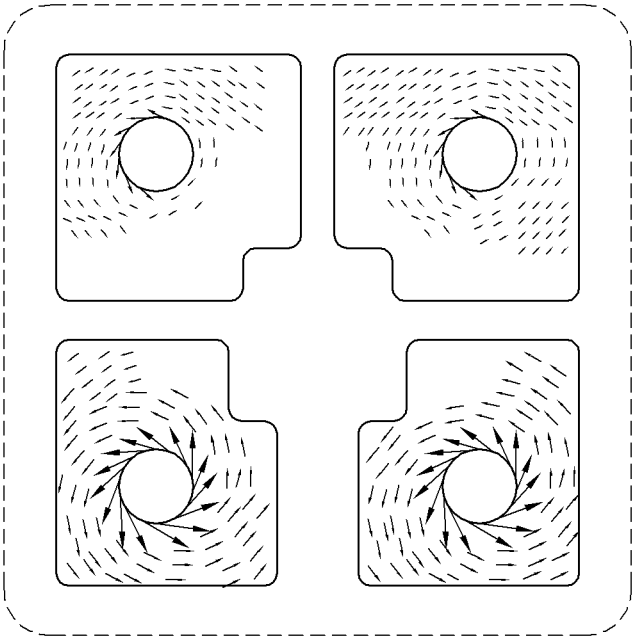
Figure 34B:
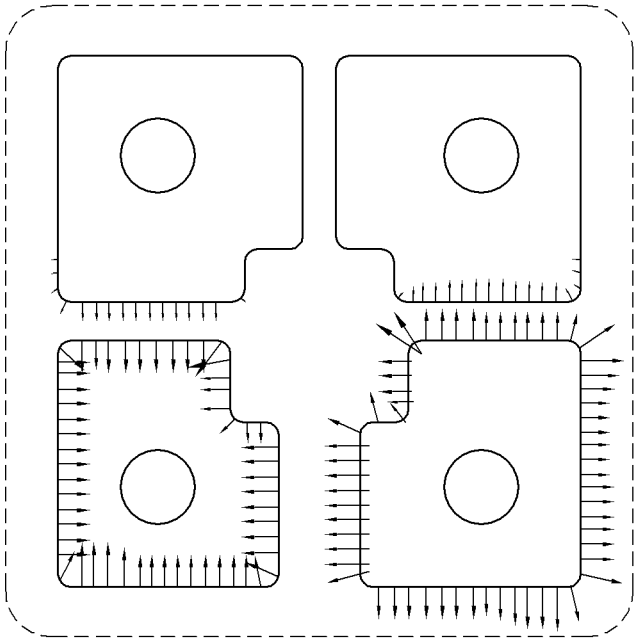
Figure 34B:
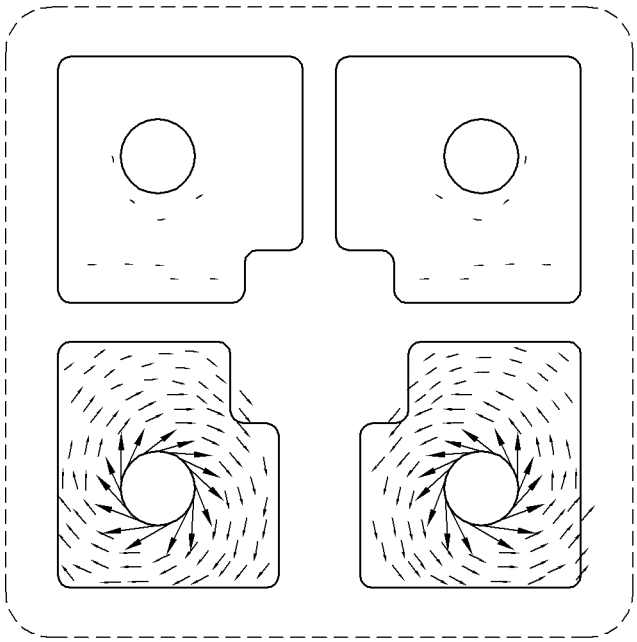
Figure 34C:
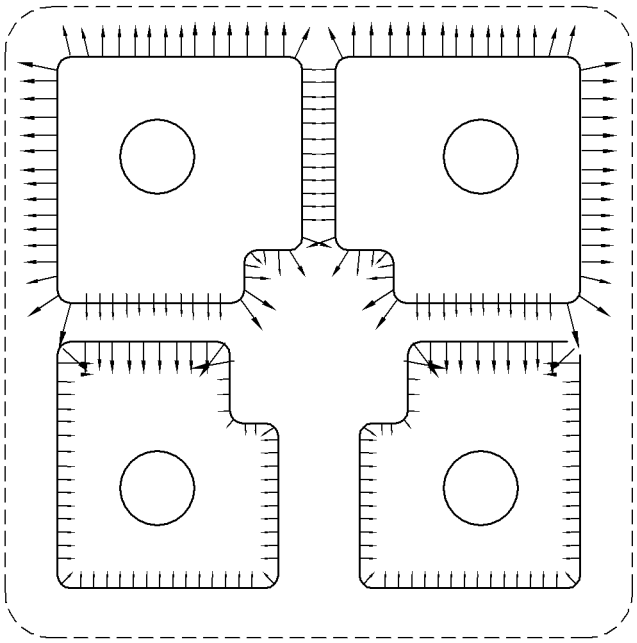
Figure 34C:
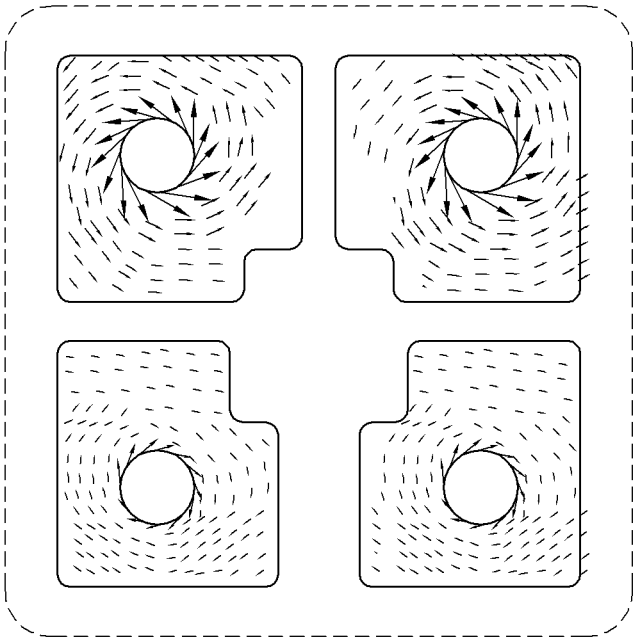
Figure 34D:
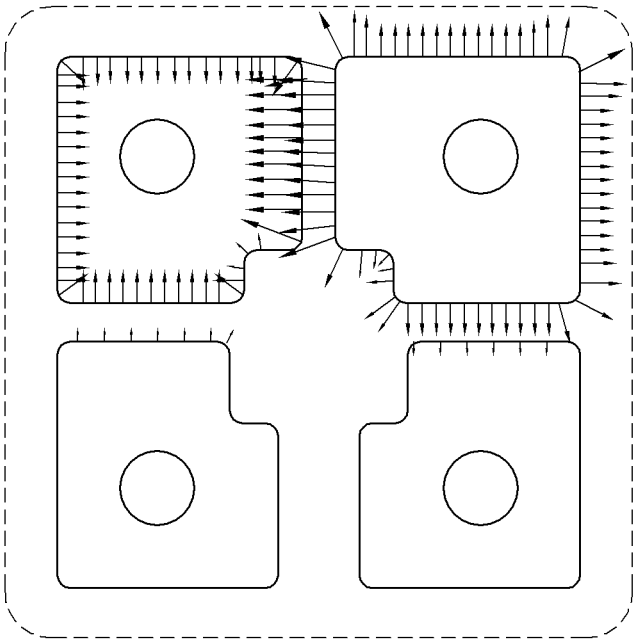
Figure 34D:
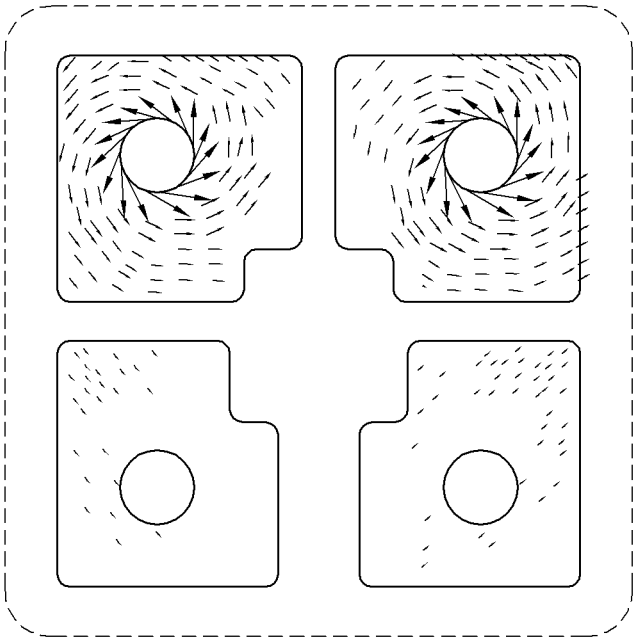

FIG. 33 is a structural diagram of a multi-mode resonator corresponding to a bandpass filter according to a nineteenth embodiment of the present disclosure, in which (a) of FIG. 33 illustrates a perspective projection structure, (b) illustrates a top plan structure, and (c) illustrates a side structure. The resonator according to the nineteenth embodiment of the present disclosure illustrated in FIG. 33, like the structures according to the above-described embodiments, may include a cavity 2100, four resonance arms 2111, 2112, 2113, and 2114, and first through fourth resonance legs 2121, 2122, 2123, and 2124.

However, the structure according to the nineteenth embodiment illustrated in FIG. 33, unlike in the structures according to the other embodiments, at least a pair of resonance arms have a plate shape. For example, in FIG. 33, all of four resonance arms 2111 through 2114 have the shape of a relatively wide plate. In this case, the first through fourth resonance arms 2111 through 2114 have a rectangular plate shape, and in the example of FIG. 33, each of the first through fourth resonance arms 2111 through 2114 has a shape in which at least a corner portion is cut as indicated by A. In addition, as indicated by B, a partition may be further installed between resonance arms.

When the first through fourth resonance arms 2111 through 2114 have a wide plate shape, such a structure is favorable to a filter that has a large size (and also a large cavity) and is applied to a low-frequency band, and increases a capacitance component between the resonance arms and the housing. Also, in this case, to address a difficulty in coupling between resonance arms, the first through fourth resonance arms 2111 through 2114 may have a rectangular plate shape as described above, facilitating coupling therebetween. Moreover, a corner portion of each of the first through fourth resonance arms 2111 through 2114 may be cut, such that the intensity of coupling therebetween, notch generation, etc., may be adjusted.

Main multi-mode resonance characteristics of the resonator having the structure illustrated in FIG. 33 are as illustrated in FIGS. 34A through 34D. In each of FIGS. 34A through 34D, (a) shows E-field characteristics and (b) shows H-field characteristics.

Figure 35:
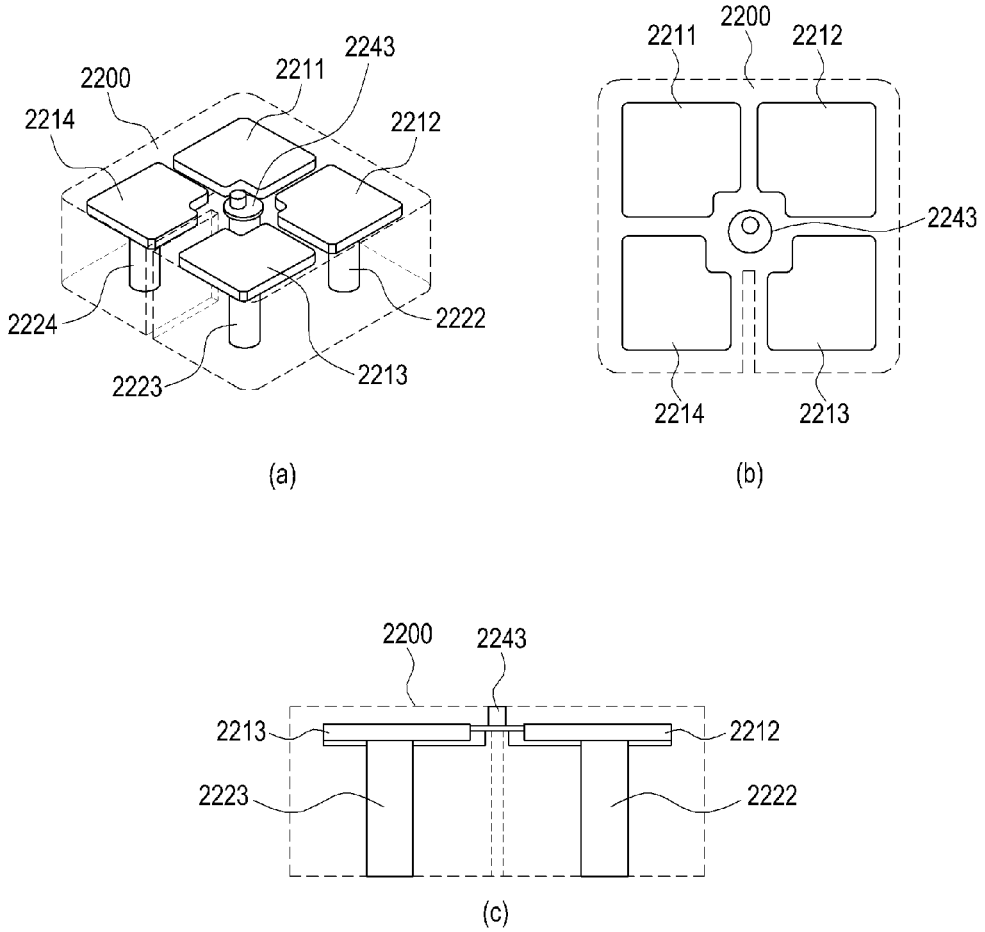
FIG. 35 is a structural diagram of a multi-mode resonator corresponding to a bandpass filter according to a twentieth embodiment of the present disclosure.

FIG. 35 is a structural diagram of a multi-mode resonator corresponding to a bandpass filter according to a twentieth embodiment of the present disclosure, in which (a) of FIG. 35 illustrates a perspective projection structure, (b) illustrates a top plan structure, and (c) illustrates a side structure. The resonator according to the twentieth embodiment of the present disclosure illustrated in FIG. 35, like the structure of the resonator according to the nineteenth embodiment illustrated in FIG. 33, may include a cavity 2200, four resonance arms 2211, 2212, 2213, and 2214, and first through fourth resonance legs 2221, 2222, 2223, and 2224.

Figure 36:
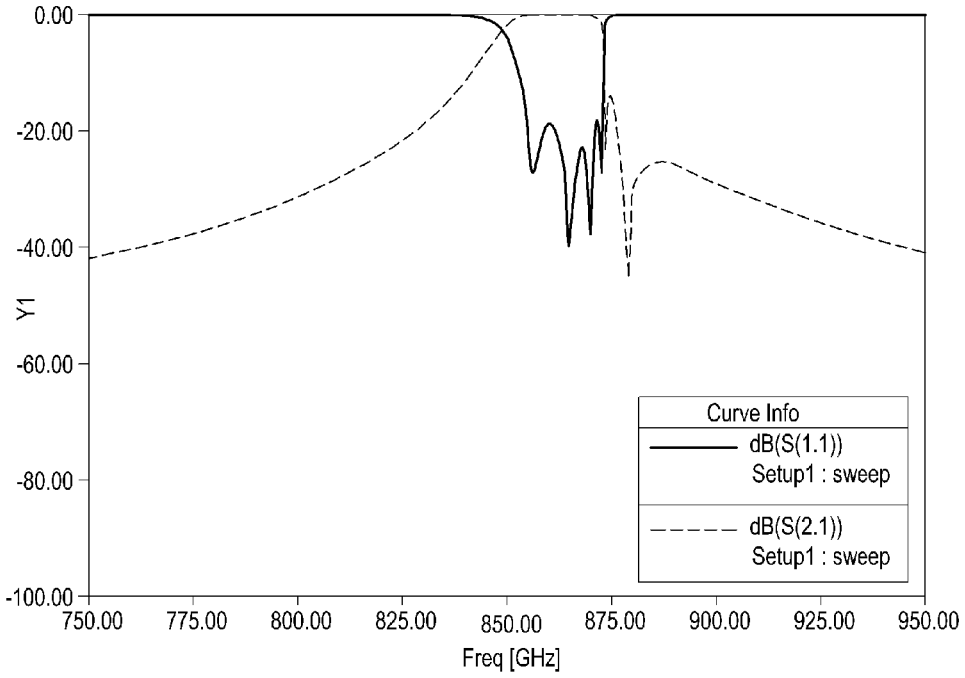
FIG. 36 is a graph showing frequency filtering characteristics of the multi-mode resonator illustrated in FIG. 35.

However, in the twentieth embodiment illustrated in FIG. 35, unlike in the nineteenth embodiment illustrated in FIG. 33, in the center of the entire structure of the four resonance arms 2211 through 2214 is provided a tuning screw 2243 which is installed to pass through a cover, etc., from an upper end of a housing (not shown). Frequency filtering characteristics of the resonator according to the twentieth embodiment are as shown in FIG. 36.

Figure 37:
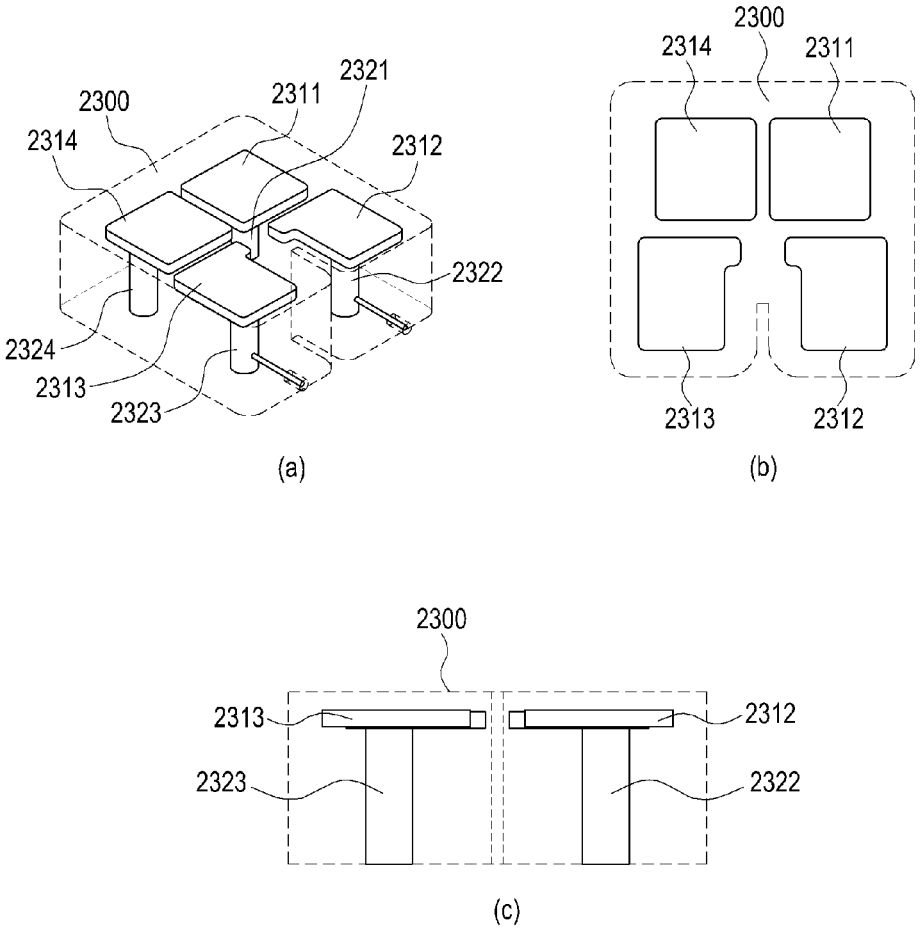
FIG. 37 is a structural diagram of a multi-mode resonator corresponding to a bandpass filter according to a twenty-first embodiment of the present disclosure.
Figure 38:
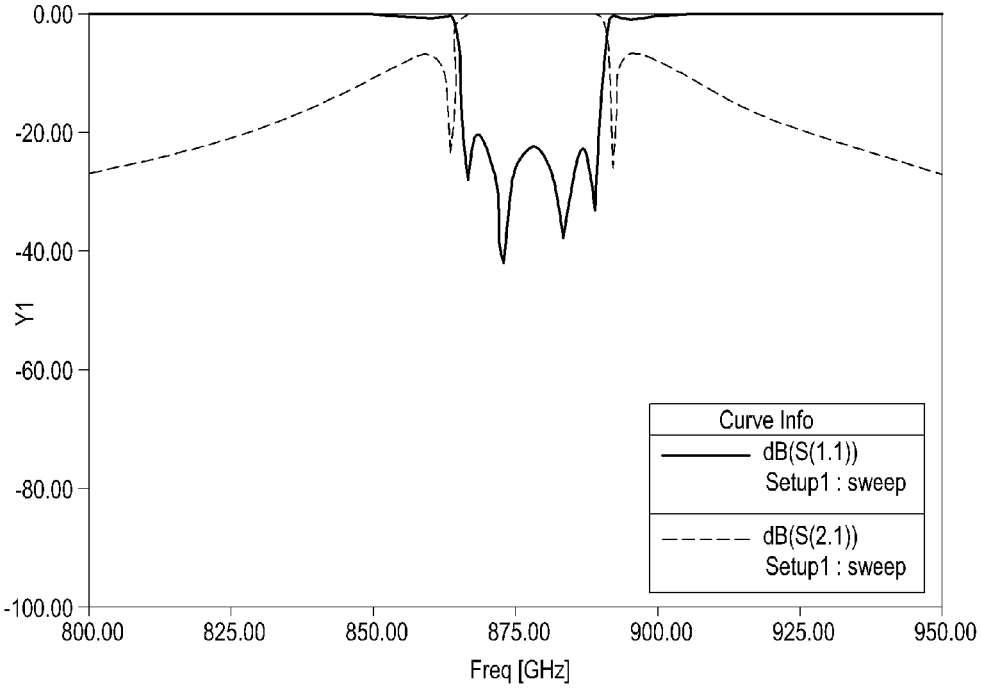
FIG. 38 is a graph showing frequency filtering characteristics of the multi-mode resonator illustrated in FIG. 37.

FIG. 37 is a structural diagram of a multi-mode resonator corresponding to a bandpass filter according to a twenty-first embodiment of the present disclosure, in which (a) of FIG. 37 illustrates a perspective projection structure, (b) illustrates a top plan structure, and (c) illustrates a side structure. The resonator according to the twenty-first embodiment of the present disclosure illustrated in FIG. 35, like the structure of the resonator according to the nineteenth embodiment illustrated in FIG. 33, may include a cavity 2300, four resonance arms 2311, 2312, 2313, and 2314, and first through fourth resonance legs 2321, 2322, 2323, and 2324.

However, in the twenty-first embodiment illustrated in FIG. 37, the shapes of the four resonance arms 2311 through 2314 are different from those in the nineteenth embodiment illustrated in FIG. 33. That is, as illustrated in FIG. 37, when compared to the nineteenth embodiment illustrated in FIG. 33, the first and fourth resonance arms 2311 and 2314 may have a complete rectangular shape without a cut corner portion, and cut portions of the second and third resonance arms 2312 and 2313 are designed differently than in the nineteenth embodiment. Frequency filtering characteristics of the resonator according to the twenty-first embodiment are as shown in FIG. 37.

Figure 39:
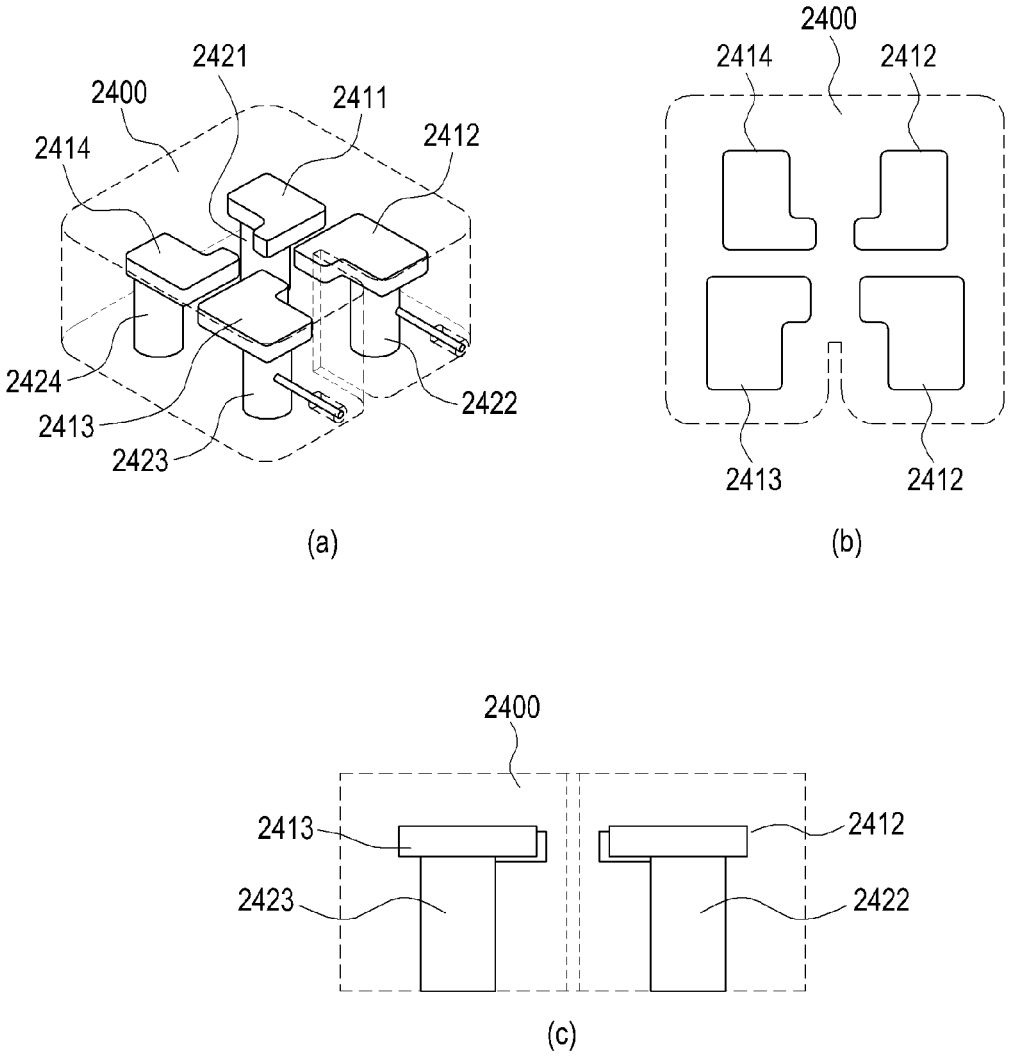
FIG. 39 is a structural diagram of a multi-mode resonator corresponding to a bandpass filter according to a twenty-second embodiment of the present disclosure.

FIG. 39 is a structural diagram of a multi-mode resonator corresponding to a bandpass filter according to a twenty-second embodiment of the present disclosure, in which (a) of FIG. 37 illustrates a perspective projection structure, (b) illustrates a top plan structure, and (c) illustrates a side structure. The resonator according to the twenty-second embodiment of the present disclosure illustrated in FIG. 39, like the structure of the resonator according to the nineteenth embodiment illustrated in FIG. 33, may include a cavity 2400, four resonance arms 2411, 2412, 2413, and 2414, and first through fourth resonance legs 2421, 2422, 2423, and 2424.

Figure 40:
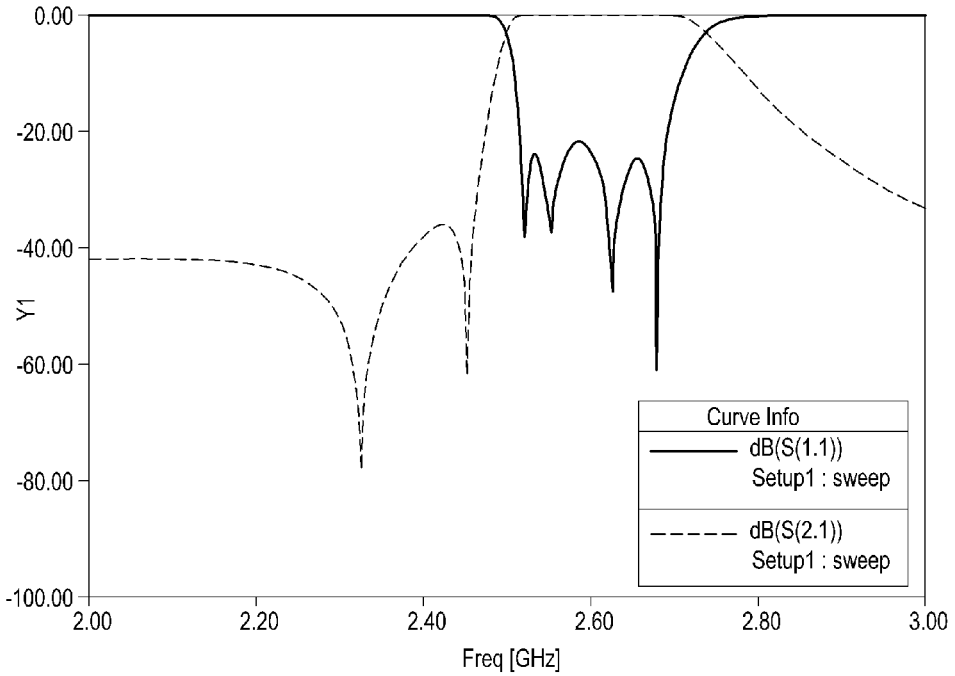
FIG. 40 is a graph showing frequency filtering characteristics of the multi-mode resonator illustrated in FIG. 39.

However, in the twenty-second embodiment illustrated in FIG. 39, the four resonance arms 2411 through 2414 are different from those in the nineteenth embodiment illustrated in FIG. 33 in terms of shapes, etc. That is, as illustrated in FIG. 39, the first and fourth resonance arms 2411 and 2414 may have cut corner portions that are different from those in the nineteenth embodiment illustrated in FIG. 33, and shapes and thicknesses of a plate shape are also set different from in the nineteenth embodiment. Moreover, thicknesses of the four resonance legs 2421 through 2424 may also be set different from in the nineteenth embodiment. Frequency filtering characteristics of the resonator according to the twenty-second embodiment are as shown in FIG. 40.

Figure 41:
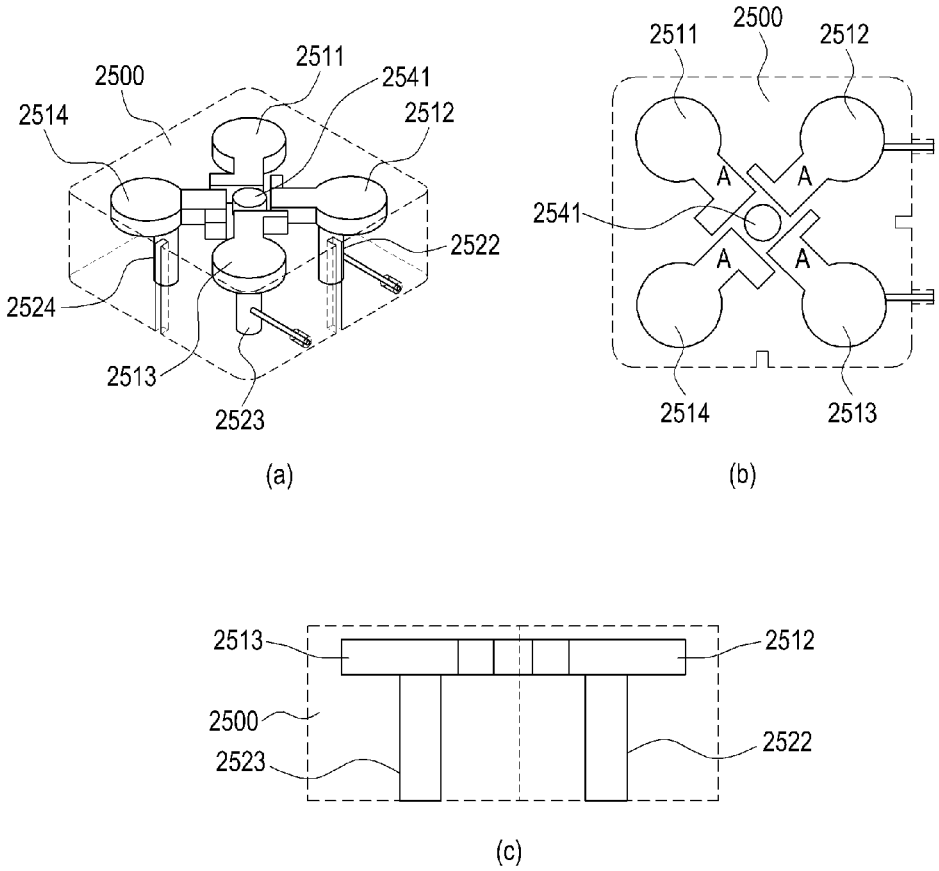
FIG. 41 is a structural diagram of a multi-mode resonator corresponding to a bandpass filter according to a twenty-third embodiment of the present disclosure.

FIG. 41 is a structural diagram of a multi-mode resonator corresponding to a bandpass filter according to a twenty-third embodiment of the present disclosure, in which (a) of FIG. 41 illustrates a perspective projection structure, (b) illustrates a top plan structure, and (c) illustrates a side structure. The resonator according to the twenty-third embodiment of the present disclosure illustrated in FIG. 41, like the structures according to the above-described other embodiments, may include a cavity 2500, four resonance arms 2511, 2512, 2513, and 2514, and first through fourth resonance legs 2521, 2522, 2523, and 2524.

Figure 42:
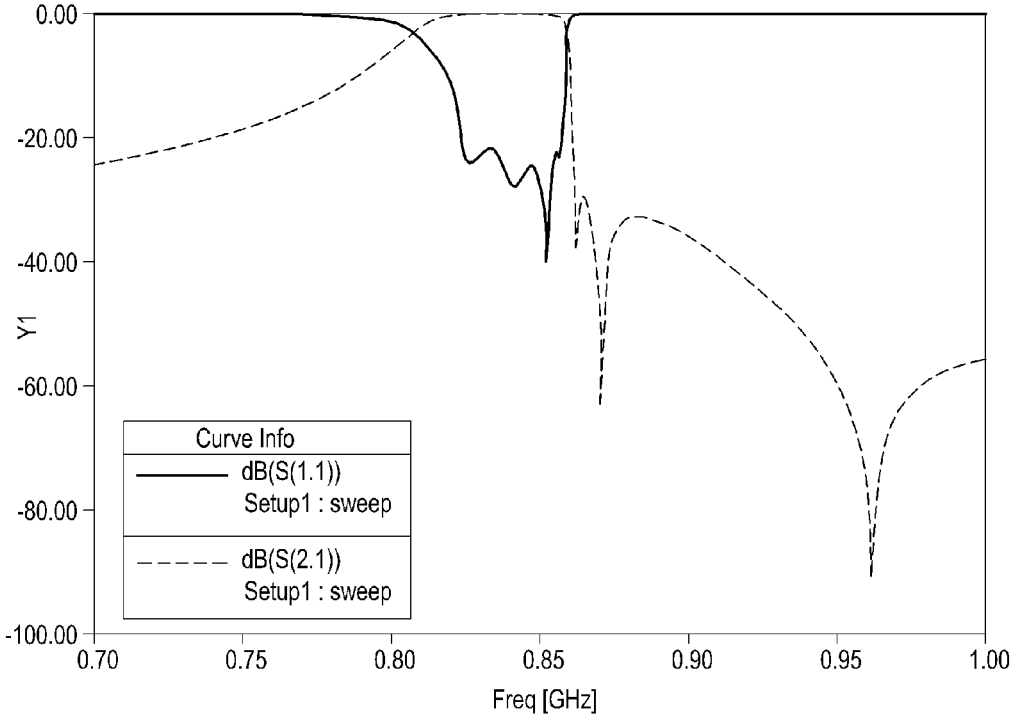
FIG. 42 is a graph showing frequency filtering characteristics of the multi-mode resonator illustrated in FIG. 41.

In the twenty-third embodiment illustrated in FIG. 41, the four resonance arms 2511 through 2514 have a wide plate shape like in the nineteenth embodiment illustrated in FIG. 33, and especially, the first through fourth resonance arms 2511 and 2514 may have a disc shape. In this case, to solve a difficulty in coupling between resonance arms, an extending structure (indicated by A in FIG. 41) in a proper shape is formed in each of the first through fourth resonance arms 2511 through 2514 to extend from each disc structure toward the center of the entire structure of the four resonance arms 2511 through 2514. With such extending structures, the first through fourth resonance arms 2511 through 2514 are electrically close to one another, enabling smooth coupling therebetween. In addition, in the example illustrated in FIG. 41, a tuning structure 2541 is further installed to electrically float in the center of the entire structure of the four resonance arms 2511 through 2514. Frequency filtering characteristics of the resonator according to the twenty-third embodiment are as shown in FIG. 42.

Figure 43:
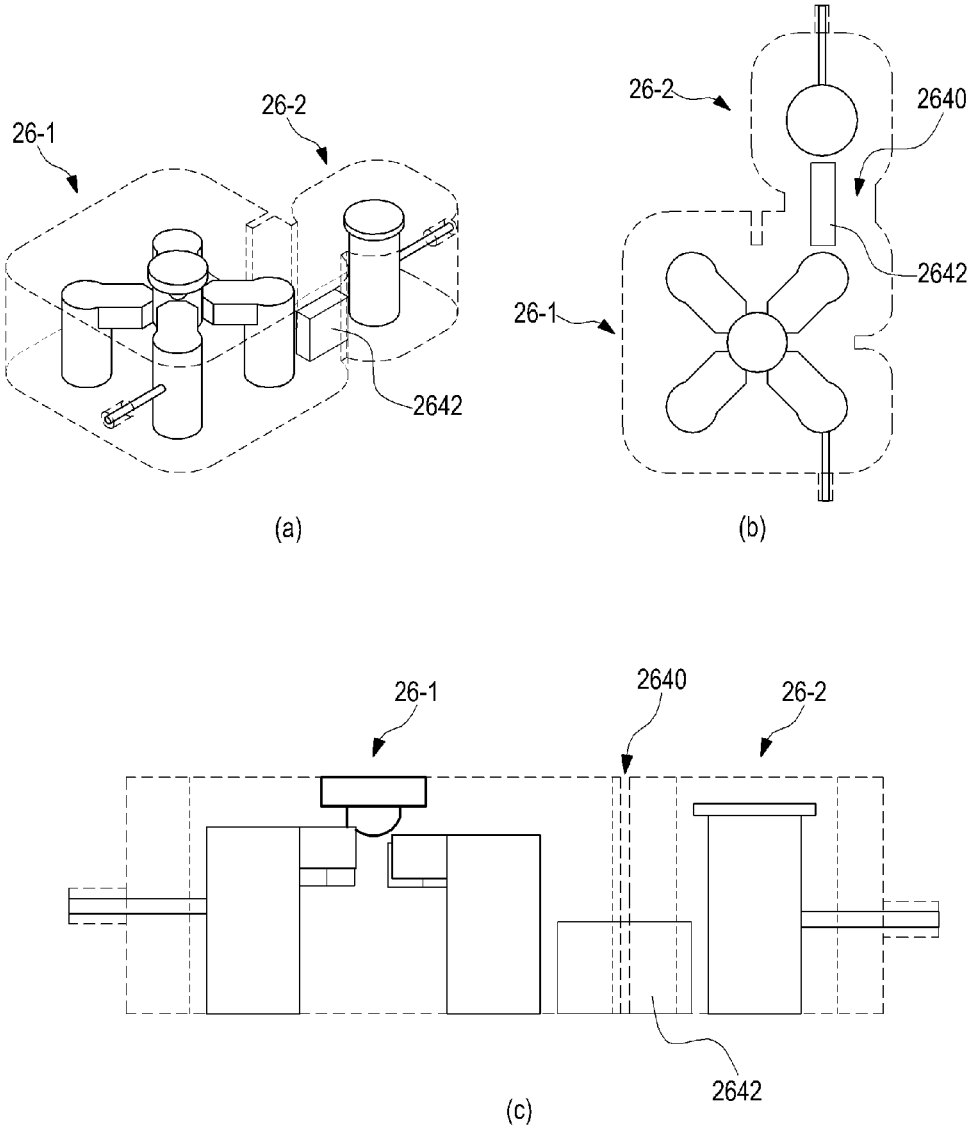
FIG. 43 is a structural diagram of a multi-mode resonator corresponding to a bandpass filter according to a twenty-fourth embodiment of the present disclosure.

FIG. 43 is a structural diagram of a multi-mode resonator corresponding to a bandpass filter according to a twenty-fourth embodiment of the present disclosure, in which (a) of FIG. 43 illustrates a perspective projection structure, (b) illustrates a top plan structure, and (c) illustrates a side structure. The resonator according to the twenty-fourth embodiment of the present disclosure illustrated in FIG. 43 is structured such that a first resonator 26-1 having the same structure as the structure of the resonator according to the sixteenth embodiment illustrated in FIG. 27 and a second resonator 26-2 having the same structure as a general structure of a single-mode resonator are coupled to each other. That is, an output side of the first resonator 26-1 and an input side of the second resonator 26-2 are connected to each other by a coupling window 2640, and a coupling structure 2642 extending from a bottom surface of a cavity is further installed in the coupling window 2640.

Figure 44:
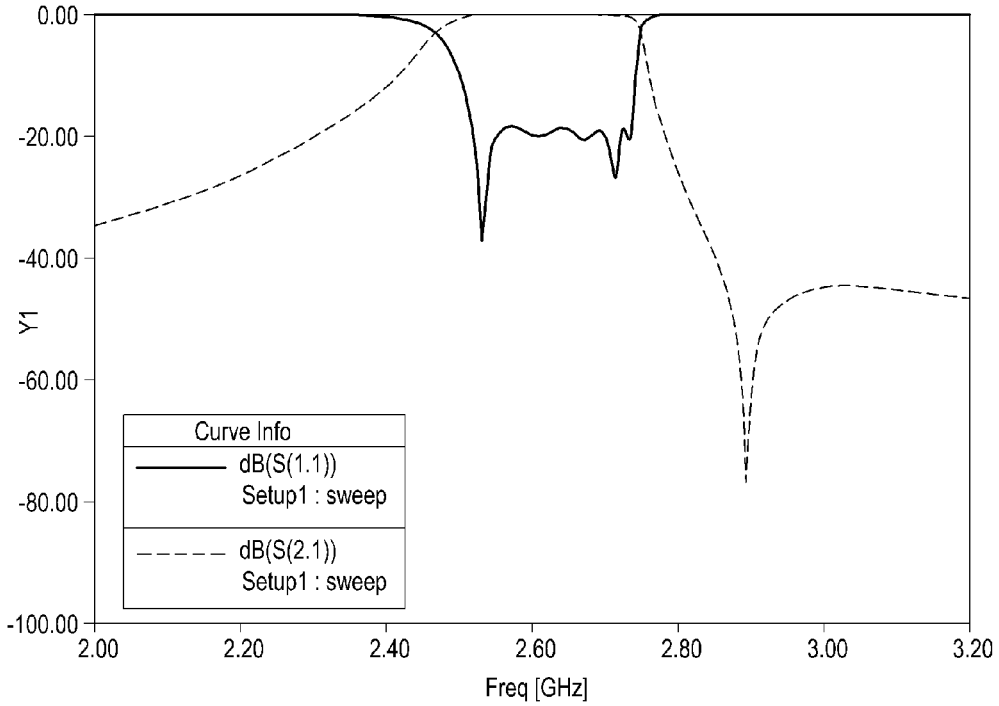
FIG. 44 is a graph showing frequency filtering characteristics of the multi-mode resonator illustrated in FIG. 43.

As such, the single-mode resonator having the general structure and the resonators according to the embodiments of the present disclosure may be coupled, and it would be understood that in the example illustrated in FIG. 44, the resonators having various structures according to the embodiments of the present disclosure may be coupled with the resonator having the general structure. Frequency filtering characteristics of the resonator according to the twenty-fourth embodiment are as shown in FIG. 44.

The multi-mode resonator according to an embodiment of the present disclosure may be structured as described above, and while detailed embodiments have been described in the description of the present disclosure, various modifications may be made without departing from the scope of the present disclosure.

For example, in the above-described structures, multiple tuning structures may be further installed in multiple positions inside the cavity for resonant frequency tuning and coupling adjustment between resonance modes. Such a tuning structure may have a cylindrical shape and may be fixedly installed by a separate support in the cavity as shown in FIGS. 9 and 10, or may have a shape of a tuning screw installed to pass through the housing (or cover) and inserted into the cavity like in a conventional filter structure.

Although the number of resonance arms is 4 in the foregoing description, a more number of resonance arms may be installed in one cavity. Also in this case, the number of resonance arms may be designed to be a multiple of 2.

In some of the above-described embodiments, a filter structure is designed such that two or more multi-mode resonators are provided and are dually connected overlappingly, but in other embodiments of the present disclosure, but in other embodiments of the present disclosure, the filter structure may be designed by connecting the structures according to the embodiments in two stages or three or more stages to obtain desired characteristics.

Also, in the foregoing embodiments, the first through fourth resonance arms are made of a metallic material, but they may also be made of a dielectric material like dielectric resonance elements in other embodiments of the present disclosure.

As described above, a multi-mode resonator according to the present disclosure may provide resonant frequencies in multiple modes to a single resonator.

Thus, the size, weight, and manufacturing cost of the filter may be reduced.

As such, various modifications and changes may be made to the present disclosure, and thus the scope of the present disclosure should be defined by the appended claims and equivalents thereof, rather than by the described embodiments.

What is claimed is:

1. A multi-mode resonator comprising:

a housing provided with a cavity corresponding to a substantially single accommodation space;

a plurality of resonance arms which are arranged with a predetermined interval therebetween in the cavity and generate a resonant signal by multiple coupling therebetween; and a plurality of resonance legs which support the plurality of resonance arms, respectively.

2. The multi-mode resonator of claim 1, wherein a pair of resonance arms among the plurality of resonance arms have a plate shape.

3. The multi-mode resonator of claim 1, further comprising a tuning structure installed in a center of an entire arrangement structure of the plurality of resonance arms to electrically float.

4. The multi-mode resonator of claim 1, further comprising a tuning screw installed in a center of an entire arrangement structure of the plurality of resonance arms to pass through from an upper end of the housing.

5. The multi-mode resonator of claim 1, further comprising an input probe and an output probe which are connected to the plurality of resonance legs to exchange input and output signals with a pair of resonance arms among the plurality of resonance arms.

6. The multi-mode resonator of claim 1, wherein the cavity has a polyhedral shape.

7. The multi-mode resonator of claim 1, wherein the plurality of resonance arms are arranged with an equal interval therebetween.

8. The multi-mode resonator of claim 1, wherein the plurality of resonance arms are arranged in pairs to face each other, and the pairs of resonance arms are arranged to cross each other.

9. The multi-mode resonator of claim 1, wherein at least an edge portion of at least one of the plurality of resonance arms is cut.

10. The multi-mode resonator of claim 1, wherein at least one partition is installed between the plurality of resonance arms.

11. The multi-mode resonator of claim 1, wherein the plurality is a multiple of 2, and the multi-mode resonator further comprises a resonance rod installed in a center of the cavity.

12. The multi-mode resonator of claim 11, wherein the multiple of 2 is four.

13. The multi-mode resonator of claim 12, wherein a number of resonance modes is five.

14. The multi-mode resonator of claim 1, wherein the plurality of resonance arms have a rectangular parallelepiped shape that is longitudinally long.

15. The multi-mode resonator of claim 14, wherein a longitudinal length of a pair of resonance arms among the plurality of resonance arms is set different from a longitudinal length of the other pair of resonance arms.

* * * * *